US007594873B2

(12) United States Patent
Terao et al.

(10) Patent No.: US 7,594,873 B2
(45) Date of Patent: Sep. 29, 2009

(54) EXERCISE-DATA MANAGEMENT SERVER APPARATUS AND EXERCISE-DATA MANAGEMENT SYSTEM

(75) Inventors: Shin Terao, Kobe (JP); Yutaka Sakaue, Akashi (JP); Ken Midorikawa, Akashi (JP)

(73) Assignee: Konami Sports & Life Co., Ltd., Tokyo (JP)

( * ) Notice: Subject to any disclaimer, the term of this patent is extended or adjusted under 35 U.S.C. 154(b) by 508 days.

(21) Appl. No.: 11/633,866

(22) Filed: Dec. 4, 2006

(65) Prior Publication Data

US 2007/0142179 A1 Jun. 21, 2007

(30) Foreign Application Priority Data

Dec. 15, 2005 (JP) ..... 2005-362306

(51) Int. Cl.
*A63B 71/00* (2006.01)

(52) U.S. Cl. ..... 482/1; 482/8; 482/9; 482/900

(58) Field of Classification Search ..... 482/1–9, 482/900–902; 434/247; 600/300, 301
See application file for complete search history.

(56) References Cited

U.S. PATENT DOCUMENTS

| | | | | |
|---|---|---|---|---|
| 6,659,916 | B1 * | 12/2003 | Shea | 482/57 |
| 6,997,852 | B2 * | 2/2006 | Watterson et al. | 482/1 |
| 2002/0042328 | A1 * | 4/2002 | Yoo | 482/8 |

FOREIGN PATENT DOCUMENTS

| | | |
|---|---|---|
| JP | 10-230035 | 9/1998 |
| JP | 2002-347937 | 12/2002 |
| JP | 2004-192467 | 7/2004 |
| JP | 2005-202856 | 7/2005 |
| JP | 2005-216044 | 8/2005 |
| JP | 2005-293443 | 10/2005 |

* cited by examiner

*Primary Examiner*—Glenn Richman
(74) *Attorney, Agent, or Firm*—Jordan and Hamburg LLP

(57) ABSTRACT

Disclosed is an exercise-data management system, which comprises a wristband 8 including an IC chip 7 recording therein unique information for authenticating a participant, a studio gate 3 set up in a studio and adapted to wirelessly receive and read the unique information recorded in the IC chip, and an exercise-data management server apparatus 4. The studio gate 3 is operable, when the unique information is read, to transmit information indicating the read to the exercise-data management server apparatus 4. The exercise-data management server apparatus 4 includes a schedule storage section which stores, as a schedule, a location and a time zone in which an exercise is to be performed, and stores a standard consumed calorie value in association with an exercise type, and a total-consumed-calorie calculation section operable, based on the received unique information and the contents stored in the schedule storage section, to acquire a consumed calorie value for a participant corresponding to the unique information. The exercise-data management system of the present invention allows the studio gate 3 as a reader apparatus to read the unique information of the wristband 8 as portable unique-information storage means, through a one-time operation.

9 Claims, 37 Drawing Sheets

FIG.5

| No | BIT 1 | BIT 2 | BIT 3 | STUDIO GATE SETUP LOCATION |
|---|---|---|---|---|
| a | 0 | 0 | 0 | STUDIO 1 |
| b | 0 | 0 | 1 | STUDIO 2 |
| c | 0 | 1 | 0 | STUDIO 3 |
| d | 0 | 1 | 1 | POOL 1 |
| e | 1 | 0 | 0 | POOL 2 |
| f | 1 | 0 | 1 | EXTRA (FOR EVENT ETC.) |
| g | 1 | 1 | 0 | EXTRA (FOR EVENT ETC.) |
| h | 1 | 1 | 1 | EXTRA (FOR EVENT ETC.) |

EXERCISE-DATA MANAGEMENT SERVER APPARATUS AND EXERCISE-DATA MANAGEMENT SYSTEM

BACKGROUND OF THE INVENTION

1. Field of the Invention

The present invention relates to an exercise-data management system for managing information about participant's exercise results, and an exercise-data management server apparatus for use in the system.

2. Description of the Related Art

Heretofore, there has been proposed a training management system designed such that a card reader is arranged in a terminal equipped in a training machine to collect a use result in response to each user's action of inserting his/her own user card into the card reader at the start of use and detaching the user card from the card reader at the end of the use, and then transfer the use result to a host computer (server apparatus, etc.) via a network (see Japanese Patent Laid-Open Publication No. 10-230035). In a training having difficulty in collecting a use result, such as aerobics, swimming or free weights, this system is designed to measure, as a use time, a time period where a user card is inserted into an identification section (card reader) of a terminal placed in a training area, and calculate a consumed calorie value in accordance with the use time.

As above, in the training, such as aerobics, having difficulty in collecting a use result, the system disclosed in Japanese Patent Laid-Open Publication No. 10-230035 is designed to measure, as a use time, a time period where a user card is inserted into an identification section of a terminal placed in a training area, and calculate a consumed calorie value in accordance with the use time. However, in a mass exercise, such as aerobics or swimming, where training is performed in a group of participants or users, the card reader must be provided in a number equal to that of users, and therefore the scale of the system will be inevitably expanded. It is also necessary for the system to keep the user card inserted in the card reader during the exercise, and thereby each user will be obliged to perform a user-card inserting operation at the start of the exercise and a user-card detaching operation at the end of the exercise. Moreover, a time difference between the insertion and detachment timings is likely to cause an undesirable situation where the user erroneously detaches other user's card.

As one alternative of the above system, it is contemplated that a participant manually inputs exercise data to a management server for himself/herself. In this case, the participant has to perform the input operation after exercise or before returning home from a training gym. This operation is complicated and troublesome for the participant who is physically exhausted. Moreover, the participant inputs his/her own exercise result in reliance on memory, and therefore can fail to input accurate data, particularly, after performing plural types of exercises. In the worst case, wrong data is likely to be entered during the input operation.

SUMMARY OF THE INVENTION

In view of the above problems, it is an object of the present invention to provide an exercise-data management system making it possible to perform a manual operation for allowing a reader apparatus to read unique information for authenticating a participant, from portable unique-information storage means recording therein the unique information, through a one-time operation without the need for a complicated operation, and keep accurate data record. It is an object of the present invention to provide an exercise-data management server apparatus for use in the exercise-data management system.

In order to achieve the above objects, the present invention is directed to an exercise-data management system for managing information about participant's exercise results, which comprises portable unique-information storage means recording therein unique information for authenticating a participant, a reader apparatus set up corresponding to a location where an exercise is performed and adapted to read the unique information recorded in the unique-information storage means, and an exercise-data management server apparatus set up at a given location. In the exercise-data management system, the reader apparatus includes a reader-side communication section operable, when the unique information is read, to transmit information indicating the read to the exercise-data management server apparatus. Further, the exercise-data management server apparatus includes first storage means storing, as a schedule, a time zone in which an exercise is to be performed, second storage means storing predetermined exercise result-related information in association with respective types of exercises, server-side communication means operable to receive, from the reader apparatus, the unique information and the read-indicating information of the unique information, and exercise data acquisition means operable, based on the unique information and the read-indicating information each received by the server-side communication means and the contents stored in the first and second storage means, to acquire predetermined information about an exercise result of a participant who has taken along the unique-information storage means.

In the exercise-data management system of the present invention, when a user performs an operation for allowing the reader apparatus to read the unique information for authenticating a participant (the user) from the unique-information storage means, i.e., a one-time operation, the unique information is read by the reader apparatus, and the unique information and the read-indicating information are transferred to the exercise-data management server apparatus through the reader-side communication section and the server-side communication means. When the reader apparatus is equipped with a clock-time counter, the read-indicating information includes clock-time information. If the reader apparatus has no built-in clock-time counter (in this case, a clock-time counter is built in the exercise-data management server apparatus), the read-indicating information will consist of information indicating a read processing at a time of the read. The exercise data acquisition means of the exercise-data management server apparatus acquires clock-time information from the received information, and collates the clock-time information with the stored content of the first storage means to identify the type of exercise (exercise category) corresponding to the time zone including the received clock-time data and acquire predetermined information about an exercise result corresponding to the identified exercise type, from the stored content of the second storage means.

These and other objects, features and advantages of the invention will become apparent upon reading the following detailed description along with the accompanying drawings.

BRIEF DESCRIPTION OF THE DRAWINGS

FIG. 5 is an explanatory table showing a method of setting switches of the studio gate.

DETAILED DESCRIPTION OF THE PREFERRED EMBODIMENTS OF THE INVENTION

Figure 1:
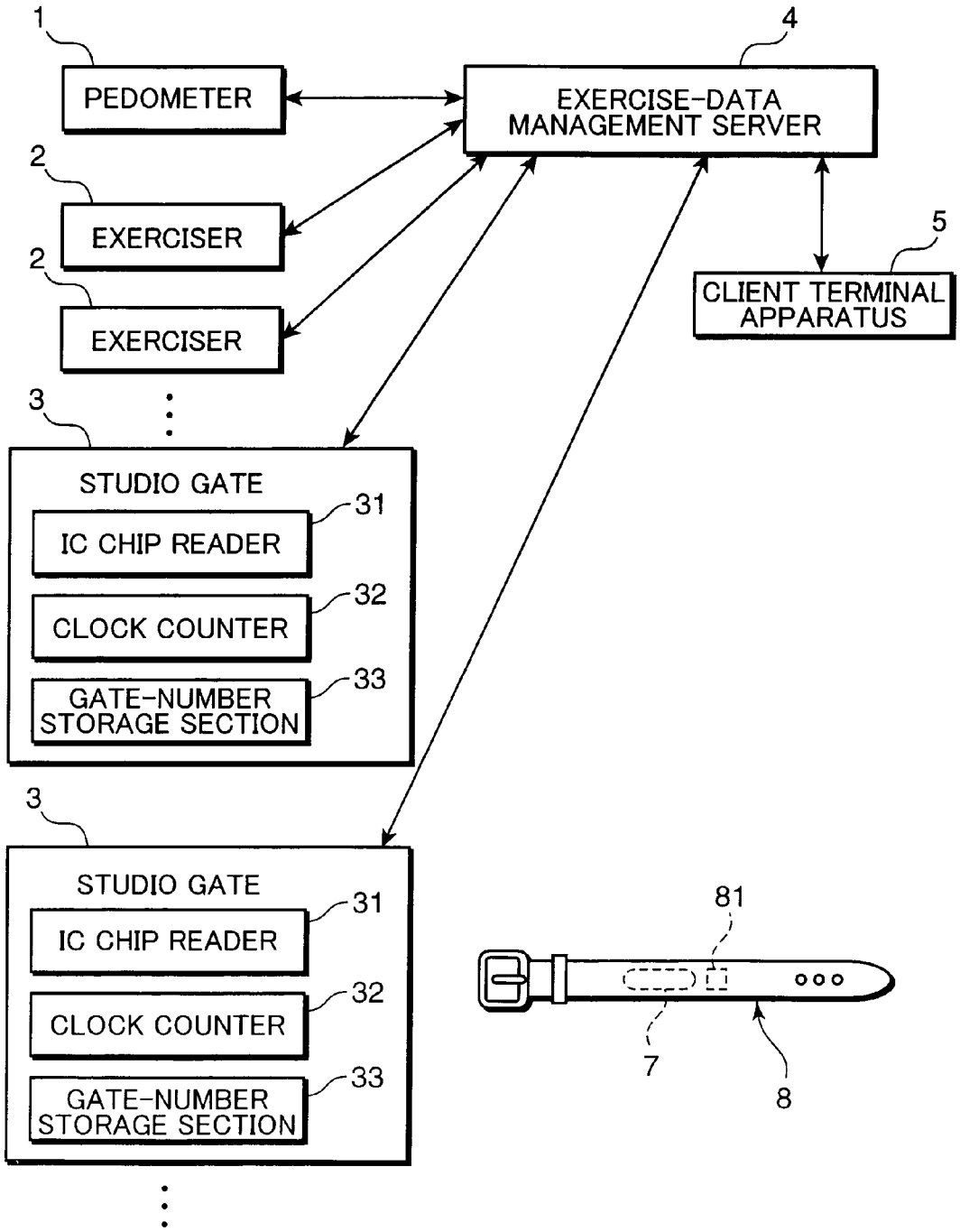
FIG. 1 is a block diagram showing a hardware configuration of an exercise-data management system according to one embodiment of the present invention.

FIG. 1 shows one example of a hardware configuration of an exercise-data management system according to one embodiment of the present invention. The exercise-data management system comprises: a portable pedometer 1 for counting and storing the number of user's steps; a plurality of exercisers 2, such as a stationary-type cycling machine, installed in a fitness club; a studio gate 3 (corresponding to a reader apparatus) for detecting identification information of a user or participant to a studio which is arranged in the fitness club to allow a group of participants to perform therein an exercise, such as aerobics, swimming, Tai Chi or yoga; an exercise-data management server apparatus 4 for managing exercise data of users of the fitness club; and one or a required number of client terminal apparatuses 5 each connected communicatably to the exercise-data management server apparatus 4 and adapted to, in response to an input from outside, display various screen images on a monitor.

The pedometer 1 has a function of counting the number of walking steps or running steps (steps during running) of a user, based on a signal from a sensor, such as a piezoelectric element, and a lock function. Thus, the pedometer 1 is operable to store the number of walking and running steps at given time intervals (e.g., 1 hour) in association with clock-time (i.e., date-and-hour) information. The pedometer 1 is provided with a button for accepting an input from outside, and a display composed, for example, of an LCD, and adapted to display various data (e.g., a total number of steps per day) in response to a manual operation of the button.

The exercisers 2 are used for allowing users of the fitness club to perform various exercises. Each of the exercisers 2 is communicatably connected to the exercise-data management server apparatus 4, and adapted to transmit information, for example, about a consumed calorie value therein, to the exercise-data management server apparatus 4, in association with identification information of each user (hereinafter referred to as "user identification information").

The studio gate 3 comprises an IC chip reader 31 for reading ID information stored in an after-mentioned IC chip (the ID information will hereinafter be referred to as "IC-chip ID"), and a clock counter 32 having a clock function. Specifically, the IC chip reader 31 is operable to read IC-chip ID as identification information of each studio which is arranged in the fitness club to allow a group of participants to perform therein an exercise, such as aerobics, swimming, Tai Chi or yoga. The clock counter 32 is operable to detect clock time (second, minute, hour, day, month, year) of entrance into the studio, and transmit the IC-chip ID and the entrance clock-time information to the exercise-data management server apparatus 4 in a mutually associated manner. When the studio gate 3 is provided in a plural number, each of the studio gates 3 further includes a gate-number storage section 33 for storing a gate number as a gate identification number. In this case, the clock counter 32 is operable to transmit the gate number, the IC-chip ID and the entrance clock-time information to the exercise-data management server apparatus 4 in a mutually associated manner.

The exercise-data management server apparatus 4 is adapted to read step-number data and exercise data, respectively, from the pedometer 1 and each of the exercisers 2 (the exercise data from each of the exercisers 2 will hereinafter be referred to as "second exercise data"), and calculate a total consumed calorie value, i.e., a sum of consumed calories, on a user-by-user basis, in accordance with the read step-number data, the second exercise data, and information received from the studio gate 3.

The client terminal apparatus 5 is adapted to, in response to an input from outside, receive various data from the exercise-data management server apparatus 4 so as to display various screen images depending on user's requests, and, in response to an input from outside, transmit various data to the exercise-data management server apparatus 4.

A process of identifying a user in the fitness club will be briefly described below. When a user applies for admission to the fitness club, an ID card 6 storing therein user's name, user's birth date, user's ID, etc., is issued, and the information about user's name, user's birth date, user's ID, etc., are stored in the pedometer 1 and the exercise-data management server apparatus 4. In advance of use of the fitness club, when the user presents the ID card 6 (not shown) to a front desk of the fitness club, the user ID stored in the ID card 6 is collated with the user ID stored in the exercise-data management server apparatus 4 to determine whether the user is a club member. If the user is determined to be a club member, the user is admitted to enter the fitness club. Simultaneously, a portable wristband 8 (unique-information storage means) which has a function usable for a personal authentication in the fitness club and an includes an IC chip 7 storing therein IC-chop ID, etc., in an embedded manner at an appropriate position thereof is given to the user, and the IC-chip ID is stored in an after-mentioned staying-user data storage section 4627 of the exercise-data management server apparatus 4 in association with the user ID. In each of the equipments, such as the exercisers 2, the studio gate 3 and the client terminals 7, the personal authentication is performed by bring the wristband 8 close to an IC chip reader arranged in each of the equipments.

As shown in FIG. 1, the wristband 8 has a simulated shape of a wristwatch. The wristband 8 includes the IC chip 7 having the IC-chop ID and other information written thereinto, and a communication section 81 adapted to perform a signal transmission with an electric power capable of transmitting the above information toward the outside only within a relatively short distance. This allows only information of a specific user who intents to obtain the personal authentication to be read while preventing information of someone around the specific user from being erroneously read.

Figure 2:
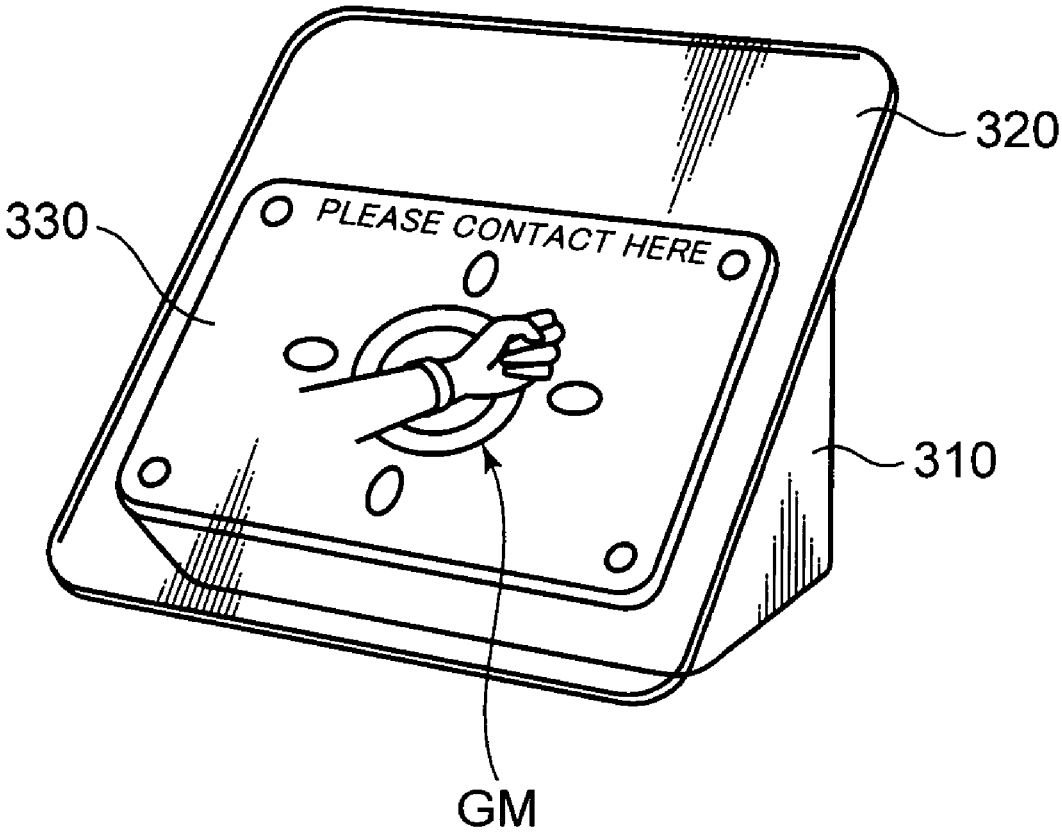
FIG. 2 is an external perspective view showing a studio gate.
Figure 3:
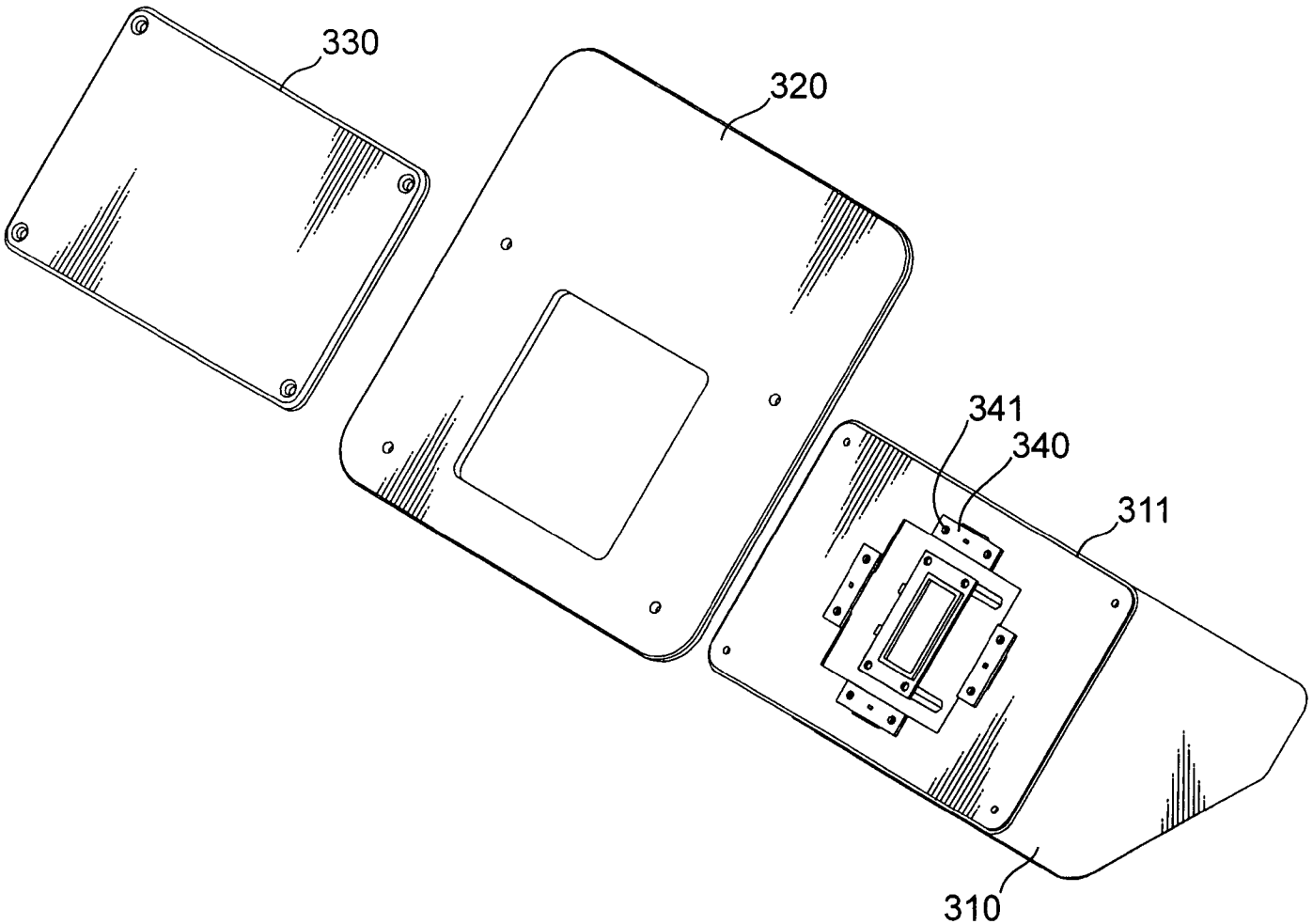
FIG. 3 is an exploded perspective view showing the studio gate.
Figure 4:
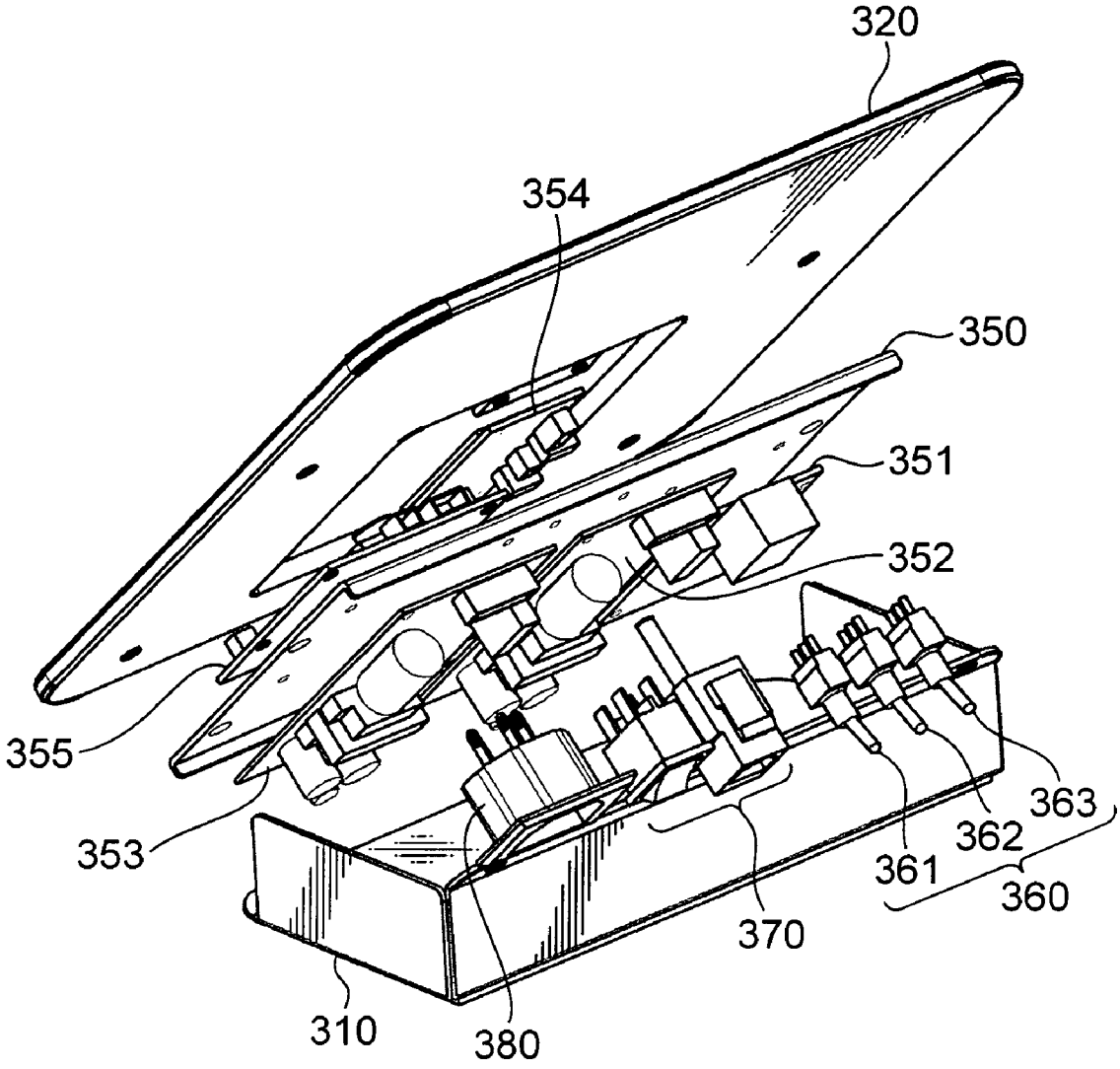
FIG. 4 is a diagram showing an internal structure of the studio gate.

FIGS. 2 to 5 show the structure of the studio gate 3, wherein FIG. 2 is an external perspective view; FIG. 3 is an exploded perspective view; FIG. 4 is a diagram showing an internal structure; and FIG. 5 is an explanatory table showing a method of setting switches of the studio gate.

In FIGS. 2 and 3, the studio gate 3 comprises a housing 310 having plural types of boards, a resin plate 320 arranged on an upper surface (front surface) of the housing 310 and formed in a given shape (in this embodiment, a quadrangular shape) employed in view of an aesthetic appearance, and a decorative panel 330 paved on an upper surface of the resin plate 320. The housing 310 has an approximately quadrangular shape in vertical sectional view, with an upper surface which is inclined at a given angle, for example about 45 degree (preferably 30 to 60 degree) to facilitate user's operation. The housing 310 has a cover 311 attached thereonto along the inclined upper surface and formed with an opening having a given shape. Further, a light-emission board 340 provided with an LED 341 as a light-emitting element is attached onto an appropriate position around the opening of the cover 311 (in this embodiment, the opening has a quadrangular shape, and four light-emission boards 340*d* are attached, respectively, to four edge portions of the cover 311 defining the opening).

The resin plate 320 is formed with an opening at a position opposed to the opening of the cover 311, and an upper surface of the resin plate 320 is translucently colored to an extent allowing a user to recognize emitted light from the LED 341 (annunciation section) through the resin plate 320. The resin plate 320 may be formed using a resin material mixed with a colorant. The decorative panel 320 has a size covering at least the opening of the resin plate 320, and an upper surface has a depiction of a given guide mark GM (in this embodiment, a ring-shaped graphic symbol having a given color), and a graphic symbol of a wristband strapped on human's arm, in an central region of the ring-shaped graphic symbol. This graphic symbol guides a user on how to handle the wristband 8 taken along by a user after entering into the studio. The graphic symbol (guide mark) to be depicted is not limited to the above graphic symbol in this embodiment, but various other graphic symbols and patterns capable of guiding or suggesting the operation procedure may be employed.

In FIGS. 3 and 4, the housing 310 houses at least the IC chip reader 31, the clock counter 32 and the gate-number storage section 33, illustrated in FIG. 1. As shown in FIG. 4, a chassis plate 350 is fixed to a bottom surface of the cover 311 through a given number of bosses formed on an upper surface thereof to extend upward (in FIG. 4, a part of the housing 310 is omitted). A communication control board 351 and two power supply boards 352 arranged from the right side of FIG. 4 are fixed onto a bottom surface of the chassis plate 350 through bosses. Further, an antenna board 354 adapted to receive information from the communication section 81 of the wristband 8 and a receiving board 355 (equivalent to the IC chip reader 31) adapted to process the received information from the antenna board 354 are attached to an approximately central region of the upper surface of the chassis plate 350. The antenna board 354 is disposed at a position exposed from the opening of the cover 311 to reliably receive a signal.

The studio gate 3 has a length, a width and a height each set at about 20 to 30 cm. That is, the entire size of studio gate 3 is set to fall within dimensions to an extent allowing a person to readily carry and install it. While the studio gate 3 is hardly displaced (relocated) because of its total weight of the power supply board, the control board and other components, a fixing element may be provided, for example, in a bottom surface of the housing 310 to be fixed to an installation target, in view of more reliable stability. Even in this case, the studio gate 3 is preferably designed to be readily detached so as to be moved to another location. The fixing element may be a double-faced adhesive tape, a gel material having high adhesiveness to an installation surface and other type of surface fastener.

A given number of installation-location selector switches 360 (corresponding to the gate-number storage section 33) for expressing given bit of code information based on a switch state to serve as setting means are attached onto a bottom plate of the housing 310. In this embodiment, three toggle switches 361, 362, 363 are employed as the installation-location selector switches 360 (in the following description, the installation-location selector switch will be described using the toggle switch, as needed). Two switchable positions in each of the three toggle switches can be appropriately pre-set to define studio-gate identification codes (gate identification information) using three bits. A connector 370 is used for wiring to perform data communication with the exercise-data management server apparatus 4. An AC inlet 380 is provided to allow an AC power code to be insertingly connected thereto.

As described above, the three toggle switches are adjusted to set eight types "a" to "h" of gate numbers serving as information for identifying each setup location of the housing 310 of the studio gate 3, as shown in FIG. 5 (in the following description, the studio gate 3 will be described using the housing 310, as needed). FIG. 5 shows one example where the fitness club has three studios and two pools. The remaining three gate numbers are extra numbers to be used in an event, in expansion of facilities or in the use of an unused facility. For example, when the housing 310 is set up in a studio 1, the toggle switches 361 to 363 are set to have a combination of bits 1, 2, 3 of (0, 0, 0) as shown in the table of FIG. 5. Thus, when data is transmitted from this housing 310 to the exercise-data management server apparatus 4, the information about this studio location, i.e., the gate number, is transmitted together with the IC-chip ID, the entrance clock-time information to allow the exercise-data management server apparatus 4 to identify a transmission location of this data as the studio 1. Therefore, as described in detail later, a program to be performed in the studio 1 at the transmission time of this data is also identified, and an assumed calorie value to be consumed through the program is automatically calculated.

The housing 310 may be set up when plural types of prescheduled exercise programs are performed in the same facility, such as the same studio or the same pool. As long as this condition is satisfied, the housing 310 may be concurrently set up in a plurality of facilities. For example, if plural types of programs are performed in each of the studio 1 and the pool 1 as in the example illustrated in FIG. 5, the two housings 310 may be set up in the two locations, respectively. In this case, a combination of bits 1, 2, 3 of the toggle switches 361 to 363 in the table of FIG. 5 is set to (0, 0, 0) for the studio 1 and (0, 1, 1) for the pool 1. For example, as the result of a survey reflecting user's desires etc., after the two housings 310 are tentatively used in the two facilities for a certain period of time, it can be judged that the housing used for a program in the pool is more desirable to be used for a program in the studio. In this case, the housing 310 set up in the pool 1 may be moved, for example, to the studio 2, and used in the studio 2. In this transfer, the setting of the toggle switches 361 to 363 may be changed from (0, 1, 1) corresponding to the pool 1 to (0, 0, 0) corresponding to the studio 1. As above, the housing is not incorporated in the structure itself of the facility, but configured to be transportable, i.e., such that its setup location can be changed. This is significantly valuable in view of flexibility.

In addition, while, even in the same studio, a reader for reading ID data etc., embedded in a wall cannot cope with change in layout consideration of circulation during user's entrance into the studio or change in a way to use an interior space of the studio, the housing 310 of the studio gate 3 according to the present invention can be locationally changed only by re-arranging a signal wiring, after checking actual situation of user's entrance. Further, the studio gate may be designed to wirelessly transmit a signal as in an after-mentioned example in FIG. 6, to eliminate the need for re-arrangement of the signal wiring so as to provide further enhanced flexibility.

Further, a large-scale studio is occasionally used, for example, in an event where a large number of club members of the fitness club participate therein. For such an event, additional housings 310 can be set up in the same studio to allow a read operation to be performed at a plurality of locations so as to prevent a large number of users after entering in the studio from concentrating in one location and waiting their turns. On this occasion, flexible measures can be taken, for example, by temporarily using the housings usually set up at other studios or pools. In this case, the additional housings 310 may be used by changing the setting of the toggle switches 361 to 363 of the switch 360 for setting the setup location, for example, to (1, 0, 1) as in "f" in FIG. 5, and, after completion of the event, returned to the respective original locations. Alternatively, an extra housing for use in such an event may be prepared in advance. The following description will be made about another type of event.

Figure 6:
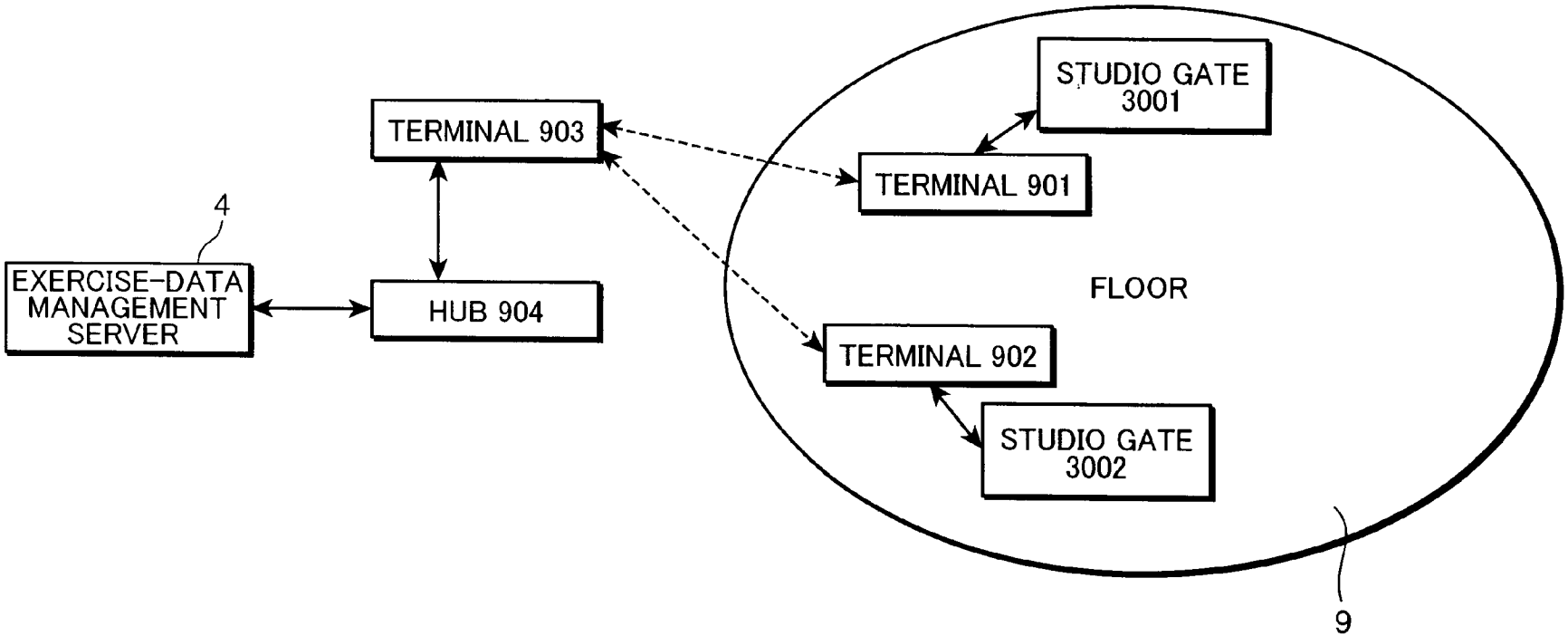
FIG. 6 is a block diagram showing one example of a process of using the studio gate.

FIG. 6 is a block diagram showing a method of applying the system of the present invention to a case where a large number of users participate in a fitness event on a large floor which is usually used for a ball sport, such as basketball or volleyball. Such a floor having no need for performing a fitness program every day is not provided with a communication device, such as a terminal, required for communication with the exercise-data management server apparatus 4, and thereby a signal wiring cannot be arranged. Thus, data read by the studio gate 3 is wirelessly transmitted to the exercise-data management server apparatus 4.

In FIG. 6, a first studio gate 3001 and a second studio gate 3002 are set up in an area of the floor 9 to be used as an exercise field of event participants (users), with an appropriate distance therebetween to allow the participants to smoothly use the studio gates. This arrangement makes it possible to avoid a crowded situation during entrance into the floor due to concentration of users in one location. According to need, the studio gate may be provided in a given number, for example, three as well as two. In this example, each of the switches in the studio gate 3001 and the studio gate 3002 is set, for example, to (1, 0, 1) as in "f" in FIG. 5. The reason is that, while the two studio gates are used, the participants receive the same program on the same floor. Correspondingly to (1, 0, 1) as a gate number of this floor, data for calculating a consumed calorie value to be consumed through this event and other data are input into the exercise-data management server apparatus 4. Further, a first terminal 901 is provided to receive a signal from the studio gate 3001 through wired transmission. This terminal is a converter capable of converting between wired and wireless signals. For example, a media convert may be used. In the same manner, a second terminal 902 is provided to receive a signal from the studio gate 3002. In the above configuration, respective signals received by the terminals 901, 902 is wirelessly (dashed lines in FIG. 6) transmitted to a third terminal 903 disposed outside the floor 9. The third terminal 903 is disposed outside the floor 9 to prevent a wired line (solid line in FIG. 6) connected to the third terminal 903 from extending across the inside and outside the floor. That is, when the wired line is arranged to extend across the inside and outside the floor, it is necessary to form a through-hole in a part of facility. If there is no particular problem in this point, the terminal 903 may be disposed inside the floor 903. Then, the signals received by the terminal 903 are transmitted to the exercise-data management server apparatus 4 through a hub 904 as a line concentrator through wired transmission.

The above configuration makes it possible to achieve a system capable of automatically accumulating and adding personal data and data about consumed calories associated with participation in the event, without occurring of a crowded situation during entrance of participants. In addition, the combination of the studio gates and the terminals can eliminate the need for arranging wiring codes and allows the studio gates to be set up at appropriate locations so as to provide high flexibility, for example, in layout of an event field, and readily cope with an unusual program, such as a special event.

Figure 7:
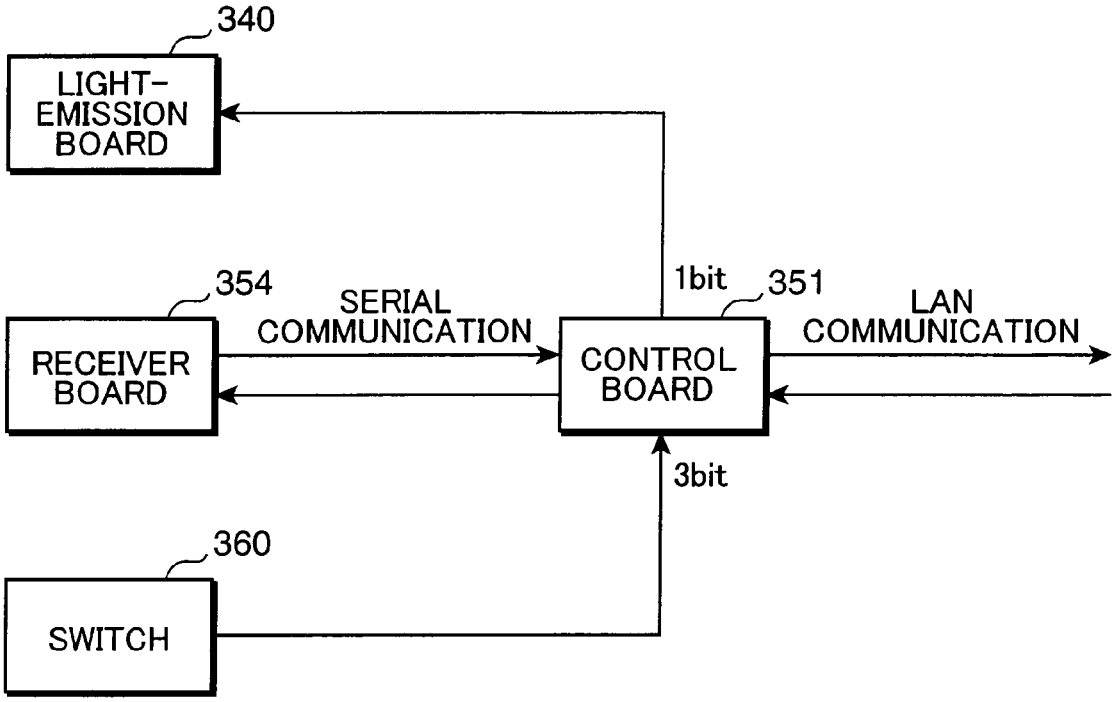
FIG. 7 is a block diagram showing a signal flow between boards installed in a housing of the studio gate.

In FIG. 7, the communication control board 351 includes a communication section for performing data communication with each of the boards and communication with the exercise-data management server apparatus 4. The communication control board 351 is operable, when the read of unique information from the wristband 8 is completed, or when the read unique information is transferred to the exercise-data management server apparatus 4 and an acknowledge signal returned in response to acknowledging the receiving of the transferred unique information is received, to change a state of the light-emission board 340 from an OFF state to an ON state so as to turn the LEDs on. Thus, a user can recognize the completion of the read. In an embodiment designed to allow a user to recognize the completion of the read of the unique information based on the communication control board 351, the communication control board 351 includes a signal processing section for shaping and converting a read analog signal to a digital signal, and a determination processing section for determining whether a received signal is a signal of unique information. The antenna board 354 (receiver) is operable to transmit electromagnetic energy from a communication section (antenna, etc.) at a cycle of a unique-information processing, for example, at given time intervals. If the wristband is located adjacent to the antenna board 354, the electromagnetic energy is converted to electric power inside the wristband 8 to allow the communication section 81 including an antenna to be activated so as to transmit unique information therefrom. The antenna board 354 is also operable to set a unique-information receiving wait mode for a given time period after transmitting the electromagnetic energy, and receive the unique information. Further, the antenna board 354 is operable to read a switch state of the switch 360 so as to acquire gate identification information of the studio gate 3.

Figure 8:
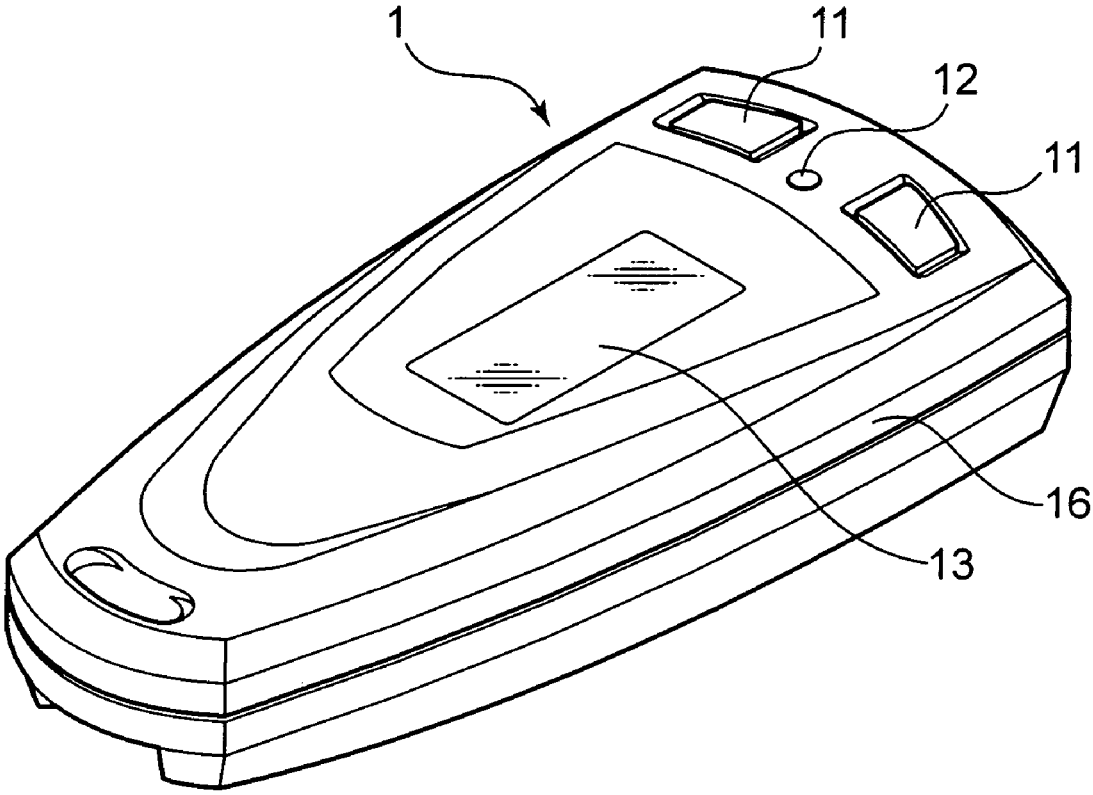
FIG. 8 is a perspective view showing one example of a pedometer.

FIG. 8 is an external perspective view showing one example of the pedometer 1. The pedometer 1 comprises a monitor 13 including a LCD for displaying data, such as an accumulated member of walking steps and an accumulated member of running steps (hereinafter referred to collectively as "step-number data"), a manual button 11 for accepting a manual operation for selecting data to be displayed on the monitor 13, a reset button 12 to be pushed down when data, such as the accumulated number of walking steps or running steps, stored in an after-mentioned step-number storage section 152, and a case 16 housing an after-mentioned sensor 14, an after-mentioned control unit 15 and others.

Figure 9:
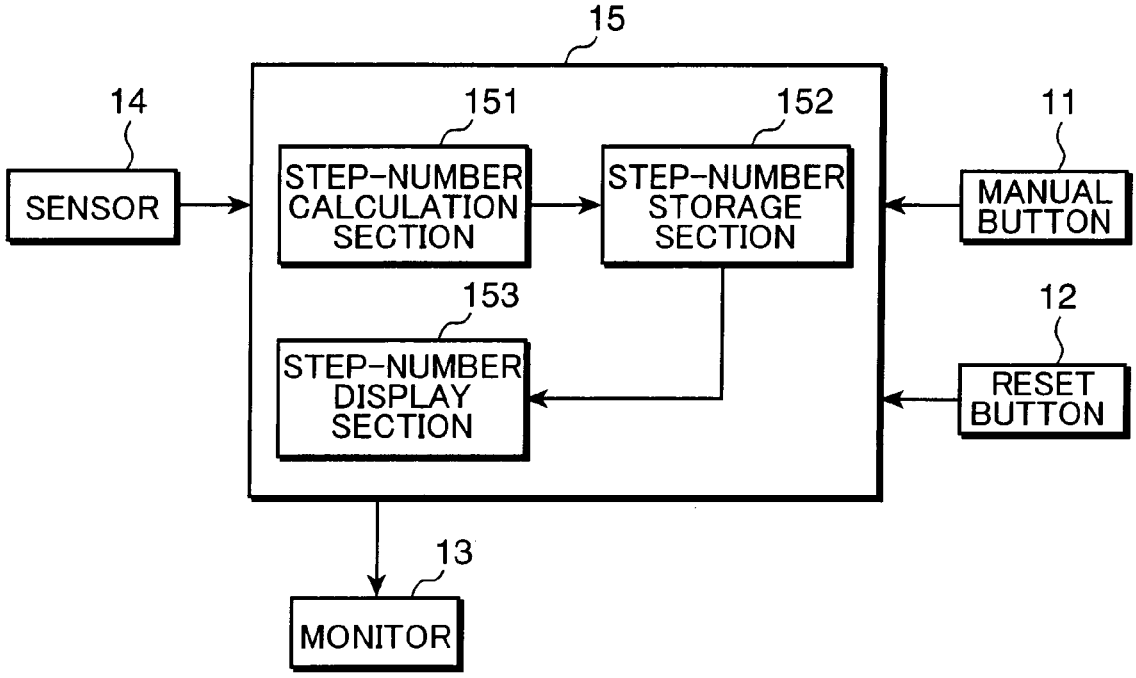
FIG. 9 is a block diagram showing one example of a functional configuration of major sections in the pedometer.

FIG. 9 is a block diagram showing one example of a functional configuration of major sections in the pedometer 1. The pedometer 1 includes: a sensor 14 composed, for example, of a piezoelectric element, and adapted to detect vibration (or acceleration); and a control unit 15 adapted to count the number of walking steps and the number of running steps, and receive an input from the manual button 11 and the reset button 12 so as to process data about an accumulated member of walking steps, an accumulated member of running steps, etc.; and a monitor 13 including a LCD for displaying data, such as an accumulated member of walking steps and an accumulated member of running steps (hereinafter referred to collectively as "step-number data"). Each of the sensor 14 and the control unit 15 are arranged at an appropriate position in the case 16. The pedometer 1 further includes a transceiver section (not shown) for transmitting data, such as an accumulated member of walking steps and an accumulated member of running steps, to the exercise-data management server apparatus 4, and receiving data, such as user ID, from the exercise-data management server apparatus 4.

The control unit 15 includes a step calculation section 151 operable to receive a signal from the sensor 14 so as to count the member of walking steps and the member of running steps, a step-number storage section 152 operable to store the respective members of walking and running steps counted by the step calculation section 151, in association with clock-time information of a clock (not shown), and a step-number display section 153 operable, in response to a manual input from the manual button 11, to read data, such as an accumulated member of walking steps or an accumulated member of running steps, from the step-number storage section 152, and display the read data on the monitor 13.

The step-number calculation section 151 is operable, in response to receiving a signal from the sensor 14, to subject the received signal to a signal processing, and determine whether the signal is obtained in a walking state or in a running state, so as to count the member of walking steps and the member of running steps.

The step-number storage section 152 is operable to store the respective members of walking and running steps counted by the step calculation section 151, in association with clock-time information of a clock (not shown) (e.g., store the respective members of walking and running steps per hour), and the user ID.

The step-number display section 153 is operable, in response to an input from the manual button 11, to read data, such as an accumulated member of walking steps or an accumulated member of running steps, from the step-number storage section 152, and display the read data on the monitor 13.

Figure 10:
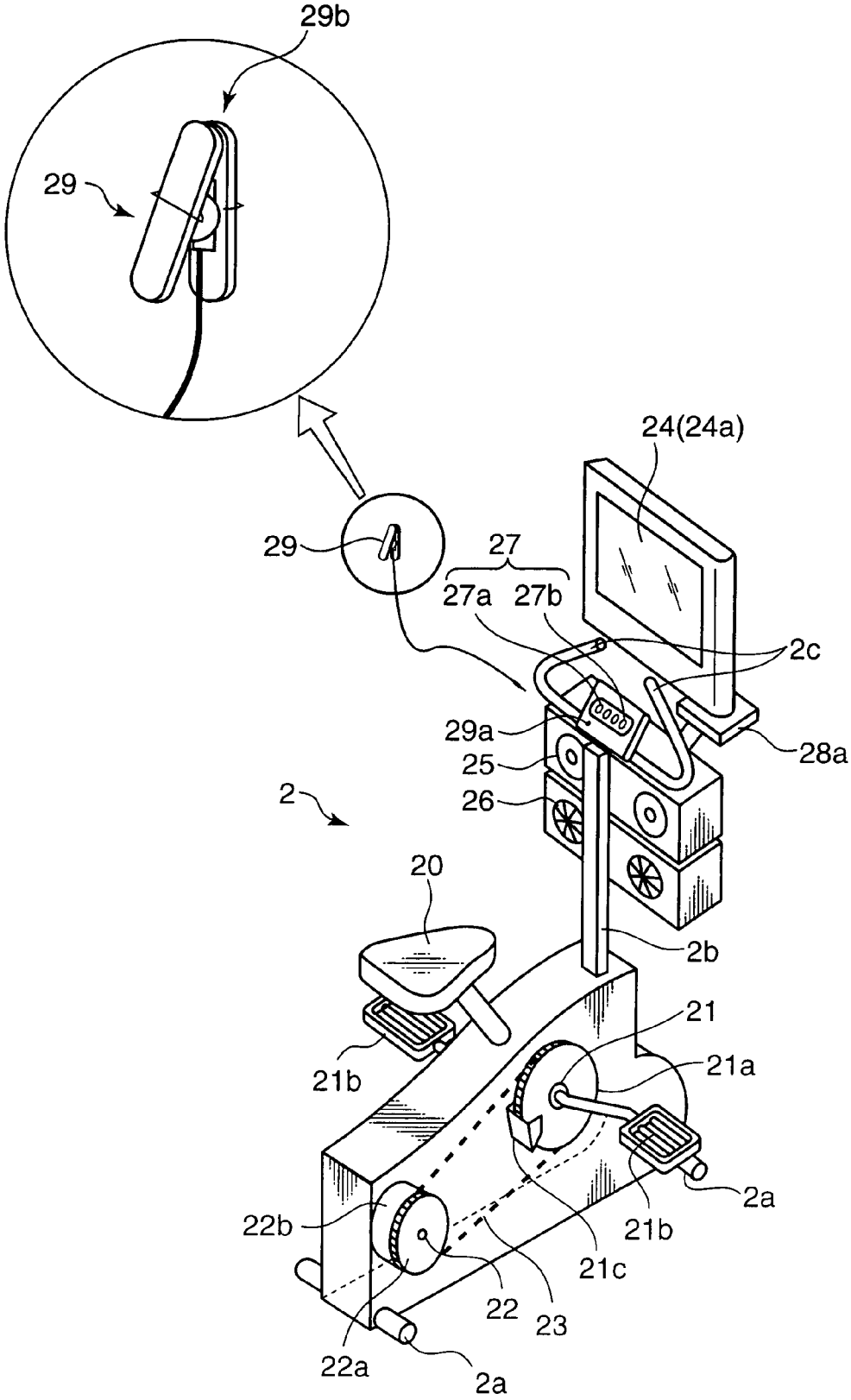
FIG. 10 is a general view showing the structure of a cycling machine as one example of an exerciser.

FIG. 10 is a general view showing the structure of a cycling machine as one example of the exerciser 2. The cycling machine is a stationary type having a simulated configuration of a bicycle except that a front wheel is removed therefrom. In the cycling machine, a saddle 20 is mounted on an upper portion of a body 2A of the cycling machine, and a leg 2*a* is attached on each of front and rear sides of a lower portion of the body 2. Further, a pair of rotation shafts 21, 22 are supported by right and left walls of the body 2, respectively, at front and rear ends of the body 2. The rotation shafts 21, 22 have gears 21*a*, 22*a* fixed, respectively, thereto in such a manner as to be rotated together therewith, and an endless chain 23 is wounded between the gears 21*a*, 22*a* in a tensioned manner. A pair of pedals 21*b* are attached, respective, opposite ends of the rotation shaft 21 in such a manner as to be pushed by a user. The pushing movement is transmitted from the rotation shaft 21 through the endless chain 23 to rotate the rear rotation shaft 22. In this embodiment, a rotation sensor 21*c* as a detection section is disposed adjacent to the front rotation shaft 21, for example, in such a manner as to face opposite surfaces of the gear 21*a*. For example, the rotation sensor 21*c* includes a light-emitting element and a light-receiving element each disposed to face a different one of the opposite surfaces of the gears 21*a*. Based on a pulse output every time each of tooth tops of the gear 21*a* passes through and between the light-emitting and light-receiving elements, a rotation pulse is generated by a rotary encoder to substantially detect a rotational speed of the pedal 21*b*. In place of a proximity switch A, such as a rotation sensor having light-emitting and light-receiving elements, a mechanical switch may be employed. Further, the rotational speed may be detected at a rotating portion other than the tooth tops of the gear 21*a*.

An electromagnetic clutch 22*b* is attached to the rear rotation shaft 22 to serve as load changing means for variably controlling a load condition, so as to change braking load (control force) by adjusting an amount of electric power to the electromagnetic clutch 22*b*. In addition to an electromagnetic clutch adapted to change the control force using eddy current, various types of load changing means may be used. For example, a mechanical clutch may be controlled electrically or hydraulically to chance the control force.

A support arm 2*b* is fixed at the front of the body 2, and a monitor 24 is attached to an upper portion of the support aim 2*b* at a height position approximately equal to a front face of a head of a user seated in the saddle. A speaker 25 and a blower fan 26 are attached to the support arm 2*b* at a position below the monitor 24 to face rearward, together with a handle 2*c*. For example, the monitor 24 is a thin-type liquid-crystal display unit for displaying an image. The speaker 25 is provided as a means to output a give message or BGM. The bower fan 26 has a fan adapted to be controllably rotated according to a detection result of the rotation sensor 21*c* so as to create immersive feeling similar to outdoor cycling.

A manual operation panel 26 is attached to a top end of the support arm 2*b*, and provided with at least a pair of right and left button 27*b*, 27*a*. Each of the buttons 27*a*, 27*b* serves as a gear shifter of an actual bicycle when it is pressed down by the user, to change an gear stage as described below, so as to adjust the braking load of the electromagnetic clutch 22*b*. For example, the gear stage is changed every time the button 27*a* is pressed down to increase the braking load of the electromagnetic clutch 22*b*. Conversely, the gear stage is changed every time the other button 27*b* is pressed down to reduce the braking load of the electromagnetic clutch 22*b*.

An IC chip reader 28*a* for reading the IC-chip ID stored in the IC chip 7 embedded in the wristband 8, and a slot 29*a* for inserting therein an end of a lead wire of a heart rate sensor 29, are provided around the monitor 24. The IC chip reader 28*a* is adapted to read the IC-chip ID stored in the IC chip 7 located within a given distance range (e.g., a distance from the IC chip reader 28*a* is 30 cm or less) in a non-contact manner. The hear rate sensor 29*b* is provided as a means to detect a heart rate of the user, and provided with a clip member 29*b* for pinching lobe or the like as show in an enlarged area of FIG. 10, to detect a blood flow volume while pinching lobe, optically, i.e., in accordance with a change in level of transmitted light.

A control unit 202 (see FIG. 11) composed, for example, of a microcomputer, is disposed at an appropriate position of the cycling machine to output a detection signal from each section and a control signal to each section. The control unit 202 may be arranged independently instead of incorporating each of the exerciser.

Figure 11:
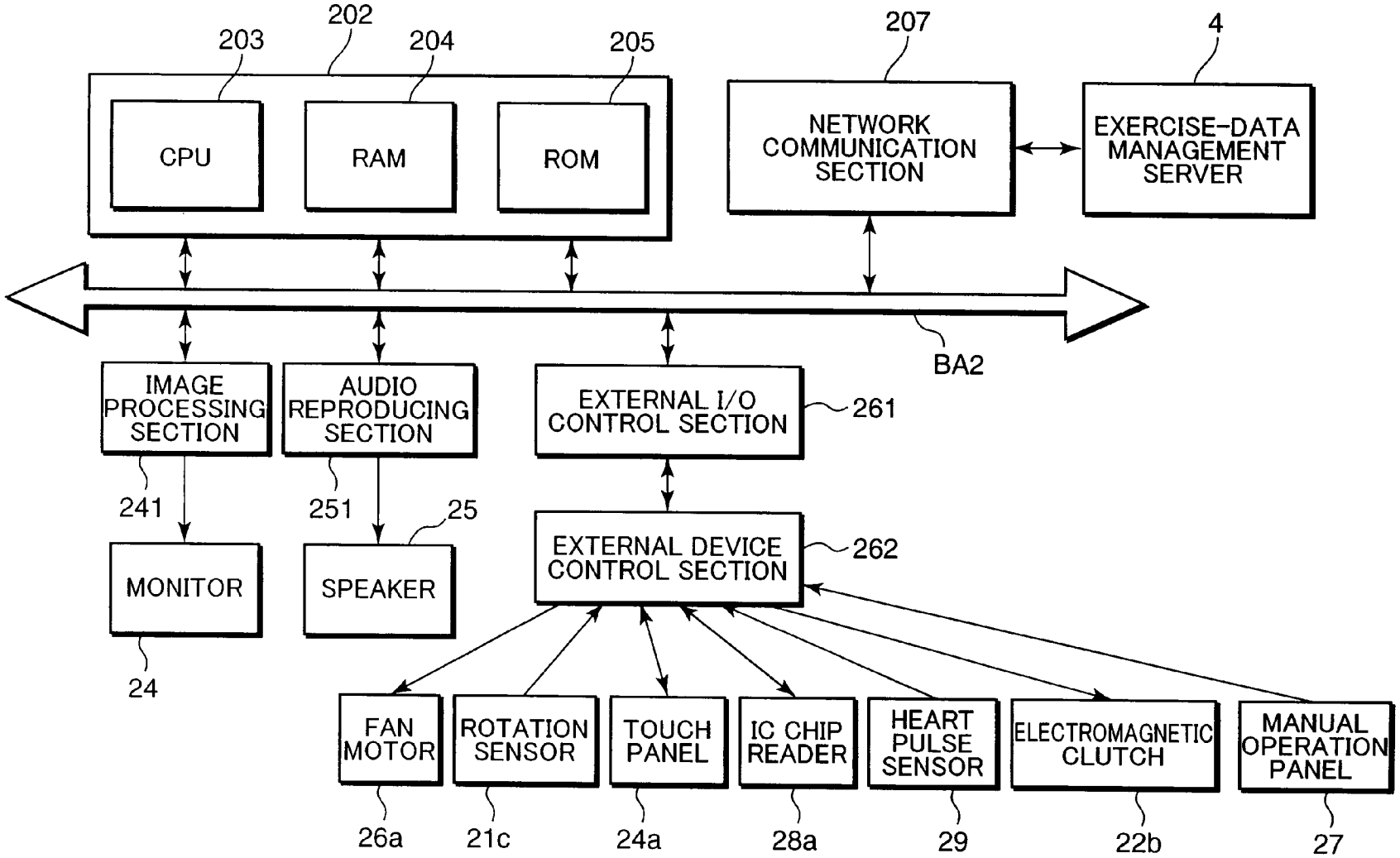
FIG. 11 is a block diagram showing a hardware configuration of the cycling machine as one example of the exerciser.

FIG. 11 is a block diagram showing a hardware configuration of the cycling machine as one example of the exerciser. The control unit 202 is adapted to control the entire operation of the cycling machine, and provided with an information processing section (CPU) 203, a RAM 204 for temporarily storing information under processing, and a ROM 205 prestoring given image information, a control program and others. The CPU 203 has a function of calculating a rotational speed of the pedal 11*b* (a running speed of the simulated cycling machine), calculating a pulse rate per minute from a detection signal of the heart rate sensor 29, calculating a consumed calorie value per unit time in accordance with the obtained speed and the pulse rate, and body data received from the exercise-data management server apparatus 4, and accumulating the obtained consumed calorie value per unit time for an exercise time to calculate a consumed calorie value in a time period between the start of the exercise to the present time. For example, among contents stored in the ROM 205, at least a control program to be affected by a change in a type of exercise may be stored in a detachable external recording medium. A bus BA2 is a data transmission path.

An external input/output (I/O) control section 261 is operable to convert a detection signal to a digital signal, and converting command information to an actuator control signal, so as to output the converted signals, between the control unit 202 and each of actuators (i.e., a fan motor 26*a* of the blower fan 26, the electromagnetic clutch 22*b*) and detection sections (i.e., the rotation sensor 21*c*, a touch panel 24*a*, the manual operation panel 27, the IC chip reader 28*a* for the IC chip 7, the heart rate sensor 29), wherein the signal processing and the I/O processing is performed, for example, in a time-division manner. The external device control section 262 is operable to output the control signal from the external I/O control section 261 to each actuator and input the detection signal from each detecting section to the external I/O control section 261, in each time-division period. The touch panel 24*a* in the detection sections has a plurality of press operation elements adapted to be turned on/off by a pressing operation with finger. The touch panel 24*a* is provided in an image screen of the monitor 24.

An image processing section 241 is operable, according to a command from the control unit 202, to display a given image on the monitor 24 according to an image display command from the control unit 202, and provided with a video RAM and others. The audio reproduction section 251 is operable to output a given message, BGM and others to the speaker 25 according to a command from the control unit 202.

The ROM 205 stores various types of character images, various types of background images, various types of screen images and various types of messages in a superimposable manner. Each of the character and background images is formed of a given number of polygons to allow for a 3-dimensional imaging. The imaging processing section 241 is operable, according to an imaging command from the CPU 203, to primarily perform a calculation of a visual-point position (in this embodiment, for changing a height and direction of a camera), a calculation of a position of the visual-point position in a 3-dimensional space, and a calculation for converting a position in the 3-dimensional space to a position in a pseudo-3-dimensional space, and a calculation on lighting. Then, the imaging processing section 241 is operable, based on the calculation results, to perform a processing of writing target image data into the video RAM, for example, a processing of writing (pasting) texture data into/onto an area of the video RAM designated by the polygon.

A relation between respective operations of the CPU 203 and the image processing section 241 will be described. Based on an operating system recorded in the built-in or external detachable-type ROM 205, the CPU 203 reads image data, audio data, control program data and a game program from the ROM 205. A part or the entirety of the read image, audio and control program data ate held on the RAM 204. Subsequently, based on the control program and the data (audio data, image data including polygons and textures of a target object and other text images) stored in the RAM 204, the detection signals from the detection sections, and a content instructed by user's manual operation, the CPU 203 executes the processing. Specifically, based on the detection signals and the user's instruction, the CPU 203 appropriately generates a command as a task for imaging and audio output. Based on the command, the image processing section 241 generates and processes audio data through calculations of a character position in a 3-dimensional space (as well as 2-dimensional space) with respect to a visual-point position, lighting etc. Then, based on the calculation results, the image processing section 241 performs a processing of writing the target image data into the video RAM. The image data written in the video RAM is (after being supplied to a D/A converter through an interface, and converted to an analog image signal) supplied to the monitor 24 and displayed on the screen thereof. Further, the audio data output from the audio reproduction section 251 is (after being supplied to a D/A converter through an interface, and converted to an analog audio signal) output from the speaker 25 as audio.

Among the various data stored in the ROM 205, data capable of being stored in a detachable recording medium may be read, for example, by a hard disk drive, an optical disk drive, a flexible disk drive, a silicon disk drive or a driver for cassette medium readers or the like. In this case, the ROM 205 as a recording medium may include a hard disk, an optical disk, a flexible disk, a CD, a DVD and a semiconductor memory.

The network communication section 207 is operable, just before the start of training, to transmit an exerciser-use start information which is information indicating that the use of the exerciser 2 and the IC-chip ID read by the IC chip reader 28*a* is started, to the exercise-data management server apparatus 4, in association with the identification information of the exerciser. Then, the network communication section 207 is operable to receive a personal authentication result from the exercise-data management server apparatus 4 so as to perform a personal authentication, and receive body data required for calculating a consumed calorie value, from the exercise-data management server apparatus 4. Subsequently, the network communication section 207 is operable, when the training is completed, to transmit exerciser-use end information which is information indicating that the use of the exerciser 2 and information about training record, such as consumed calorie value, is terminated, to the exercise-data management server apparatus 4, in association with the identification information of the exerciser.

Figure 12:
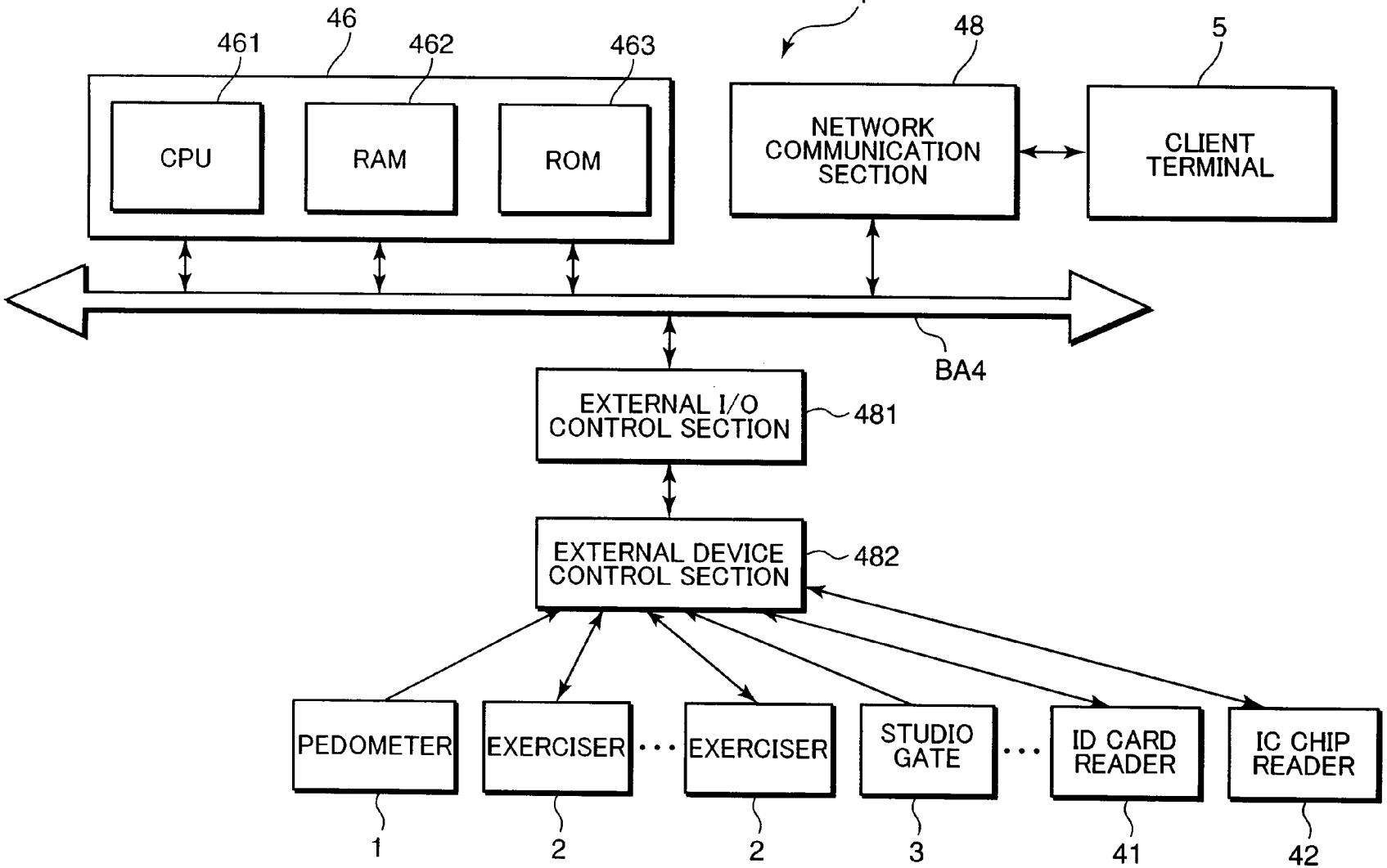
FIG. 12 is a block diagram showing a hardware configuration of an exercise-data management server apparatus according to one embodiment of the present invention.

FIG. 12 is a block diagram showing a hardware configuration of the exercise-data management server apparatus 4 according to one embodiment of the present invention. A control unit 46 is adapted to control the entire operation of the exercise-data management server apparatus 4, and provided with an information processing section (CPU) 461, a RAM 462 for temporarily storing information under processing, and a ROM 463 pre-storing an exercise data management program, a control program and others. For example, among contents stored in the ROM 463, at least a control program to be affected by a change in a type of exercise may be stored in a detachable external recording medium. A bus BA4 is a data transmission path.

An external input/output (I/O) control section 481 is operable to allow a signal to be received and transmitted between the control unit 46 and each of detection sections (i.e., the pedometer 1, the exerciser 2, the studio gate 3, an ID card reader 41, an IC chip reader 42), for example, in a time-division manner. An external device control section 482 is operable to make a request for information to each of the detection section and instruct each of the detection section to perform a setting, in each time-division period.

Among the various data stored in the ROM 463, data capable of being stored in a detachable recording medium may be read, for example, by a hard disk drive, an optical disk drive, a flexible disk drive, a silicon disk drive or a driver for cassette medium readers or the like. In this case, the ROM 463 may include a hard disk, an optical disk, a flexible disk, a CD, a DVD and a semiconductor memory.

The network communication section 48 is operable, based on a request for transmitting given data, from the client terminal apparatus 5, to transmit the given data to the client terminal apparatus 5, and, based on a request for storing given data, from the client terminal apparatus 5, to receive the given data and store the received data in the RAM 462.

Figure 13:
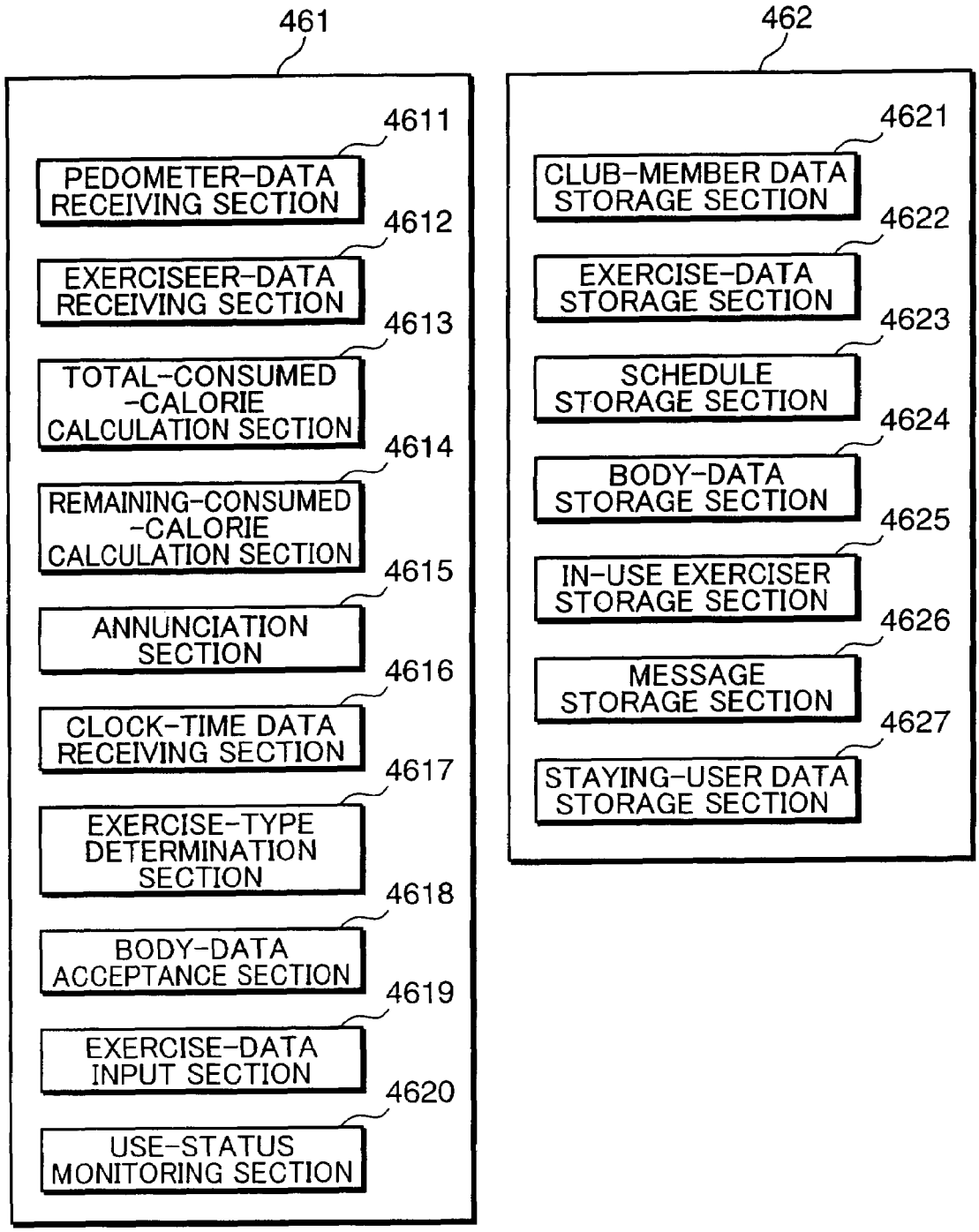
FIG. 13 is a block diagram showing one example of a functional configuration of a control unit in the exercise-data management server apparatus

FIG. 13 is a block diagram showing one example of a functional configuration of the control unit 46 in the exercise-data management server apparatus 4. The CPU 461 includes: a pedometer-data receiving section 4611 for receiving user identification information and step-number data from the pedometer 1; an exerciser-data receiving section 4612 for receiving identification information of a user and second exercise data from each of the exercisers 2; a total-consumed-calorie calculation section 4613 for calculating a total consumed calorie value which is a sum of consumed calories, on a user-by-user basis in accordance with the step-number data from the pedometer 1 and the second exercise data from each of the exercisers 2; a remaining-consumed-calorie calculation section 4614 for calculating a remaining consumed calorie value which is a difference between a target consumed calorie value and the total consumed calorie value, on a user-by-user basis; an annunciation section 4615 for annunciating the remaining consumed calorie value to a user in a recognizable manner; a clock-time data receiving section 4616 for receiving a clock time of entrance into a studio; an exercise-type determination section 4617 for determining an exercise type performed by a user in the studio (hereinafter referred to as "studio user"), with reference to the clock time received by the clock-time receiving section 4616, and an after-mentioned schedule storage section 4623 (first storage means); a body-data acceptance section 4618 for receiving information from the client terminal apparatus 5 to accept the user identification information, and user's body data including body weight and body height; an exercise-data input section 4619 for receiving information from the client terminal apparatus 5, and storing user identification information and user's exercise data in an after-mentioned exercise-data storage section 4622; and an use-status monitoring section 4620 for monitoring whether each of the exercisers 2 is in use.

The pedometer-data receiving section 4611 is operable to receive a user ID as user identification information, step-number data, such as the number of walking steps and the number of running steps on a clock time-by-clock time basis, through the external I/O control section 481 and the external device control section 482 as shown in FIG. 12, and store the step-number data in an after-mentioned exercise-data storage section 4622 in association with the user ID and the clock-time.

The exerciser-data receiving section is operable to receive the identification information of the exerciser 2 and an IC-chip ID as user identification information, and second exercise data including a consumed calorie value, through the external I/O control section 481 and the external device control section 482 as shown in FIG. 12, and, after reading a user ID corresponding to the received IC chip ID with reference to an after-mentioned staying-user data storage section 4627 based on the IC-chip ID, store second exercise data in the after-mentioned exercise-data storage section 4622 in association with the user ID and the identification information of the exerciser 2.

The total-consumed-calorie calculation section 4613 (exercise data acquisition means) is operable to calculate a total consumed calorie value which is a sum of consumed calories, on a user-by-user basis in accordance with the step-number data from the pedometer 1 and the second exercise data from each of the exercisers 2, and store the total consumed calorie value in the after-mentioned exercise-data storage section 4622 in association with the user ID and the clock time. When the consumed calorie value is calculated in accordance with the second exercise data from the exerciser 2, the total-consumed-calorie calculation section 4613 refers to body data stored in an after-mentioned body-data storage section 4624, according to need. Further, the total-consumed-calorie calculation section 4613 is operable to calculate a consumed calorie value corresponding to an exercise type determined by the exercise-type determination section 4617 with reference to consumed calorie-related data stored in the after-mentioned schedule storage section 4623 and body data stored in the after-mentioned body-data storage section 4624. Then, the total-consumed-calorie calculation section 4613 is operable to store the calculated consumed calorie value in the after-mentioned exercise-data storage section 4622, and add the calculated consumed calorie value to the total consumed calorie value. Furthermore, the total-consumed-calorie calculation section 4613 is operable to calculate a consumed calorie value with reference to body data stored in the after-mentioned body-data storage section 4624 based on the exercise data received by the exercise-data input section 4619. Then, the total-consumed-calorie calculation section 4613 is operable to store the calculated consumed calorie value in the after-mentioned exercise-data storage section 4622, and add the calculated consumed calorie value to the total consumed calorie value.

The remaining-consumed-calorie calculation section 4614 is operable to calculate a remaining consumed calorie value which is a difference between a target consumed calorie value pre-determined on a user-by-user basis and on a clock time-by-clock time basis and stored in the after-mentioned exercise-data storage section 4622 and the total consumed calorie value calculated by the total-consumed-calorie calculation section 4613, and store the remaining consumed calorie value in the after-mentioned exercise-data storage section 4622 in association with the user ID and the clock time. Further, the remaining-consumed-calorie calculation section 4614 is operable to extract currently-unused exercisers 2 based on information stored in an after-mentioned in-use exerciser storage section 4625, and allocate the calculated remaining consumed calorie to the extracted exercisers 2, i.e., allocate the calculated remaining consumed calorie to the extracted exercisers 2 based on an exerciser-specific scheduled consumed calorie value (i.e., a scheduled consumed calorie value for each of the exercisers 2) pre-determined with respect to each user identification information and with respect to each clock time and stored in the after-mentioned exercise-data storage section 4622. In this embodiment, the calculated remaining consumed calorie to currently-unused exercisers 2 where an exerciser-specific remaining consumed calorie value (=exerciser-specific scheduled consumed calorie value−exerciser-specific previously-consumed calorie value) is a given value (e.g., 100 Kcal) or more, in proportion to the exerciser-specific remaining consumed calorie value.

If the calculated remaining consumed calories value is allocated simply to each of the exercisers 2 in proportion to the scheduled consumed calorie value, there is a problem that a minimum exercise required for consuming the remaining consumed calories value allocated to some of the exercisers 2 has no effect as exercise (the remaining consumed calories value will be consumed shortly after starting exercise). This problem can be solved by allocating the calculated remaining consumed calories value only to the exercisers 2 where an exerciser-specific remaining consumed calorie value is a given value or more.

The annunciation section 4615 is operable, in response to a request from the client terminal apparatus 5, to read a remaining consumed calorie value stored in the after-mentioned exercise-data storage section 4622 on a user-by-user basis and on a clock time-by-clock time basis, and transmit the read remaining consumed calorie value to the client terminal apparatus 5. Further, the annunciation section 4615 is operable to transmit the exerciser-specific remaining consumed calorie value calculated and allocated by the remaining-consumed-calorie calculation section 4614 to the client terminal apparatus 5. The client terminal apparatus 5 is operable to display the remaining consumed calorie value and the exerciser-specific remaining consumed calorie value on the monitor 51 so as to annunciate the remaining consumed calorie value and the exerciser-specific remaining consumed calorie value, as described in detail later.

The clock-time data receiving section 4616 (server-side communication section) is operable to receive a gate number, a clock time of entrance into a studio, and IC-chip ID as user identification information of a studio user, from the IC chip reader 31.

The exercise-type determination section 4617 is operable to determine an exercise type performed by a studio user, with reference to a gate number received by the clock-time data receiving section 4616, and the after-mentioned schedule storage section 4623 based on the clock time of entrance into the studio received by the clock-time data receiving section 4616. The exercise-type determination section 4617 is operable, based on the IC-chip ID received by the clock-time data receiving section 4616, to retrieve a corresponding user ID with reference to the after-mentioned staying-user storage section 4627, and store the exercise type in the after-mentioned exercise-data storage section 4622 in association with the retrieved user ID.

The body-data acceptance section 4618 is operable to accept information from the client terminal apparatus 5 so as to obtain IC-chip ID as user identification information, and user's body data including body weight and body height. Then, the body-data acceptance section 4618 is operable to read a user ID corresponding to the IC-chip ID with reference to the after-mentioned staying-user storage section 4627, and store the body data in the after-mentioned body-data storage section 4624 in association with the read user ID.

The exercise-data input section 4619 is operable to receive information (IC-chip ID) from the client terminal apparatus 5. Then, the exercise-data input section 4619 is operable to read and a user ID corresponding to the IC-chip ID with reference to the after-mentioned staying-user storage section 4627, and store the exercise data and the User ID as user identification information in an after-mentioned exercise-data storage section 4622.

The use-status monitoring section 4620 is operable to receive data about a use status (start and end of use) of each of the exercisers 2 so as to monitor whether each of the exercisers 2 is in use, and store the use status in the after-mentioned in-use exerciser storage section 4625. Further, the use-status monitoring section 4620 is operable, in response to reserving a request for transmitting an exercise use status, from the client terminal apparatus 5, to read the exercise use status from the after-mentioned in-use exerciser storage section 4625, and transmit the read exercise use status to the client terminal apparatus 5.

The RAM 462 includes: a club-member data storage section 4621 storing club member data; an exercise-data storage section 4622 storing club member's exercise data; a schedule storage section 4623 (first storage means, second storage means) which stores schedule data including an exercise type to be performed in a studio, and a consumed calorie-related data, in association with the exercise type; a body-data storage section 4624 (third storage means) storing club member's body data; an in-use exerciser storage section 4625 storing information about whether each of the exercisers 2 is in use; a message storage section 4626 storing various types of messages; and an staying-user data storage section 4627 storing data about each user staying in the fitness club.

The club-member data storage section 4621 store personal information, such as user's name and user's birth date, and past exercise record data, in association with a user ID.

The exercise-data storage section 4622 stores, in association with a user ID, second exercise data including consumed calorie data from each of the exercisers 2 in association with identification information of the exerciser 2, and stores the exercise data including the consumed calorie value in the studio calculated by the total-consumed-calorie calculation section 4613 in association with identification information of an exercise type. Further, the exercise-data storage section 4622 stores, in association with a use ID, the step-number data including consumed calorie value from the pedometer 1 and an update clock time about the step-number data. Furthermore, the exercise-data storage section 4622 stores, in association with a use ID, a target consumed calorie value pre-determined on a clock time-by-clock time basis, the total consumed calorie value calculated by the total-consumed-calorie calculation section 4613 on a clock time-by-clock time basis, and the remaining consumed calorie value calculated by the remaining-consumed-calorie calculation section 4614 on a clock time-by-clock time basis.

As to data input of the target consumed calorie value, a user may input it from the client terminal apparatus 5. Alternatively, a target data determined as a result, for example, of an interview or diagnosis with/from an instructor may be stored in a server (not shown), and the CPU 461 may read the data and store the read data in the exercise-data storage section 4622. In this case, the CPU 461 may be configured to calculate a target consumed calorie value using body information (age, sexuality, body height, body weight, body fat, etc.) of a user according to a given calculation formula, and store the calculated target consumed calorie value in the exercise-data storage section 4622.

The schedule storage section 4623 stores a type of exercise (exercise type) to be performed in a studio (e.g., aerobics, yoga and Tai Chi) on a studio-by-studio basis (i.e., for each studio in the fitness club, corresponding to a gate number) and in association with a gate number, a clock time and a time zone. Further, the schedule storage section 4623 stores an exercise intensity parameter value pre-determined on an exercise type-by-exercise type basis. The exercise intensity parameter is user for defining the level of load for each exercise, and pre-determined, for example, in the range of 0 (zero) to 100%. In this embodiment, an exercise intensity parameter value of a beginner's aerobics program is set at 50%, and an exercise intensity parameter value of an intermediate user's aerobics program is set at 70%. An exercise intensity parameter value of a dance program is set at 60%. In another embodiment, the schedule storage section 4623 stores a standard consumed calorie value which is a consumed calorie value per unit time when a user with a standard body weight performs each type of exercise.

The body-data storage section 4624 stores, in association with a user ID, the body data including body weight and body height, which is accepted from the client terminal apparatus 5 by the body-data acceptance section 4618. Further, the body-data storage section 4624 stores a user's exercise capacity parameter, for example, in the form of a maximum oxygen intake value (VO2MAX). The maximum oxygen intake value is registered during an application for membership, or measured using a conventional measuring device at an appropriate timing after obtaining membership and registered. For a user who has had no measured maximum oxygen intake value, a default value is set and stored as the standard value.

The in-use exerciser storage section 4625 stores the information about where each of the exercisers 2 is in use, which is obtained by the use-status monitoring section 4620, in association with identification information of the exerciser 2, The message storage section 4626 stores various types of messages to be transmitted to the client terminal apparatus 5.

The staying-user data storage section 4627 stores a user ID in association with IC-chip ID.

Figure 14:
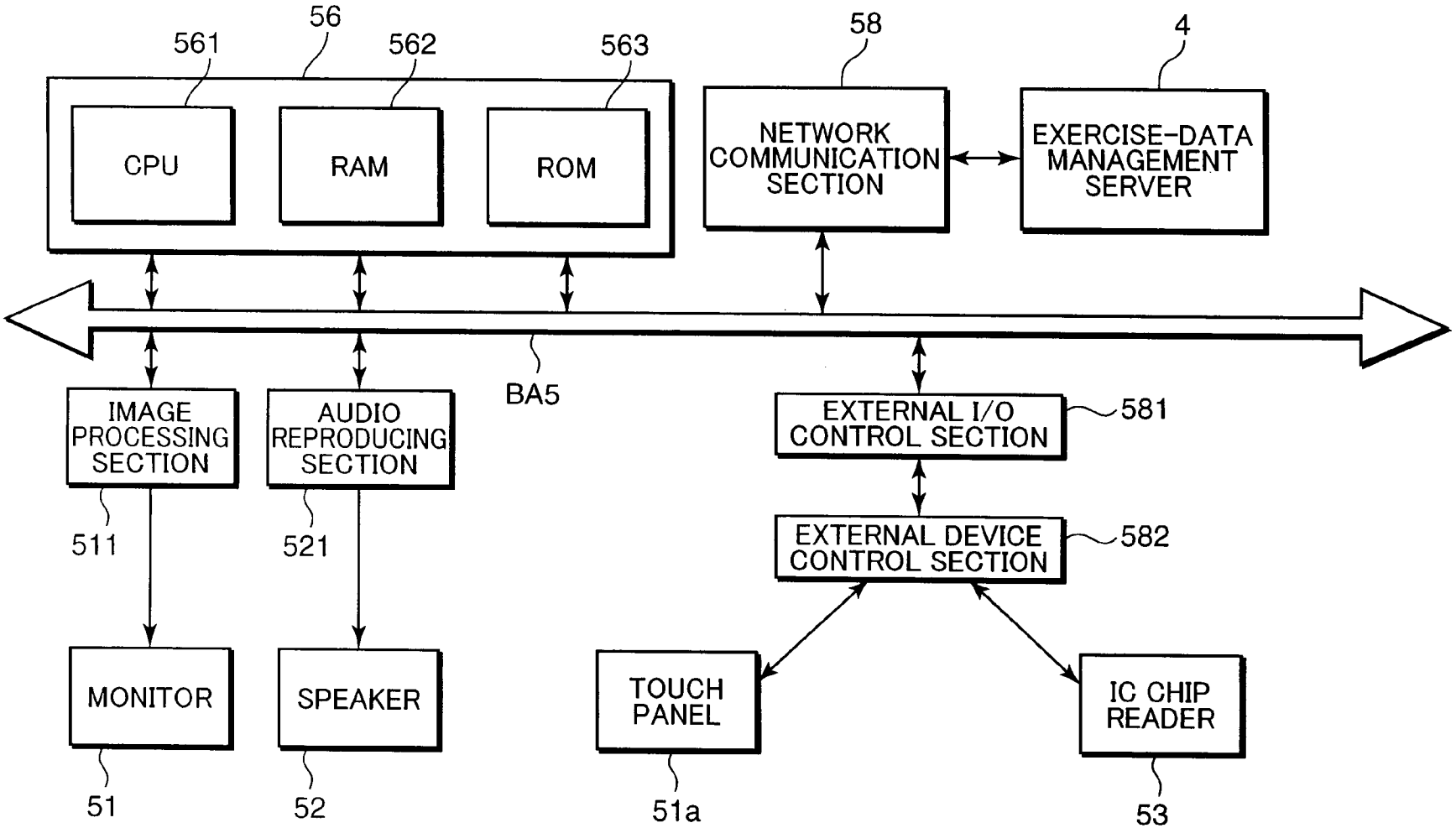
FIG. 14 is a block diagram showing one example of a hardware configuration of a client terminal apparatus.

FIG. 14 is a block diagram showing one example of a hardware configuration of the client terminal apparatus 5. A control unit 56 is adapted to control the entire operation of the client terminal apparatus 5, and provided with an information processing section (CPU) 561, a RAM 562 for temporarily storing information under processing, and a ROM 563 pre-storing after-mentioned given image information, a control program and others. A bus BA5 is a data transmission path. The ROM 563 stores various types of screen images and various types of messages in a superimposable manner.

An external input/output (I/O) control section 581 is operable to convert a detection signal to a digital signal for use in a processing, between the control unit 56 and each of detection sections (i.e., a touch panel 51*a*, an IC chip reader 53), wherein the signal processing and the I/O processing is performed, for example, in a time-division manner. An external device control section 582 is operable to perform an input operation of a detection signal from each detection section, in each time-division period. The touch panel 24*a* in the detection sections has a plurality of press operation elements adapted to be turned on/off by a pressing operation with finger. The touch panel 24*a* is provided in an image screen of the monitor 24.

An image processing section 511 is operable to display a given image on the monitor 51 according to an image display command from the control unit 56, and provided with a video RAM and others. The audio reproduction section 521 is operable to output a given message, BGM and others to the speaker 52 according to a command from the control unit 56.

A relation between respective operations of the CPU 561 and the image processing section 511 will be described. Based on an operating system recorded in the built-in or external detachable-type ROM 563, the CPU 561 reads image data, audio data and control program from the ROM 563. A part or the entirety of the read image, audio and control program data ate held on the RAM 562. Subsequently, based on the control program and the data (audio data, image data including text images) stored in the RAM 562, the detection signals from the detection sections, and a content instructed by user's manual operation, the CPU 561 executes the processing. Specifically, based on the detection signals and the user's instruction, the CPU 561 appropriately generates a command as a task for imaging and audio output. Based on the command, the image processing section 511 generates and processes image data and audio data. Then, based on the processing result, the image processing section 511 performs a processing of writing the target image data into the video RAM. The image data written in the video RAM is (after being supplied to a D/A converter through an interface, and converted to an analog image signal) supplied to the monitor 51 and displayed on the screen thereof. Further, the audio data output from the audio reproduction section 521 is (after being supplied to a D/A converter through an interface, and converted to an analog audio signal) output from the speaker 52 as audio.

Among the various data stored in the ROM 563, data capable of being stored in a detachable recording medium may be read, for example, by a hard disk drive, an optical disk drive, a flexible disk drive, a silicon disk drive or a driver for cassette medium readers or the like. In this case, the ROM 563 may include a hard disk, an optical disk, a flexible disk, a CD, a DVD and a semiconductor memory.

A network communication section 58 is operable to transmit a data transmission request to the exercise-data management server apparatus 4. Then, the network communication section 58 is operable to receive a corresponding data from the exercise-data management server apparatus 4 and transmit a data storage request to the exercise-data management server apparatus 4. Based on this data storage request, the exercise-data management server apparatus 4 is operable to receive the corresponding data and store the received data in a corresponding one of the storage sections.

Figure 15:
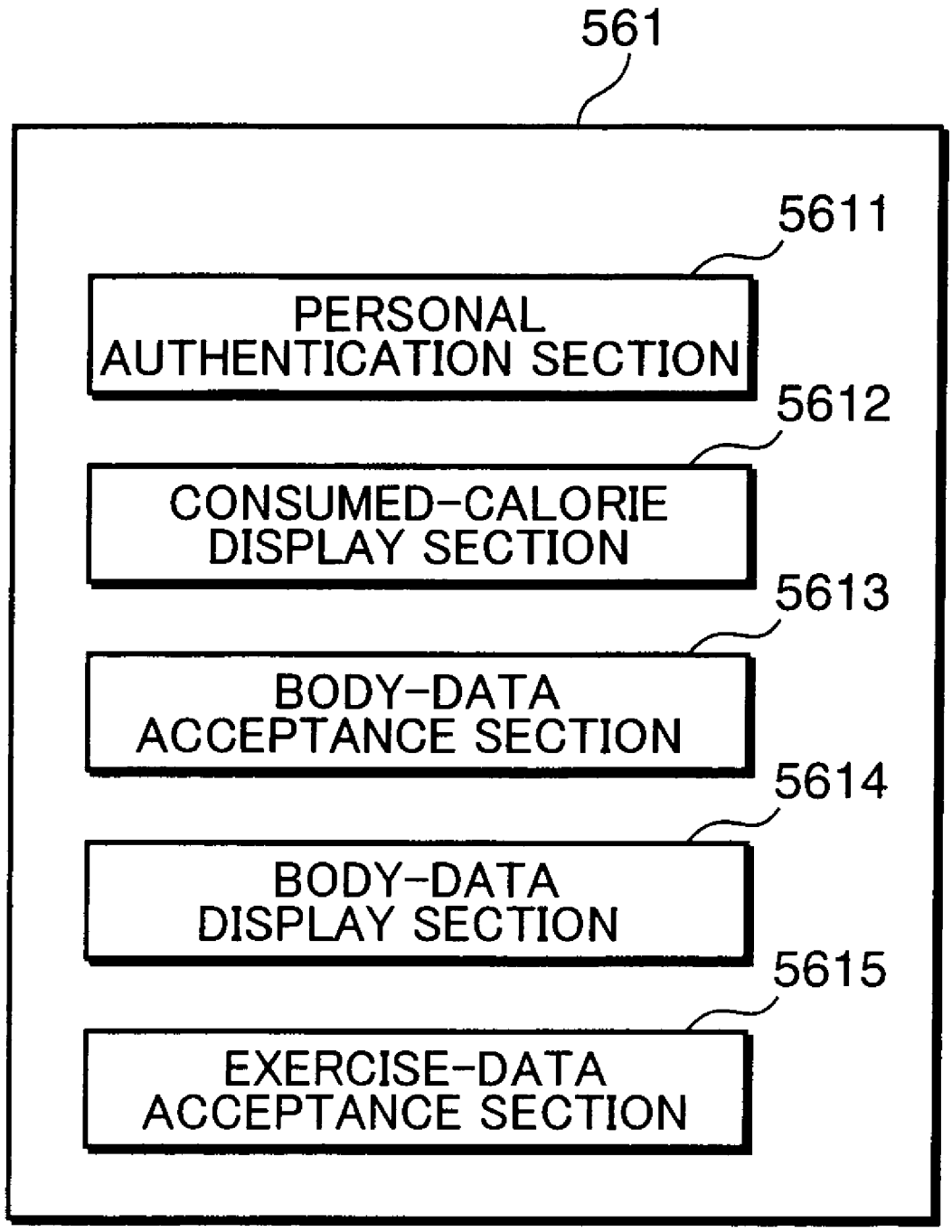
FIG. 15 is a block diagram showing one example of a functional configuration of a control unit in the client terminal apparatus.

FIG. 15 is a block diagram showing one example of a functional configuration of the control unit 56 in the client terminal apparatus 5. The CPU 561 of the control unit 56 includes a personal authentication section 5611 for performing a personal authentication based on IC-chip ID, a consumed-calorie display section 5612 for displaying a consumed calorie value on the monitor 51, a body-data acceptance section 5613 for accepting an input of body data, a body-data display section 5614 for displaying body data on the monitor 51, and an exercise-data acceptance section 5615 for accepting an input of exercise data.

The personal authentication section 5611 is operable to receive IC-chip ID from the IC chip reader 53 and transmit the IC-chip ID to the exercise-data management server apparatus 4. After the personal authentication by the exercise-data management server apparatus 4 with reference to the club-member data storage section 4621, the personal authentication section 5611 is operable to receive the result and validate the personal authentication.

The consumed-calorie display section 5612 is operable to read data, such as an exerciser 2, a studio, a consumed calorie value for each of the pedometers 1, and a total consumed calorie value, corresponding to a user ID of a user subjected to the personal authentication by the personal authentication section 5611, from the exercise-data storage section 4622 of the exercise-data management server apparatus 4, and display the received data on the monitor 51.

The body-data acceptance section 5613 is operable to display a body-data input screen image on the monitor, and accept an input of body data from the touch panel 51*a*. Then, the body-data acceptance section 5613 is operable to transmit the accepted body data to the exercise-data management server apparatus 4 in association with the user ID. Then, the body-data acceptance section 4618 of the exercise-data management server apparatus 4 is operable to store the received body data in respective areas of the storage sections corresponding to the user ID received by the exercise-data management server apparatus 4.

In the above configuration where the body-data acceptance section 5613 accepts an input of body data from the touch panel 51*a*, the exercise-data management system may be communicatably connected to the client terminal apparatus 5, and provided with a body measurement apparatus (not shown) for measuring body data. Then, the body-data acceptance section 5613 may accept body data obtained by the body measurement apparatus and transmit the accepted body data to the exercise-data management server apparatus 4 in association with a user ID. For example, when the body measurement apparatus is a body weight scale, body weight data is obtained as the body data by the body weight scale, and transmitted to the exercise-data management server apparatus 4 in association with a user ID.

Figure 31:
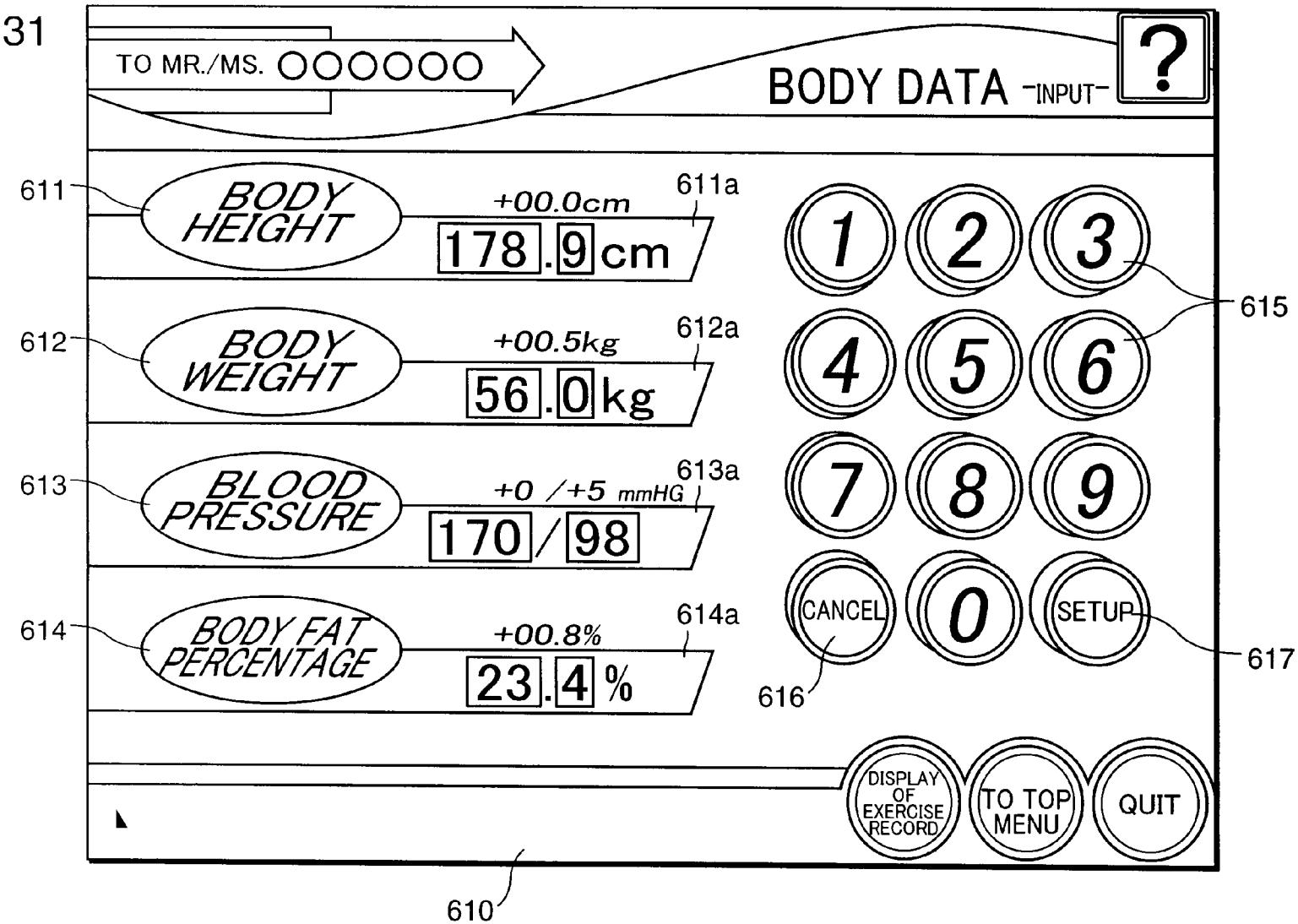
FIG. 31 is a diagram showing one example of a body-data input screen image to be displayed in Step ST13 in the flowchart illustrated in FIG. 27.

The body-data display section 5614 is operable to transmit a request for transmitting body data corresponding to a user ID of a certain user, to the exercise-data management server apparatus 4. Then, the body-data display section 5614 is operable to receive body data from corresponding to the transmission request, from the exercise-data management server apparatus 4, and display a body-data display screen image as shown in FIG. 31, on the monitor 51.

The exercise-data acceptance section 5615 is operable, when the personal authentication is not validated, or second exercise data cannot be transmitted from an exerciser 2 to the exercise-data management server apparatus 4, for some reason, to display an after-mentioned exercise-data input screen image on the monitor 51 so as to accept a user's manual input from the touch panel 51*a*, and transmit the input exercise data to the exercise-data management server apparatus 4. Then, the exercise-data input section 4619 of the exercise-data management server apparatus 4 is operable to store the exercise data received from the exercise-data acceptance section 5615, in the exercise-data storage section 4622.

Figure 16:
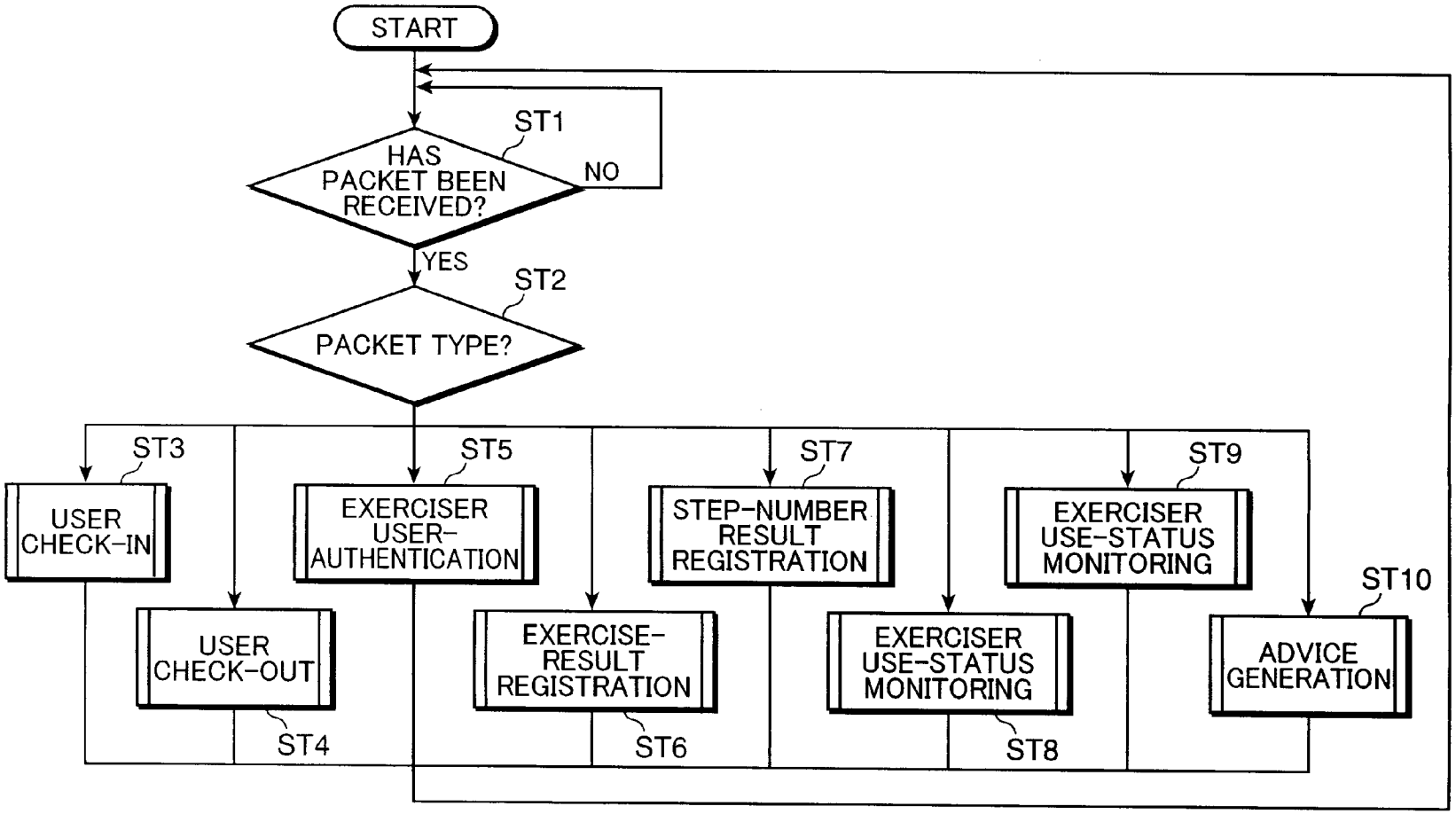
FIG. 16 is a flowchart generally showing one example of an operation of the exercise-data management server apparatus.

With reference to flowcharts illustrated in FIGS. 16 to 26, an operation of the exercise-data management server apparatus 4 will be described below. The following description will be made on the assumption that a membershipping process of a user has been completed, and an ID card has been issued to the user. FIG. 16 is a flowchart generally showing one example of the operation of the exercise-data management server apparatus 4. Firstly, it is determined whether a packet is received from at least either one of the client terminal apparatus 5, the pedometer 1, the exercisers 2, the studio gates 3, the ID card reader 41 and the IC chip reader 42 which are connected to the network communication section 48 and the external device control section 482, (Step ST1). If it is determined that no packet is received, a waiting state will be continued until a packet is received. When it is determined that a packet is received, a packet type is determined based on the received data (Step ST2). Then, depending on packet types, a user check-in processing (Step ST3), a user check-out processing (Step ST4), an exerciser user-authentication processing (Step ST5), an exercise-result registration processing (Step ST6), a step-number result registration processing (Step ST7), an exerciser use-status monitoring processing (Step ST8), an exerciser use-status transmission processing (Step ST9) and an advice generation processing (Step ST10) are performed. When each of the processings is completed, the process retunes to Step ST1, and the above processings will be repeated.

Figure 17:
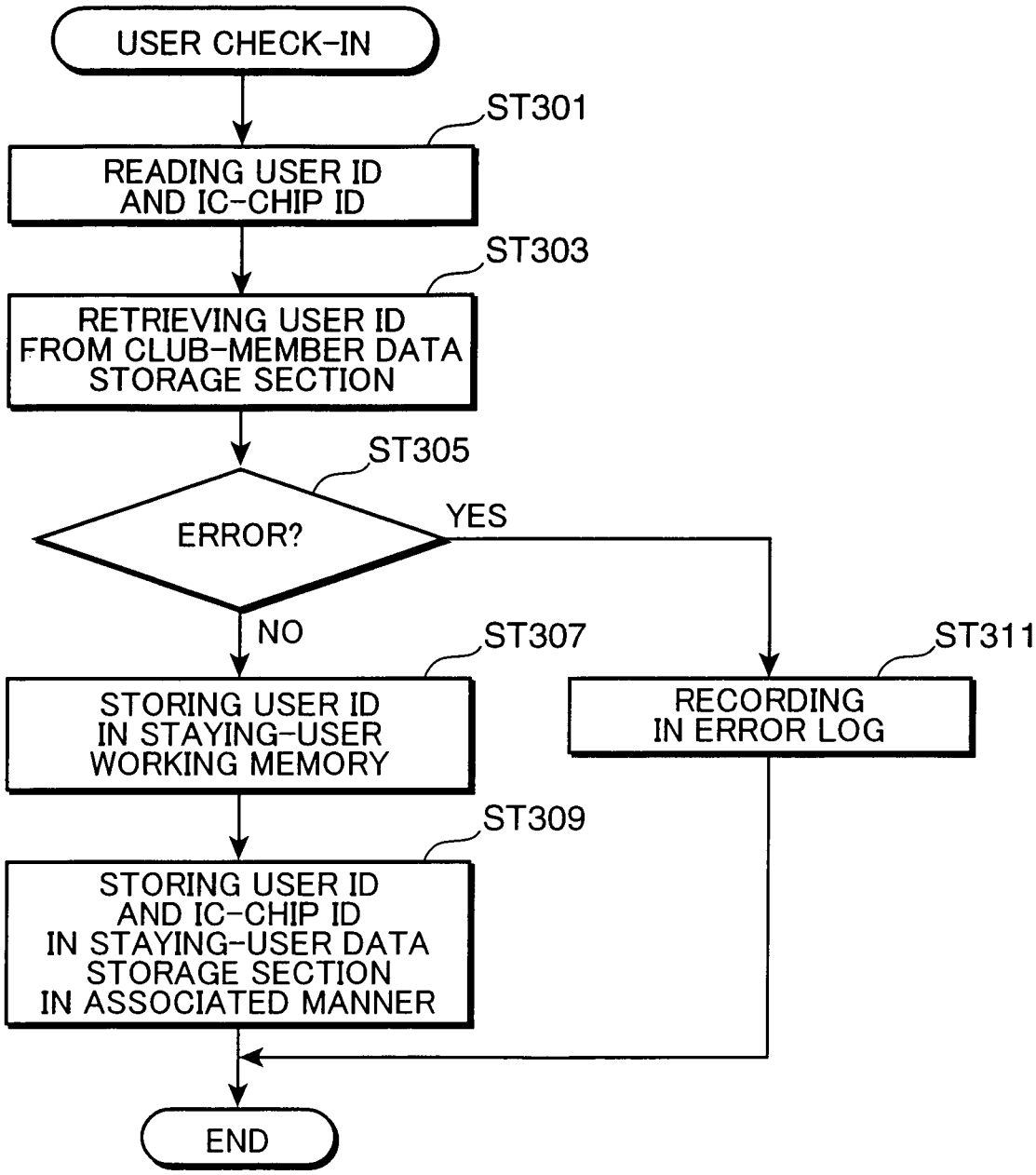
FIG. 17 is a detailed flowchart showing one example of a user check-in processing to be executed in Step ST3 in the flowchart illustrated in FIG. 16.

FIG. 17 is a detailed flowchart showing one example of a user check-in processing to be executed in Step ST3 in the flowchart illustrated in FIG. 16. In this processing, during admission into the fitness club, IC-chip IP of the user has been registered in the staying-user data storage section 4627, and written into a wristband 8, and the wristband 8 has been given to the user.

Firstly, the user ID and the IC-chip ID are read by the IC card reader 41 and the IC chip reader 42, respectively (Step ST301). Then, a retrieval on whether a user ID identical to the read user ID is stored in the club-member data storage section 4621 is performed (Step ST303). Then, it is determined whether the identical user ID is found in the retrieval (Step ST305). If no identical user ID is found, this information will be recorded in an error log for storing error information (Step ST311) and the process will be terminated. When the identical user ID is found, club-member information and exercise record corresponding to the user ID are extracted from club-member information stored in the club-member data storage section 4621, and body data corresponding to the user ID is extracted from body data stored in the body-data storage section 4624. Then, the extracted information is stored in an after-mentioned staying-user working memory (Step ST307). Thus, the IC-chip ID is stored in the staying-user data storage section 4627 in association with the user ID (Step ST309), and the process is terminated.

The staying-user working memory (which is omitted in the functional block diagram illustrated in FIG. 13, for simplicity) is provided in the RAM 462 to store club-member information and body data in association with each club members staying in the fitness club. As to club-member information of a club member staying in the fitness club, the club-member information corresponding to the user ID of each club member staying in the fitness club is extracted from the club-member information stored in the club-member data storage section 4621 and then stored in the staying-user working memory by the CPU 461. Further, body data corresponding to the user ID of each club member staying in the fitness club is extracted from the body information stored in the body-data storage section 4624, and stored in the staying-user working memory by the CPU 461.

As above, the IC-chip ID is stored in the staying-user data storage section 4627 in association with the user ID. Thus, in the after-mentioned user-check-out processing, the exerciser user-authentication processing, etc., if information is retrieved form the entire club-member information stored in the club-member data storage section 4621, the club-member information of entire club members will be subjected to the retrieval. In the above embodiment, only the club-member information of club members staying in the fitness club (stored in the staying-user data storage section 4627) is subjected to retrieval, and therefore the number of club members to be subjected to the retrieval is significantly reduced. This makes it possible to reduce a CPU load required for the personal authentication so as to provide enhanced throughput or processing speed.

While this embodiment is described based on the configuration provided with the staying-user data storage section 4627 and the staying-user working memory, IC-chip ID may be stored the staying-user data storage section 4627, and the staying-user data storage section 4627 may have the function of the staying-user working memory (a configuration where the RAM 462 has no staying-user working memory). In this case, a CPU load required for retrieval on IC-chip ID during the personal authentication will be increased and a processing speed will be lowered.

Figure 18:
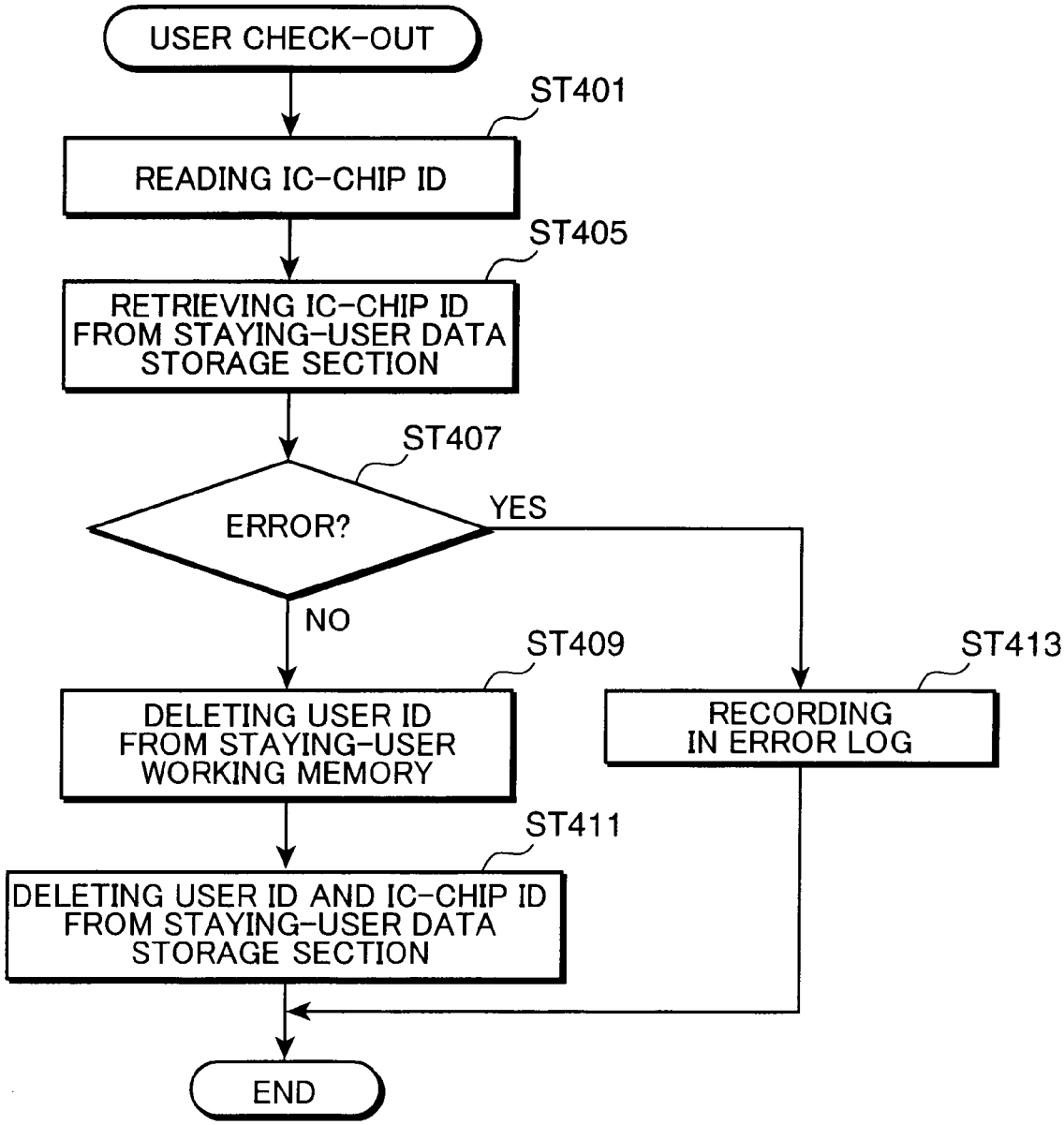
FIG. 18 is a detailed flowchart showing one example of a user check-out processing to be executed in Step ST4 in the flowchart illustrated in FIG. 16.

FIG. 18 is a detailed flowchart showing one example of the user check-out processing to be executed in Step ST4 in the flowchart illustrated in FIG. 16. Firstly, the IC-chip ID is read by the IC chip reader 42 (Step ST401). Then, a retrieval on whether IC-chip ID identical to the read IC-chip ID is stored in the staying-user data storage section 4627 is performed (Step ST405). Then, it is determined whether the identical IC-chip ID is found in the retrieval (Step ST407). If no identical IC-chip ID is found, this information will be recorded in the error log (Step ST413) and the process will be terminated. When the identical user ID is found, the user ID corresponding to the IC-chip ID and the user information etc., corresponding to the user ID are deleted from the staying-user working memory (Step ST409). Thus, the IC-chip ID and the user ID are deleted from the staying-user data storage section 4627 (Step ST411) and the process is terminated.

Figure 19:
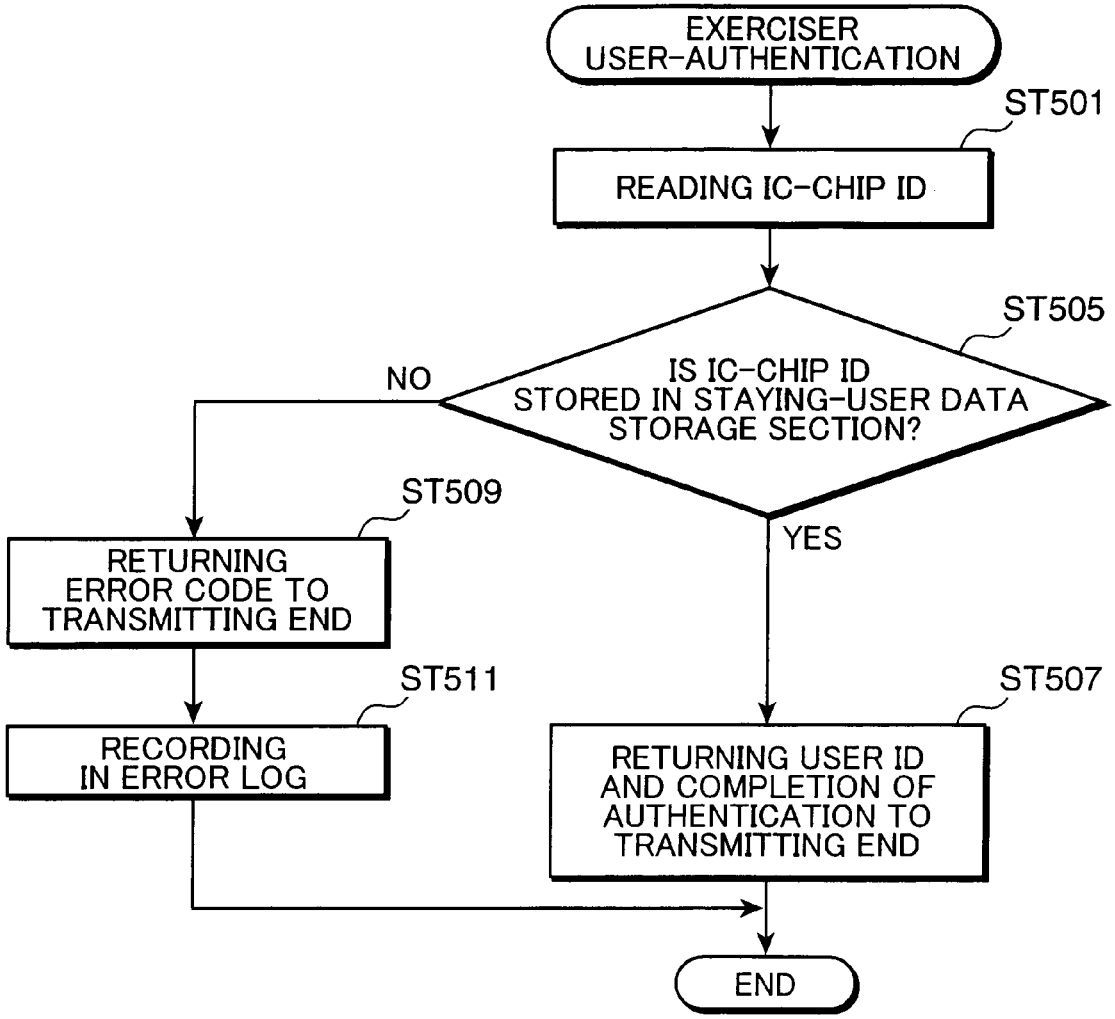
FIG. 19 is a detailed flowchart showing one example of an exerciser user-authentication processing to be executed in Step ST5 in the flowchart illustrated in FIG. 16.

FIG. 19 is a detailed flowchart showing one example of an exerciser user-authentication processing to be executed in Step ST5 in the flowchart illustrated in FIG. 16. The exerciser user-authentication means a user authentication which is performed based on information from an exerciser 2 or a studio gate 3. Firstly, the IC-chip ID is read by an IC-chip reader 28*a*, 31 of an exerciser 2 or a studio gate 3 (hereinafter referred to as "transmitter terminal" for simplicity) (Step ST501). Then, it is determined whether IC-chip ID identical to the read IC-chip ID is stored in the club-member data storage section 4621 (Step ST505). If it is determined that no identical IC-chip ID is stored, an error code indicating that no identical IC-chip ID is stored will be transmitted to the transmitter terminal (Step ST509), and, after recording the error code in the error log (Step ST511), the process will be terminated. In Step ST505, when it is determined that the identical IC-chip ID is stored, an acknowledge signal indicative of completion of the personal authentication and the user ID corresponding to the IC-chip ID are returned to the transmitter terminal (Step ST507) and the process is completed.

Figure 20:
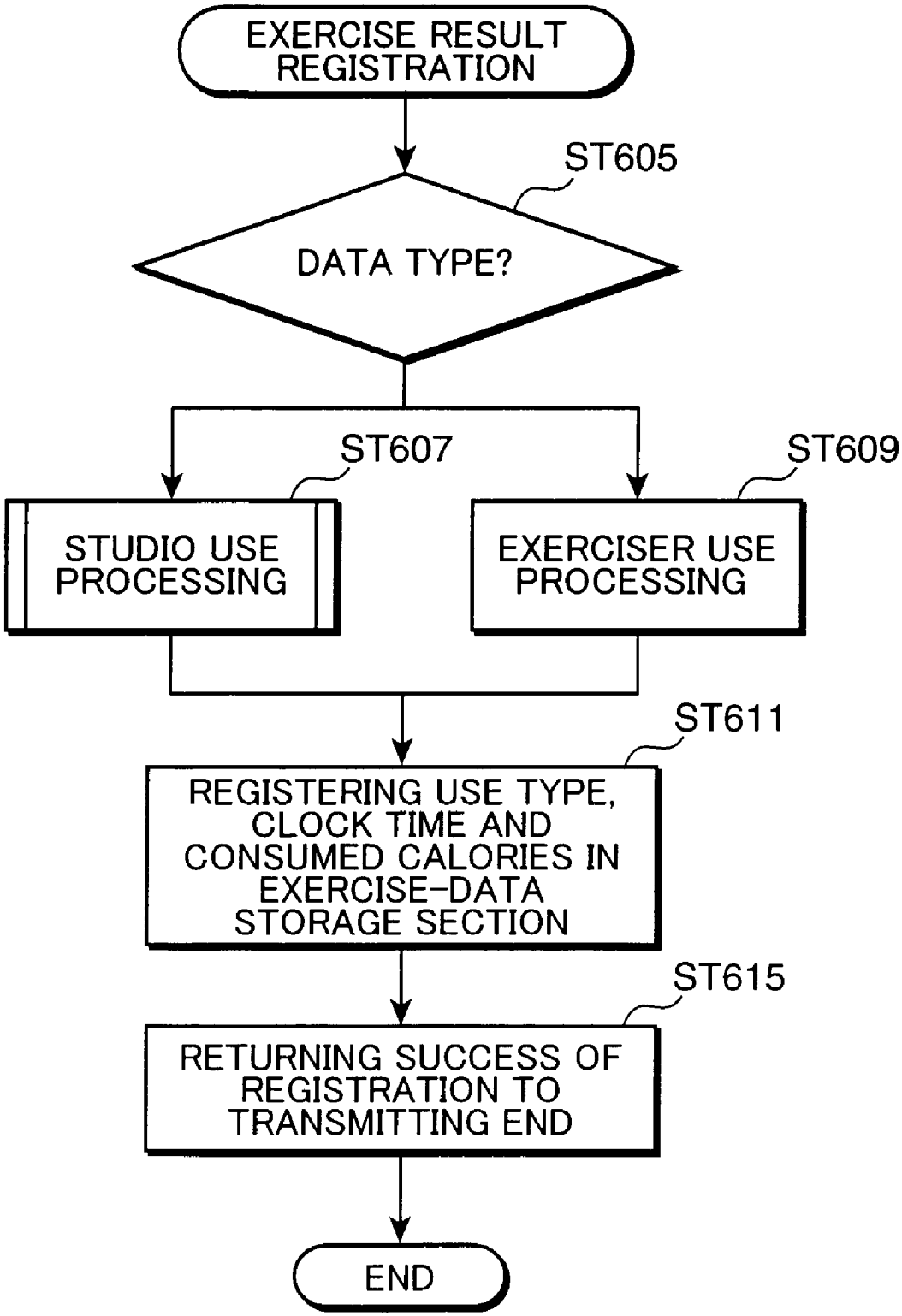
FIG. 20 is a detailed flowchart showing one example of an exercise-result registration processing to be executed in Step ST6 in the flowchart illustrated in FIG. 16.

FIG. 20 is a detailed flowchart showing one example of the exercise-result registration processing to be executed in Step ST6 in the flowchart illustrated in FIG. 16. The exercise-result registration processing in this example is configured to register exercise result data (store exercise data in exercise-data storage section 4622) based on information from an exerciser 2 or a studio gate 3 (hereinafter referred to as "transmitter terminal" for simplicity). Further, the following description will be made on the assumption that the personal authentication has been completed through the exerciser user-authentication described in FIG. 19. The exercise-result registration processing is performed by the exerciser-data receiving section 4612, the exercise-type determination section 4617 and the total-consumed-calorie calculation section 4613. Firstly, it is determined to which of an exerciser 2 or a studio gate 3 the transmitter terminal corresponds (Step ST605).

Figure 21:
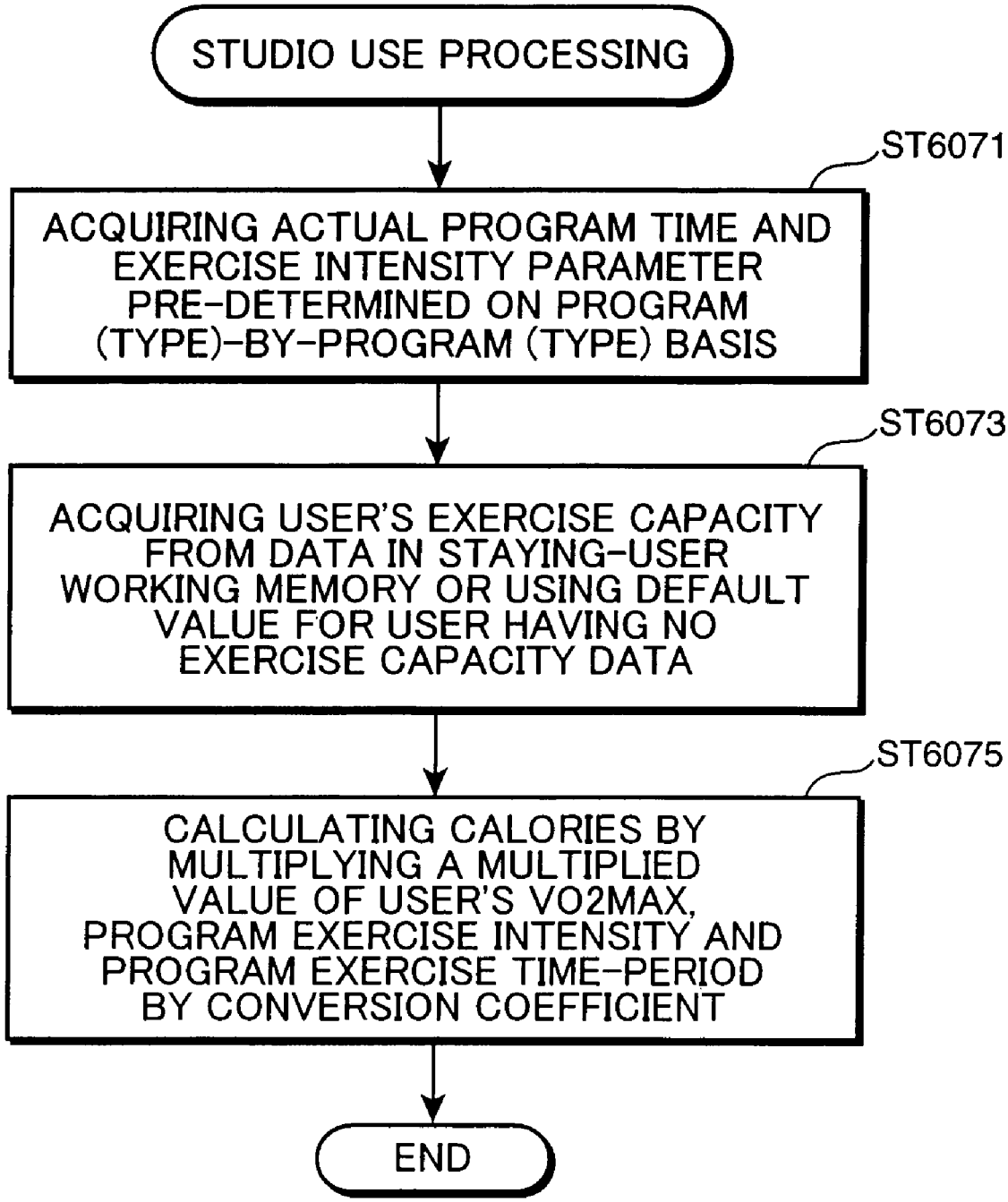
FIG. 21 is a detailed flowchart showing one example of a studio use processing (calorie value calculation) to be executed in Step ST607 in the flowchart illustrated in FIG. 20.

When it is determined that the transmitter terminal is a studio gate 3, a studio use processing illustrated in FIG. 21 is performed to calculate a consumed calorie value in the studio (Step ST607), and the process advances to Step ST611. When it is determined that the transmitter terminal is an exerciser 2, an exerciser use processing is performed to calculate (or correct) a consumed calorie value with reference to the body data stored in body-data storage section 4624 according to need (Step ST609). After completion of Step S607 or S609, identification information of the exerciser 2 or exercise data in the studio, such as exercise type, clock time and consumed calorie value, is stored in the exercise-data storage section 4622 in association with the user ID. Then, the total-consumed-calorie calculation section 4613 calculates a total consumed calorie value of the entire exercise types including an after-mentioned consumed calorie value read from a pedometer 1, and the remaining-consumed-calorie calculation section 4614 calculates a remaining-consumed calorie value which is a difference between the target total consumed calorie value pre-stored in the exercise-data storage section 4622 and the total consumed calorie value. Then, the total consumed calorie value and the remaining-consumed calorie value are stored in the exercise-data storage section 4622 in association with the user ID (Step ST611). Then, information indicating that the exercise data has been successively stored in the exercise-data storage section 4622 is returned to the transmitter terminal (Step ST615), and the process is terminated.

As above, a total consumed calorie value which is a sum of consumed calories on a user-by-user basis is calculated without taking along a pedometer 1 in the fitness club, to provide enhanced user-friendliness. In addition, data received from a pedometer 1 and each exerciser 2 is stored in the exercise-data storage section 4622 in association with identification information of the transmitter terminal on a user-by-user basis and in a centralized manner to facilitate data management.

FIG. 21 is a detailed flowchart showing one example of a studio-use processing (calorie value calculation) to be executed in Step ST607 in the flowchart illustrated in FIG. 20. This flowchart is started after an exercise type performed by a studio user is determined by the exercise-type determination section 4617 with reference to the schedule storage section 4623 based on a received gate number and a studio-entrance clock time. For example, given that a daily schedule of exercise types (aerobics, dance, etc.) to be performed in the studio is pre-determined. For example, the daily schedule is determined such that a beginner's aerobics program is set between 9:00 to 9:50, and an intermediate user's aerobics program is set between 11:00 to 11:50, - - - . Thus, a time zone is identified by determining to which of the time zones the received clock-time data belongs, and an exercise type is identified based on correspondence to the identified time zone. In this manner, the process of determining to which of time zones received clock-time data belongs allows a user to complete an authentication operation to a studio gate 3 only by a one-time operation during entrance into a studio, so as to provide enhanced user-friendliness.

Firstly, the total-consumed-calorie calculation section 4613 acquires an exercise intensity parameter value corresponding to the exercise type determined based on the schedule storage section 4623, and an exercise time-period (Step ST6071). Then, the total-consumed-calorie calculation section 4613 acquires a VO2MAX in accordance with body data corresponding to the user ID of the user, which is read from the body data stored in the body-data storage section 4624 (Step ST6073). Then, the acquired VO2MAX exercise capacity, the exercise intensity parameter value and the exercise time-period are multiplied. Then, the calculated value is multiplied by a conversion coefficient and converted to a calorie value so as to obtain an assumed consumed calorie value as a result of the type of exercise (Step ST6075), and the process is terminated. The calculated consumed calorie value will be added to the total consumed calorie value.

If it is determined that no VO2MAX is stored in the body-data storage section 4624, i.e., for a user who has had no measurement of the exercise capacity, a default value as a standard value will be acquired, and a consumed calorie value will be calculated using the default value.

As above, an exercise type performed by a studio user is determined, and an assumed consumed calorie value corresponding to the determined exercise type is calculated and added to the total consumed calorie value. Thus, the exercise performed by a studio user is reflected to the total consumed calorie value to allow the total consumed calorie value to be further accurately calculated so as to further enhance the user-friendliness.

Figure 22:
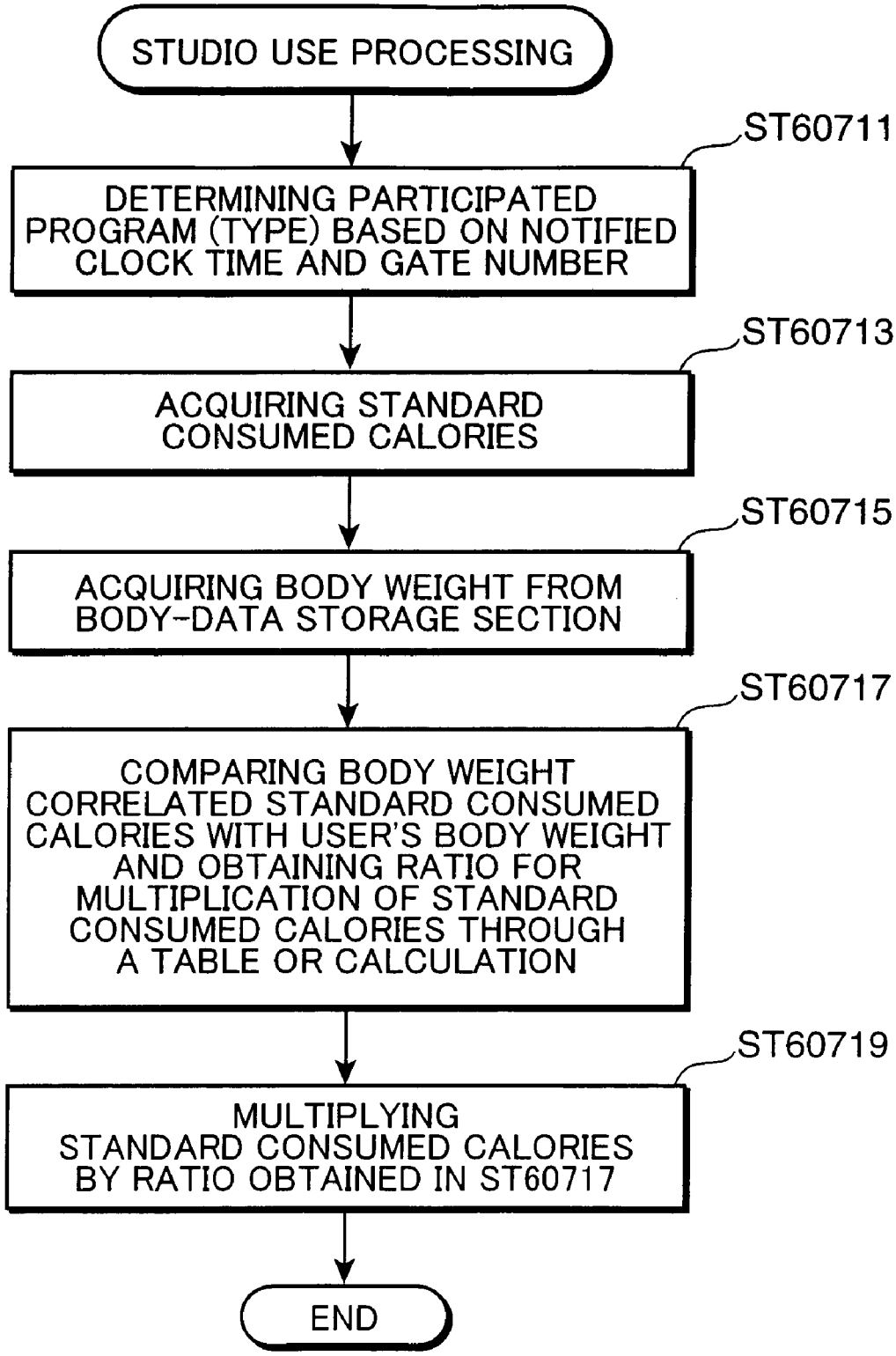
FIG. 22 is a detailed flowchart showing another example of a studio use processing (calorie value calculation) to be executed in Step ST607 in the flowchart illustrated in FIG. 20.

FIG. 22 is a detailed flowchart showing another example of the studio use processing (calorie value calculation) to be executed in Step ST607 in the flowchart illustrated in FIG. 20. Firstly, the exercise-type determination section 4617 determines an exercise type performed by a studio user with reference to the schedule storage section 4623 based on a received gate number and a studio-entrance clock-time (Step ST60711). For example, given that a daily schedule of exercise types (aerobics, dance, etc.) to be performed in the studio is pre-determined. For example, the daily schedule is determined such that a beginner's aerobics program is set between 09:00 to 09:50, and an intermediate user's aerobics program is set between 11:00 to 11:50, - - - . Thus, a time zone is identified by determining to which of the time zones the received clock-time data belongs, and an exercise type is identified based on correspondence to the identified time zone. In this manner, the process of determining to which of time zones received clock-time data belongs allows a user to complete an authentication operation to a studio gate 3 only by a one-time operation during entrance into a studio, so as to provide enhanced user-friendliness.

Then, the total-consumed-calorie calculation section 4613 acquires a standard consumed calorie value corresponding to the exercise type determined in Step ST60711 based on the schedule storage section 4623 (Step ST60713). Then, the total-consumed-calorie calculation section 4613 acquires the body weight data corresponding to the user ID of the user which is stored in the body-data storage section 4624 (Step ST60715). Further, the total-consumed-calorie calculation section 4613 compares a user's body weight correlated with the standard consumed calorie value with the user's weight acquired in Step ST60715, and obtains a ratio for calculating a consumed value, with reference to table data (or by a calculation) (Step ST60717). Then, total-consumed-calorie calculation section 4613 multiplies the standard consumed calories value by the ratio to calculate an assumed consumed calorie value as a result of the type of exercise (Step ST60719), and the process is terminated.

As above, an exercise type performed by a studio user is determined, and an assumed consumed calorie value corresponding to the determined exercise type is calculated and added to the total consumed calorie value (Step ST611 in FIG. 20). Thus, the exercise performed by a studio user is reflected to the total consumed calorie value to allow the total consumed calorie value to be further accurately calculated so as to further enhance the user-friendliness.

Figure 23:
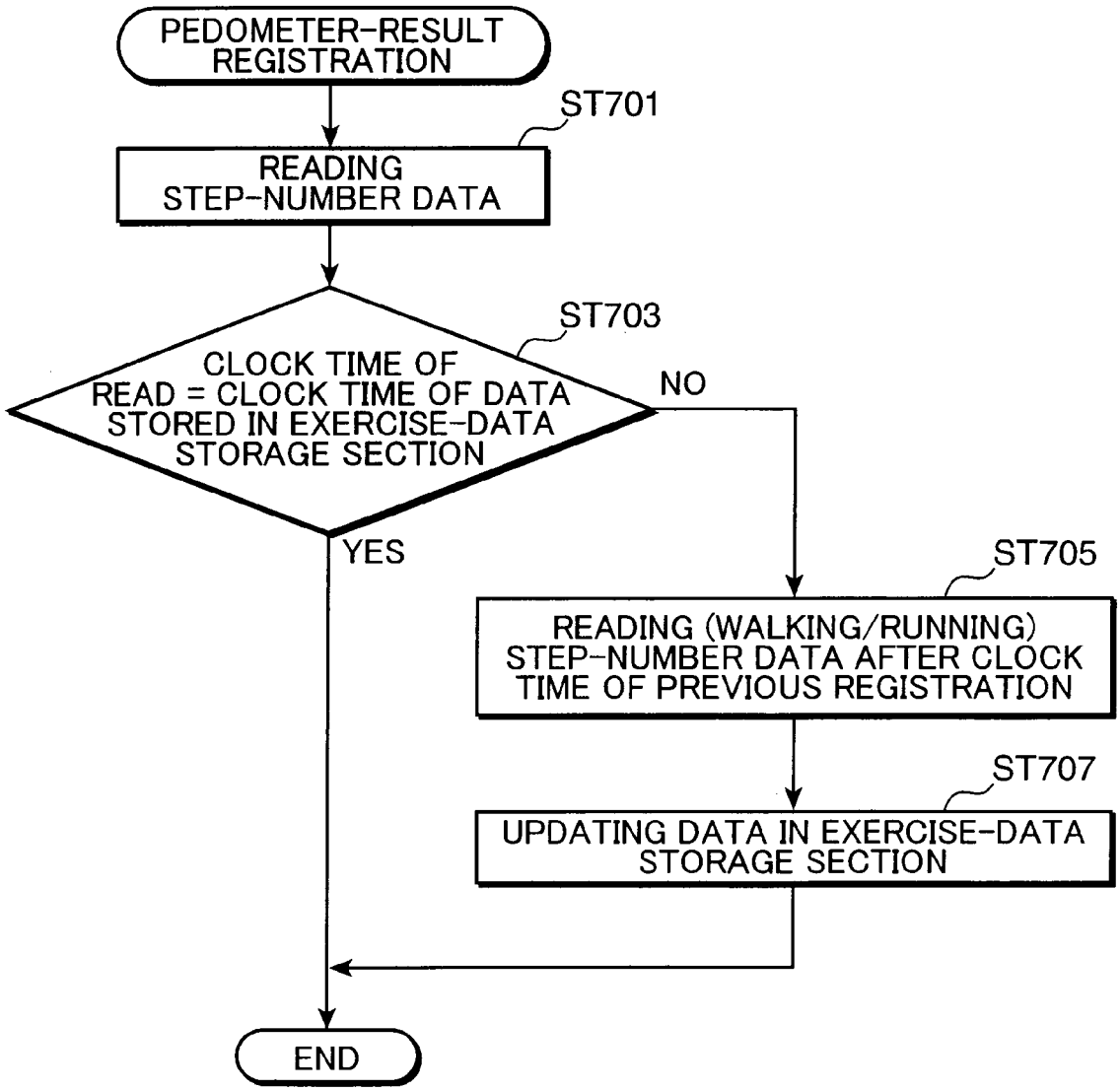
FIG. 23 is a detailed flowchart showing one example of a pedometer-result registration processing to be executed in Step ST7 in the flowchart illustrated in FIG. 16.

FIG. 23 is a detailed flowchart showing one example of the pedometer-result registration processing to be executed in Step ST7 in the flowchart illustrated in FIG. 16. This processing is performed by the pedometer-data receiving section 4611. Firstly, the user ID and step-number data are received from a pedometer 1 through the external I/O control section 481 and the external device control section 482 (Step ST701). Then, it is determined whether a clock time of the execution of Step ST701 is identical to an updated clock time of step-number date stored in the exercise-data storage section 4622 (Step ST703). If the clock time is determined to be identical to the updated clock time, the process will be terminated. If not, step-number data after the updated clock time of the step-number data stored in the exercise-data storage section 4622 is read from the pedometer 1 (Step ST705). The read step-number data is stored in the exercise-data storage section 4622, and the updated clock time of step-number data is rewritten to a clock time of the execution of this processing (Step ST707), and the process is terminated.

Figure 24:
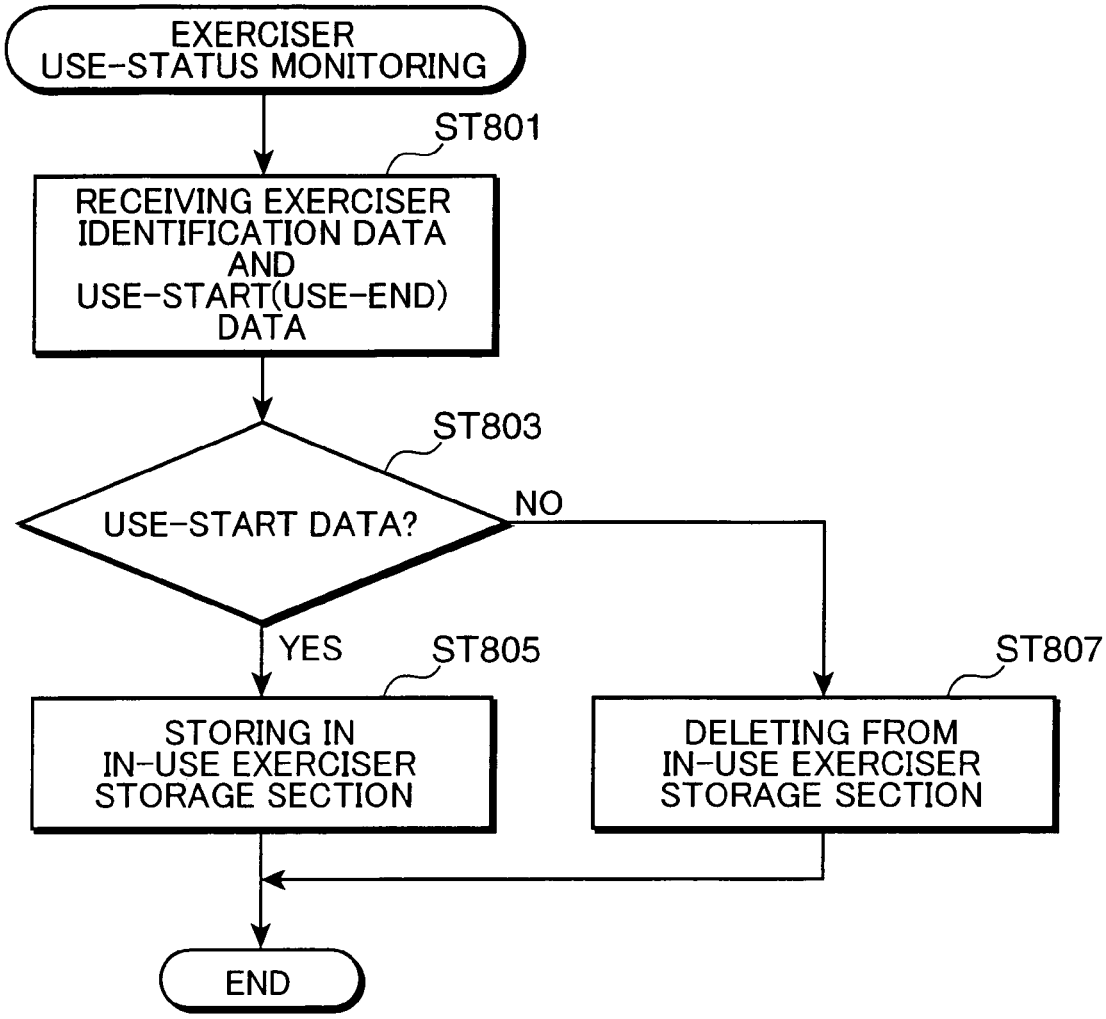
FIG. 24 is a detailed flowchart showing one example of an exerciser-use-status monitoring processing to be executed in Step ST8 in the flowchart illustrated in FIG. 16.

FIG. 24 is a detailed flowchart showing one example of the exerciser-use-status monitoring processing to be executed in Step ST8 in the flowchart illustrated in FIG. 16. This processing is performed by the use-status monitoring section 4620. Firstly, use-start information (use-end information) and exerciser-identification data are received from each exerciser 2 (Step ST801). Then, it is determined whether the received data is use-start information (Step ST803). When the received data is determined to be use-start information, information indicating that the exerciser corresponding to the exerciser-identification data is in use is stored in the in-use exerciser storage section 4625 (Step ST805). If the received data is determined to be not use-start information (i.e., to be use-end information), information indicating that the exerciser corresponding to the exerciser-identification data is in an unused state is stored in the in-use exerciser storage section 4625 (Step ST807).

Figure 25:
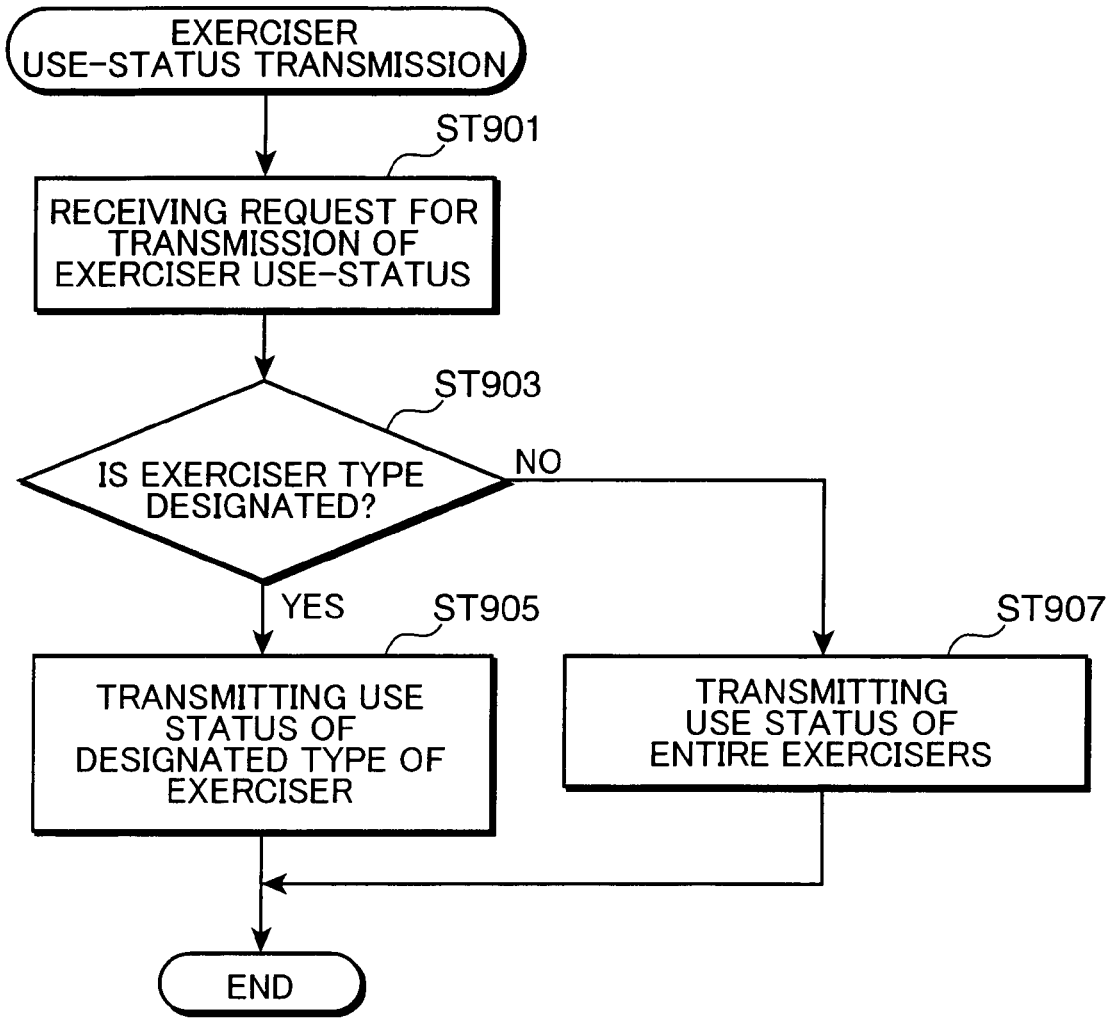
FIG. 25 is a detailed flowchart showing one example of an exerciser-use-status transmission processing to be executed in Step ST9 in the flowchart illustrated in FIG. 16.

FIG. 25 is a detailed flowchart showing one example of the exerciser-use-status transmission processing to be executed in Step ST9 in the flowchart illustrated in FIG. 16. This processing is performed by the use-status monitoring section 4620. Firstly, a request for transmitting exerciser use-status is received from the client terminal apparatus 5 (Step ST901). Then, it is determined whether the request designates a type of exerciser 2 (Step ST903). If a type of exerciser 2 is designated, a use status (in use or in an unused state) of the designated type of exerciser 2 is transmitted to the client terminal apparatus 5 (Step ST905). If a type of exerciser 2 is not designated, a use status (in use or in an unused state) of the entire exercisers 2 is transmitted to the client terminal apparatus 5 (Step ST907).

Figure 26:
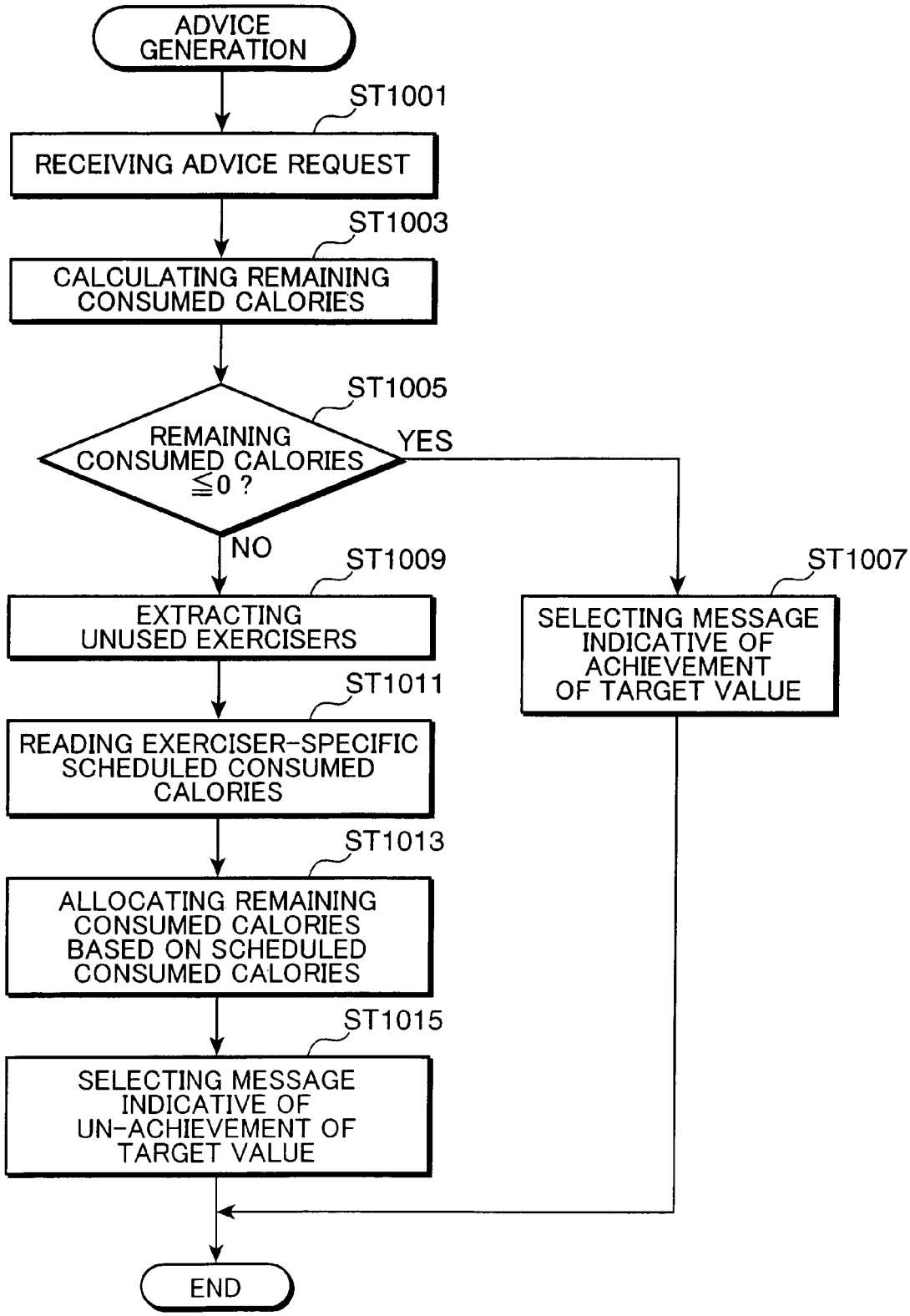
FIG. 26 is a detailed flowchart showing one example of an advice generation processing to be executed in Step ST10 in the flowchart illustrated in FIG. 16.

FIG. 26 is a detailed flowchart showing one example of the advice generation processing to be executed in Step ST10 in the flowchart illustrated in FIG. 16. This processing is performed by the remaining-consumed-calorie calculation section 4614. Firstly, a request for transmitting an advice on subsequent exercise is received from the client terminal apparatus 5 (Step ST1001). Then, a remaining consumed calorie value which is a difference between the target consumed calorie value stored in the exercise-data storage section 4622 and the total consumed calorie value calculated by the total-consumed-calorie calculation section 4613 is calculated, and stored in the exercise-data storage section 4622 in association with the user ID and the clock-time information (Step ST1003).

Then, it is determined whether the remaining consumed calorie value is "0 (zero)" or less (Step ST1005). If the remaining consumed calorie value is determined to be "0" or less, a message suitable for this remaining consumed calorie value will be selected from the message storage section 4626, and transmitted to the client terminal apparatus 5 (Step ST1007). When the remaining consumed calorie value is determined to be not "0" or less, unused exercisers 2 are extracted with reference to the in-use exerciser storage section 4625 (Step ST1009). Then, the exerciser-specific scheduled consumed calorie values stored in the exercise-data storage section 4622 is read (Step ST1011). Then, based on the exerciser-specific scheduled consumed calorie values, the remaining consumed calorie value is allocated to the unused exercisers 2 (Step ST1013). Then, a message suitable for this remaining consumed calorie value will be selected from the message storage section 4626, and transmitted to the client terminal apparatus 5 (Step ST1015).

As above, as an exerciser 2 to be used for consuming a remaining consumed calorie value, unused exercisers 2 are selected, and the user can use the designated exercisers 2 to quickly consume the remaining consumed calorie value so as to provide enhanced user-friendliness. In addition, the remaining consumed calorie value is allocated to the unused exercisers 2 based on the exerciser-specific scheduled consumed calorie values, and the user can use the scheduled exercisers 2 to perform exercise for consuming the remaining consumed calorie value, so as to provide further enhanced user-friendliness.

An operation of the client terminal apparatus will be described based on the flowcharts illustrate in FIGS. 27 to 29. The following description will be made on the assumption that a user has checked in at the fitness club (i.e., the user check-in processing of Step ST3 in the flowchart illustrated in FIG. 16 has been completed), and IC-chip ID has been read by the client terminal apparatus 5 to complete a user authentication in the client terminal apparatus 5. That is, the client terminal apparatus 5 recognizes a user ID of the user.

Figure 27:
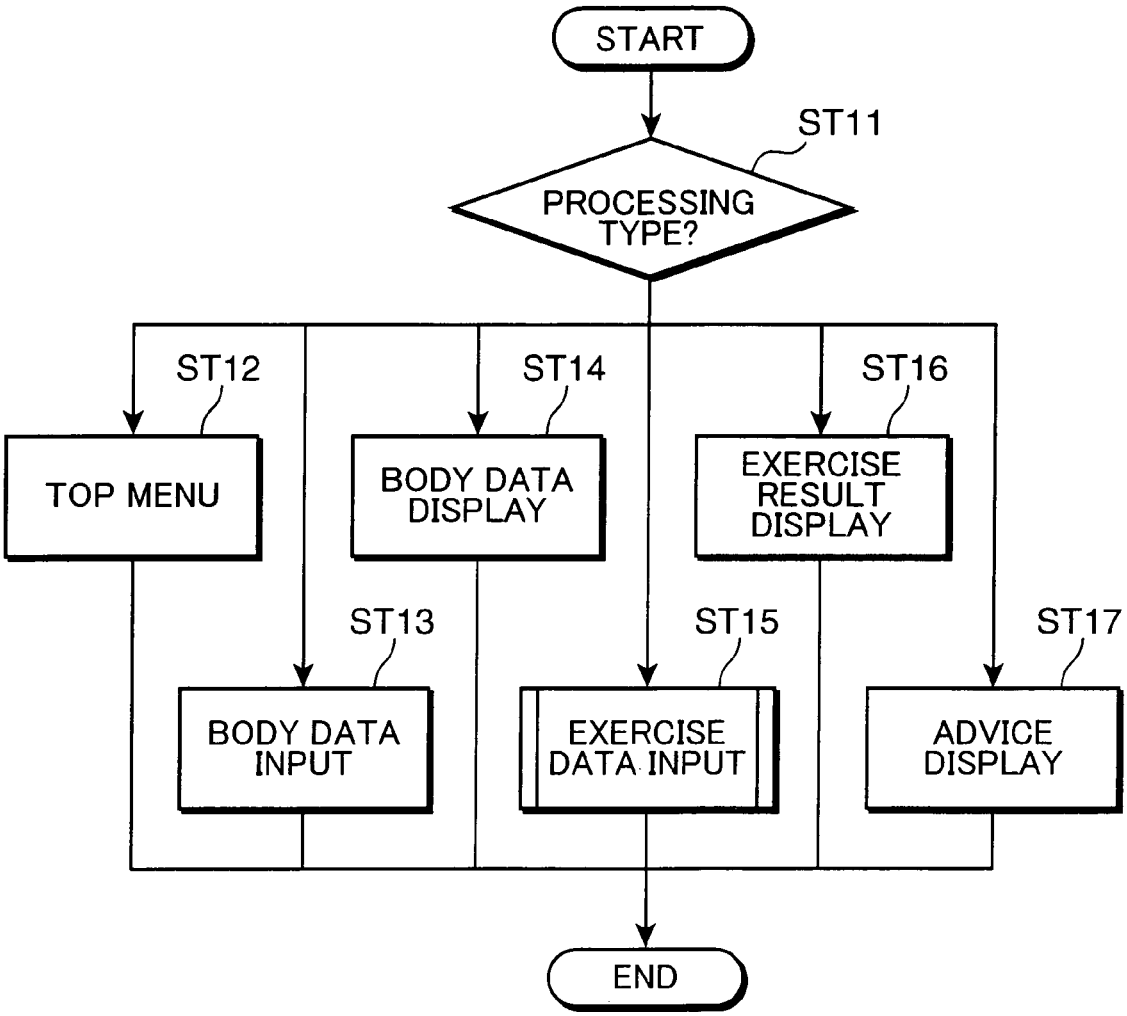
FIG. 27 is a flowchart generally showing one example of an operation of a client terminal apparatus.
Figure 32:
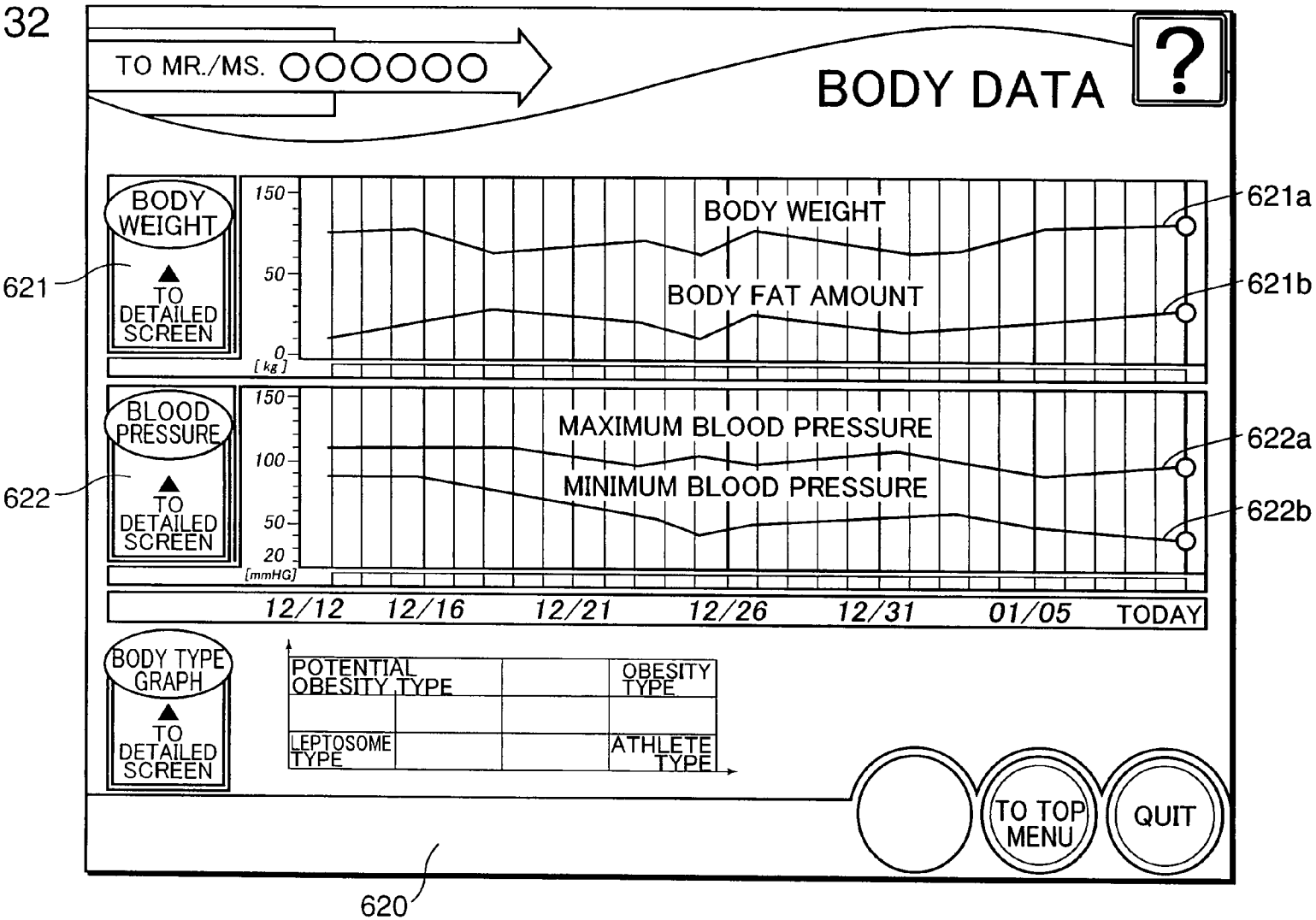
FIG. 32 is a diagram showing one example of a body-data display screen image to be displayed in Step ST14 in the flowchart illustrated in FIG. 27.

FIG. 27 is a flowchart generally showing one example of an operation of the client terminal apparatus 5. Firstly, the touch panel 51*a* accepts a user's input of processing-name information for designating an intended processing, and a processing type is determined (Step ST11). When the processing type is determined as a top-menu display processing, a top-menu display screen image illustrated in FIG. 27 is displayed (Step ST12), and the process is terminated. When the processing type is determined as a body-date input processing, the body-data acceptance section 5613 operates to display a body-data input screen image illustrated in FIG. 28 on the monitor 51 so as to accept an input of body data from the touch panel 51*a*. Then, the accepted body data is transmitted to the exercise-data management server apparatus 4 (Step ST13), and the process is terminated. When the processing type is determined as a body-date display processing, the body-data display section 5614 transmits a request for transmitting body data corresponding to the user ID of the user, to the exercise-data management server apparatus 4, receives body data corresponding to the transmission request, from the exercise-data management server apparatus 4. Then, a body-data display screen image illustrated in FIG. 32 is displayed on the monitor 51 (Step ST14), and the process is terminated.

Figure 36:
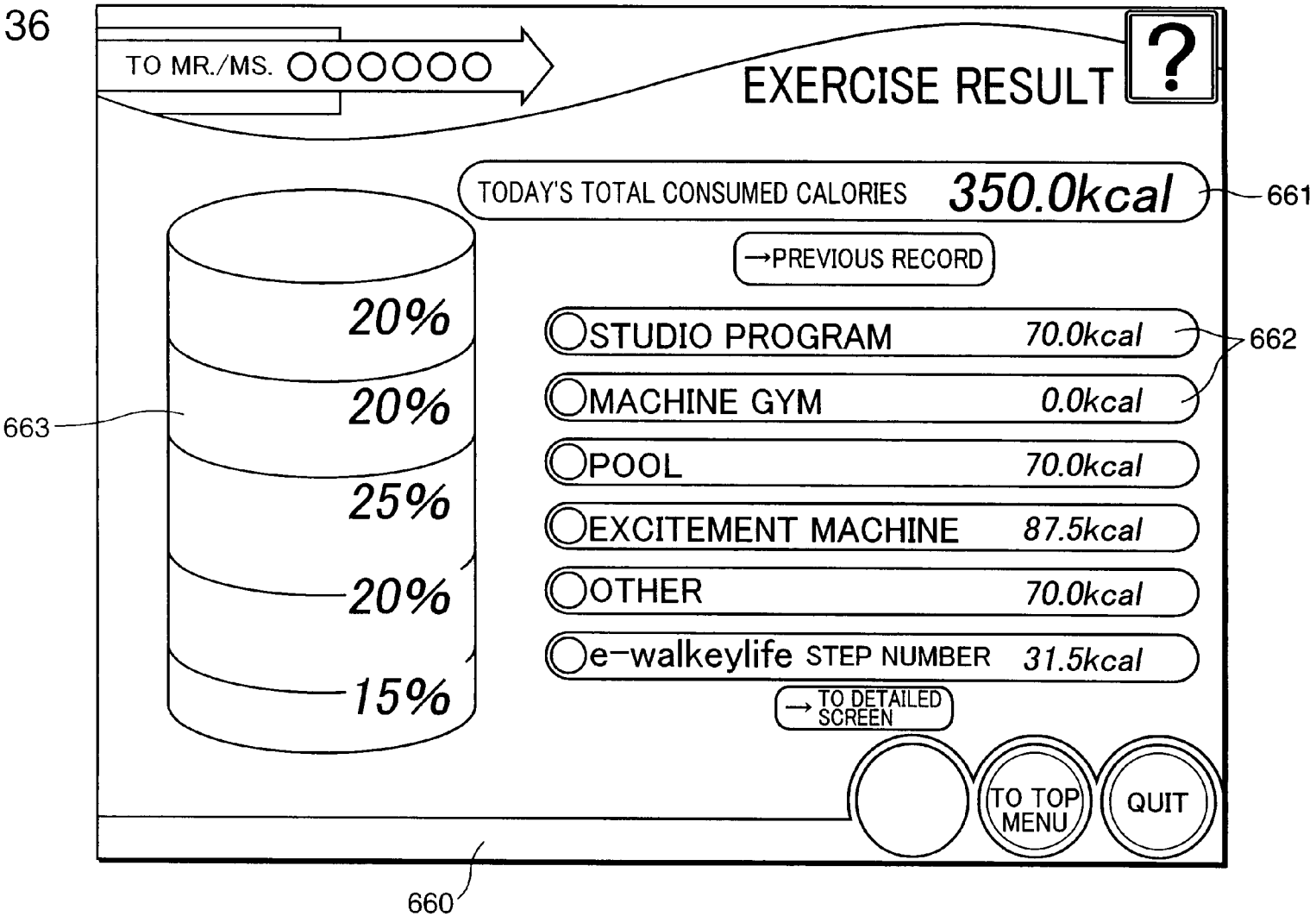
FIG. 36 is a diagram showing one example of an exercise-data display screen image to be displayed in Step ST16 in the flowchart illustrated in FIG. 27.
Figure 37:
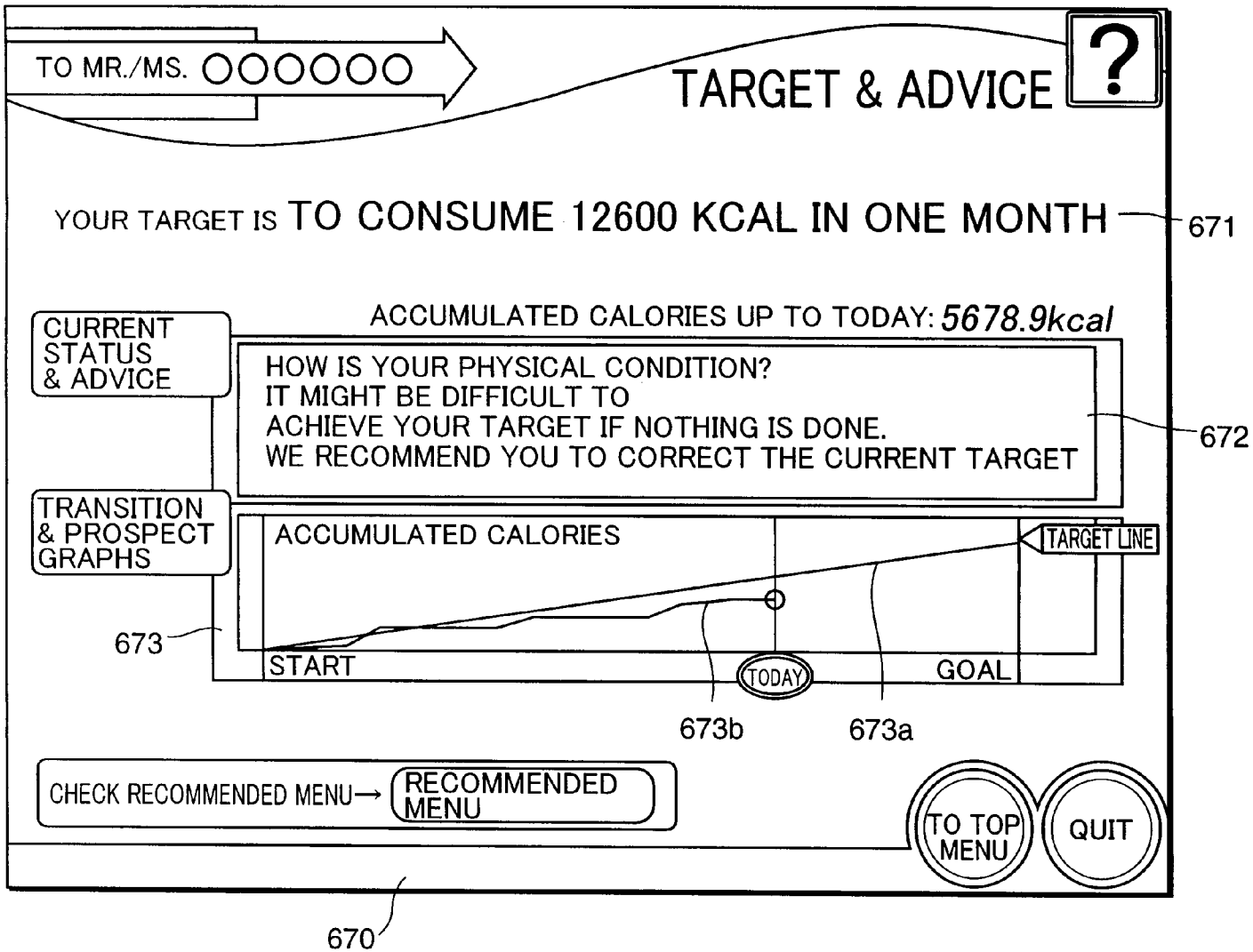
FIG. 37 is a diagram showing one example of an advice display screen image to be displayed in Step ST17 in the flowchart illustrated in FIG. 27.

When the processing type is determined as an exercise-date input processing, the exercise-data acceptance section 5615 operates to display first to third exercise-date input screen images on the monitor 51. Then, the exercise-date input processing illustrated in FIG. 28 is performed (Step ST15), and the process is terminated. When the processing type is determined as an exercise-result display processing, a request for transmitting exercise data corresponding to the user ID of the user is transmitted to the exercise-data management server apparatus 4, and receives exercise data corresponding to the transmission request, from the exercise-data management server apparatus 4. Then, an exercise-data display screen image illustrated in FIG. 36 is displayed on the monitor 51 (Step ST16), and the process is terminated. When the processing type is determined as an advice display processing, a request for transmitting advice data corresponding to the user ID of the user is transmitted to the exercise-data management server apparatus 4, and receives exercise data-based advice data corresponding to the transmission request, from the exercise-data management server apparatus 4. Then, an advice display screen image illustrated in FIG. 37 is displayed on the monitor 51 (Step ST17), and the process is terminated.

Figure 28:
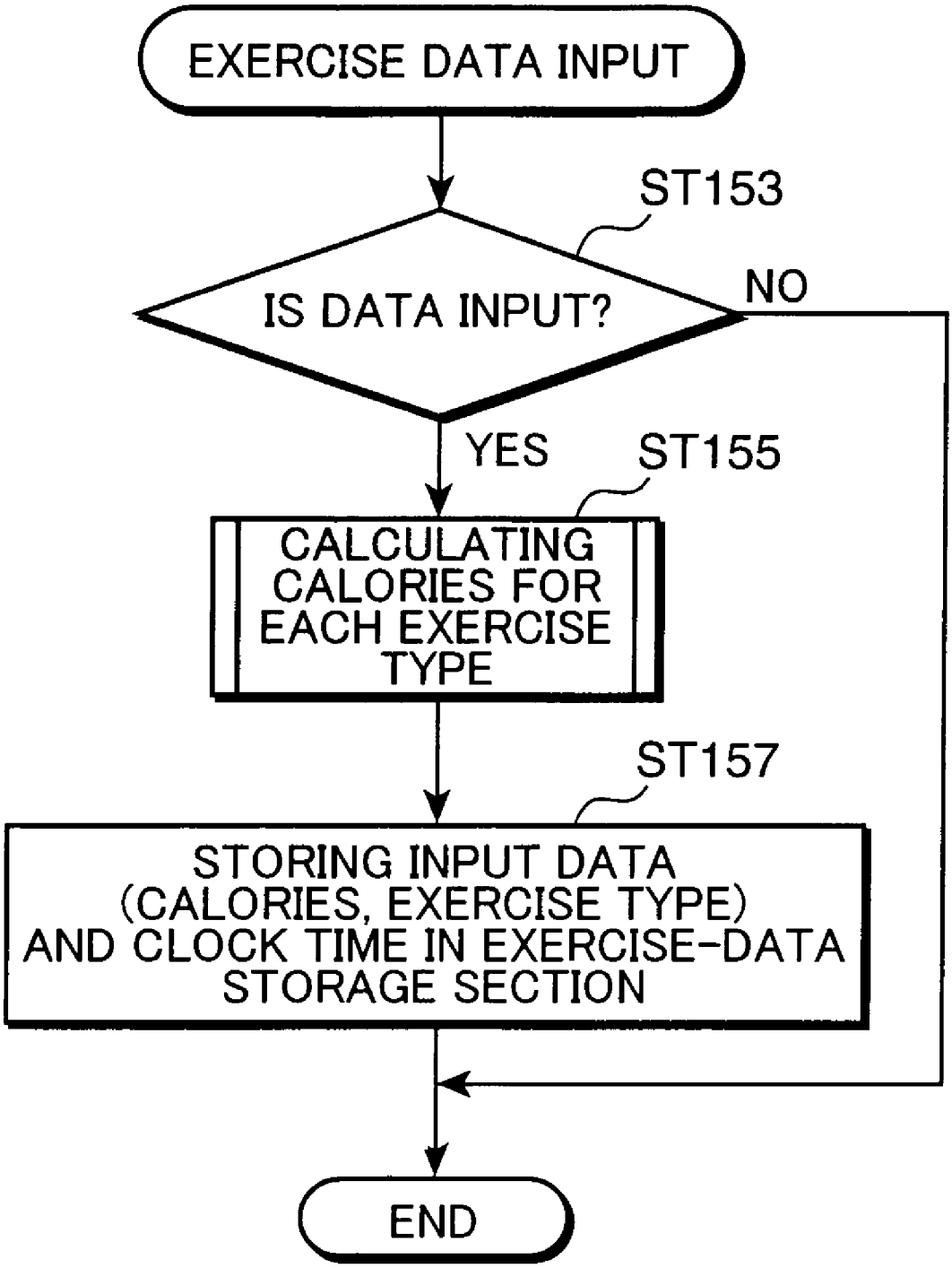
FIG. 28 is a detailed flowchart showing one example of an exercise-data input processing to be executed in Step ST15 in the flowchart illustrated in FIG. 27.

FIG. 28 is a detailed flowchart showing one example of the exercise-data input processing to be executed in Step ST15 in the flowchart illustrated in FIG. 27. The following processing is performed by the exercise-data acceptance section 5615. Firstly, it is determined where exercise data is input (Step ST153). If it is determined that no exercise data is input, the process will be terminated. If it is determined that exercise data is input based on an input from the touch panel 51*a*, an exercise type-specific consumed calorie value calculation process illustrated in FIG. 29 is performed (Step ST155). Then, exercise data including the consumed calorie value calculated in Step ST155 is transmitted to the exercise-data management server apparatus 4 (Step S157), and the process is terminated. In Step S157, the exercise data transmitted to the exercise-data management server apparatus 4 is stored in the exercise-data storage section 4622 through the exercise-data input section 4619.

Figure 29:
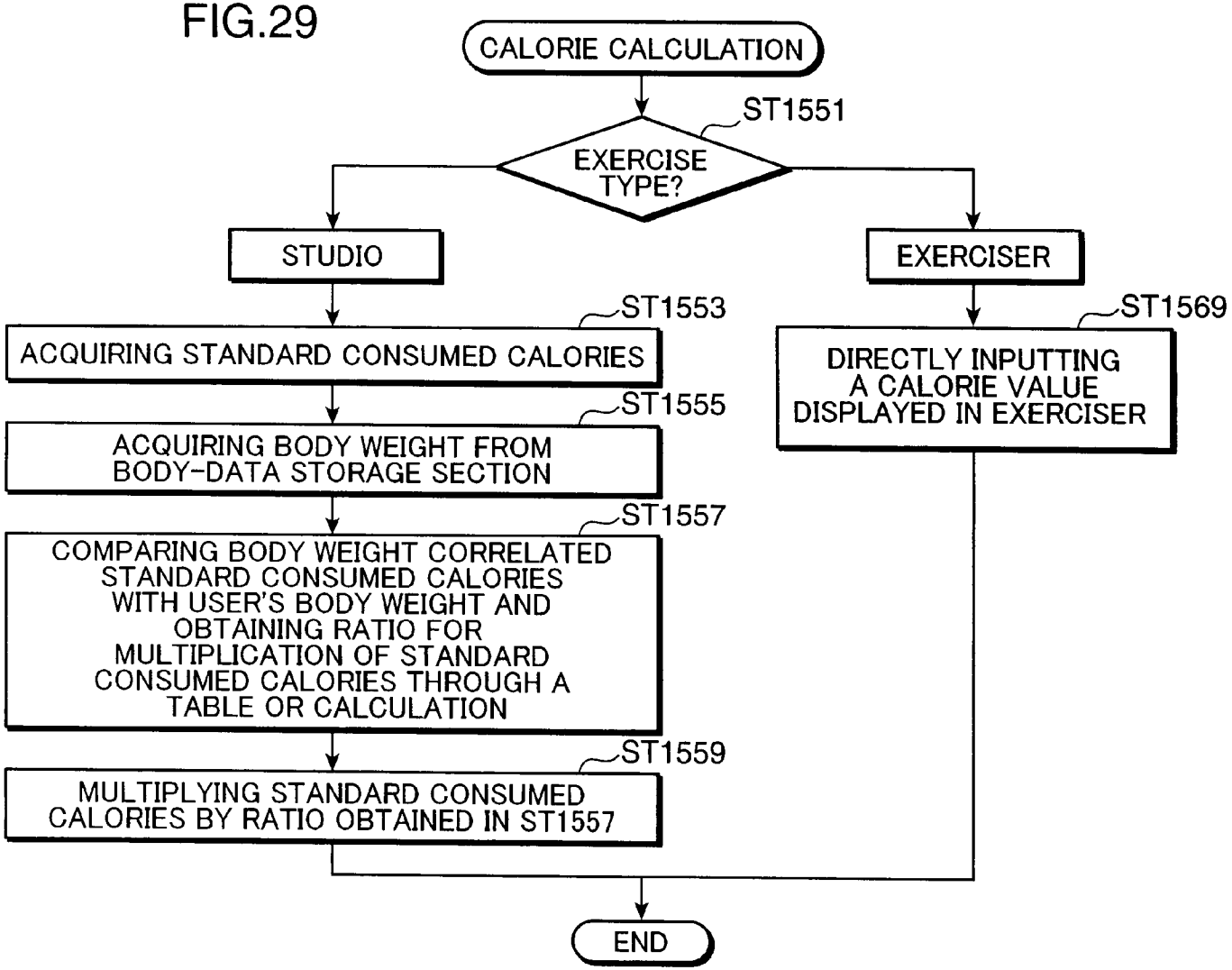
FIG. 29 is a detailed flowchart showing one example of a consumed-calorie calculation processing to be executed in Step ST155 in the flowchart illustrated in FIG. 28.

FIG. 29 is a detailed flowchart showing one example of the consumed-calorie calculation processing to be executed in Step ST155 in the flowchart illustrated in FIG. 28. Firstly, a determination on exercise type is performed based on an input from the touch panel 51*a* (Step ST1551). When the exercise type is determined as a type to be performed in a studio, a request for transmitting a standard consumed calorie value corresponding to the determined exercise type is transmitted to the exercise-data management server apparatus 4, and the standard consumed calorie value corresponding to the determined exercise type is acquired from the schedule storage section 4623 (Step ST1553). Then, a request for transmitting a body data corresponding to the user ID is transmitted to the exercise-data management server apparatus 4, and the body data is acquired from the body data stored in the body-data storage section 4624 (Step ST1555). Then, a user's body weight (standard weight) correlated with the standard consumed calorie value is compared with the user's weight acquired in Step S1555, and a ratio for calculating a consumed calorie value is obtained with reference to a table data (or by a calculation) (Step ST1557). Then, the standard consumed calorie value is multiplied by the ratio to obtain a consumed calorie value (Step ST1559), and the process is terminated. In Step ST1551, when the exercise type is determined as a type to be performed using an exerciser 2, a consumed calorie value displayed on the monitor 24 of the exerciser 2 and held in user's remembrance is accepted from the touch panel 51*a* (Step ST1569), and the process is completed.

Figure 30:
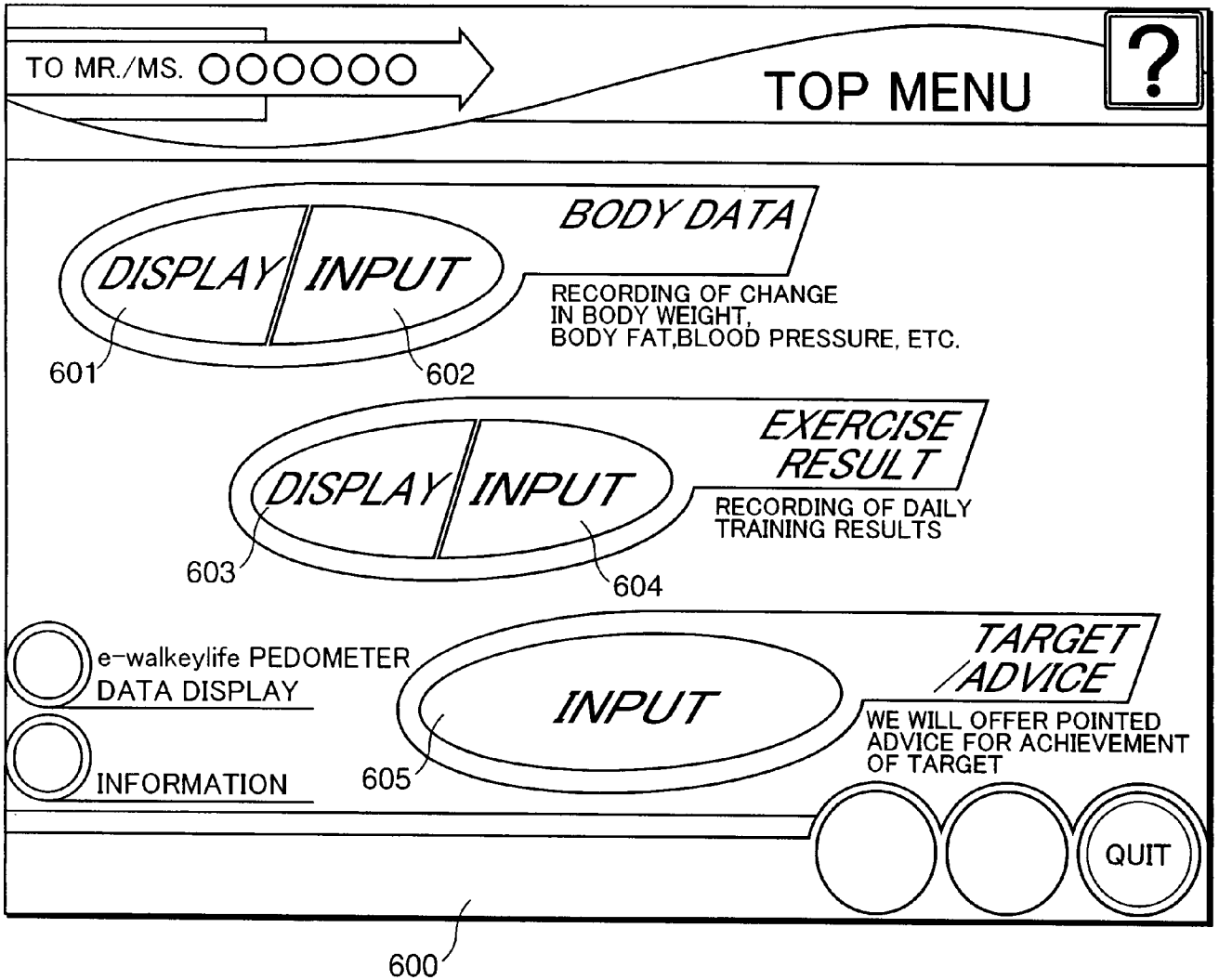
FIG. 30 is a diagram showing one example of a top-menu display screen image to be displayed in Step ST12 in the flowchart illustrated in FIG. 27.

FIG. 30 is a diagram showing one example of the top-menu display screen image to be displayed in Step ST12 in the flowchart illustrated in FIG. 27. The top-menu display screen image 600 includes a body-data display button 601 disposed on an upper left side of the screen image and adapted to allow body data to be displayed by a pushing operation, a body-data input bottom 602 disposed on the right side of the body-data display button 601 and adapted to allow body data to be input by a pushing operation, an exercise-data display button 603 disposed on a central region of the screen image and adapted to allow exercise data to be displayed by a pushing operation, an exercise-data input bottom 604 disposed on the right side of the exercise-data display button 603 and adapted to allow exercise data to be input by a pushing operation, and an advice display button 605 disposed on a lower right side of the screen image and adapted to allow advice to be displayed by a pushing operation. In the top-menu display screen image 600, a user can push down one of the buttons corresponding to an intended processing to select the intended processing.

FIG. 31 is a diagram showing one example of a body-data input screen image to be displayed in Step ST13 in the flowchart illustrated in FIG. 27. The body-data-input screen image 610 includes a body-height display field 611, a body-weight display field 612, a blood-pressure display field 613 and a body-fat display field 614, which are arranged on the left side of the screen image in this order in a downward direction to display a body height, a body weight, a blood pressure and body fat, respectively. On the respective right sides of the display fields 611 to 614, the body-data input screen image 610 includes a body-high correction field 611*a*, a body-weight correction field 612*a*, a blood-pressure correction field 613*a* and a body-fat correction field 614*a*, which are displayed based on the data stored in the body-data storage section 4624 of the exercise-data management server apparatus 4, and adapted to accept an input from the touch panel 51*a* so as to correct or change the respective body data. Further, on the right side, the body-data input screen image 610 includes a numeric keypad field 615 adapted to allow respective body data in the body-high correction field 611*a*, the body-weight correction field 612*a*, the blood-pressure correction field 613*a* and the body-fat correction field 614*a* to be corrected by a pushing operation, a cancel button adapted to allow input data to be cancelled by a pushing operation, and a setup button 617 adapted to allow input data to be set up by a pushing operation (i.e., to allow the input data to be transmitted to the exercise-data management server apparatus 4 and stored in the body-data storage section 4624 through the body-data acceptance section 4618. The client terminal apparatus 5 may be designed to be connected to various types of body data measurement devices, such as a body-height meter, a body-weight meter, a blood-pressure meter or a body-fat meter, so as to display body data measure by the measurement devices, in the body-data input screen image 610

As above, user identification information and user's body data including body weight and body height, are accepted through the body-data acceptance section 4618, and the body data is stored in the body-data storage section 4624 in association with the user identification information. Then, for example, in Step ST60715 illustrated in FIG. 22, using the body data, a consumed calorie value is calculated by the total-consumed-calorie calculation section 4613. Thus, the consumed calorie value can be accurately calculated using the body data to provide enhanced user-friendliness.

FIG. 32 is a diagram showing one example of a body-data display screen image to be displayed in Step ST14 in the flowchart illustrated in FIG. 27. The body-data display screen image 620 includes a body-weight display field 621 disposed on an upper side of the screen image and adapted to display body weight data and body fat percentage, and a blood pressure display field 622 disposed in an approximately central region of the screen image and adapted to display blood pressure data. The body-weight display field 621 has a right vertical axis representing body weight or body fat percentage and a horizontal axis representing date/month, and displays a body weight graph 621*a* and a body fat percentage graph 521*b* which indicate respective transitions in body weight and body fat percentage. The blood-pressure display field 622 has a right vertical axis representing maximum body pressure or minimum body pressure and a horizontal axis representing date/month, and displays a maximum body pressure graph 622*a* and a minimum body pressure graph 662*b* which indicate respective transitions in maximum body pressure and minimum body pressure body. Thus, the user can know a transition of body data.

Figure 33:
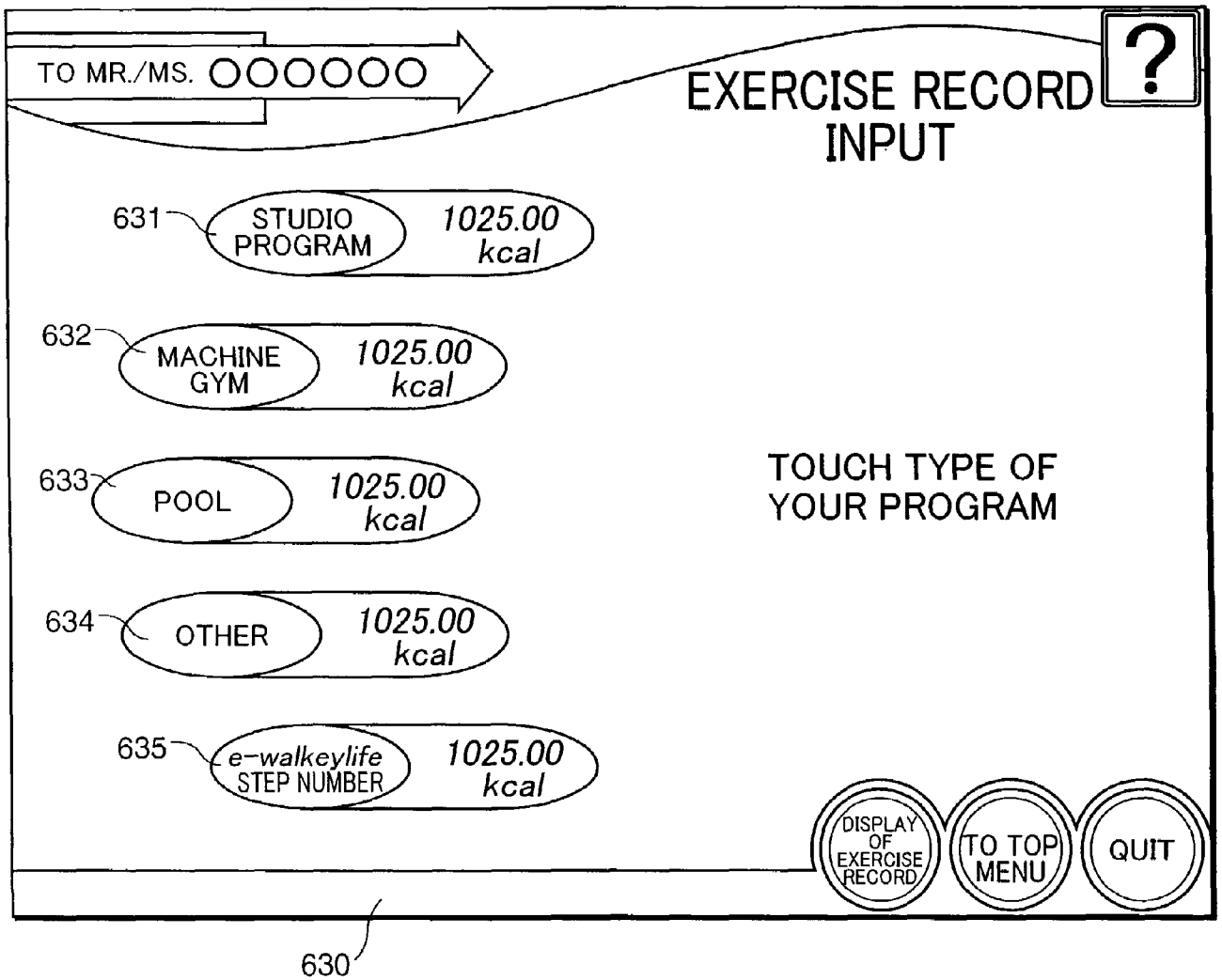
FIG. 33 is a diagram showing one example of a first exercise-data input screen image to be displayed in Step ST15 in the flowchart illustrated in FIG. 27.

FIG. 33 is a diagram showing one example of the first exercise-data input screen image to be displayed in Step ST15 in the flowchart illustrated in FIG. 27. The first exercise-data input screen image 630 includes a studio button 631 to be pushed down when exercise data to be input belongs to a type performed in a studio, a machine gym button 632 to be pushed down when exercise data to be input belongs to a type performed using an exerciser 2, a pool button 633 to be pushed down when exercise data to be input belongs to a type performed in a pool, an extra type button 634 to be pushed down when exercise data to be input belongs to other types performed in the fitness club, and a pedometer button 635 to be pushed down when exercise data to be input belongs to a type recorded in a pedometer 2 (in this example, walking or running). The user can push down either one of the studio button 631, the machine gym button 632, the pool button 633, the extra type button 634 and the pedometer button 635 to display an exercise-data input screen image of an intended one of the exercise types and input exercise data therethrough.

Figure 34:
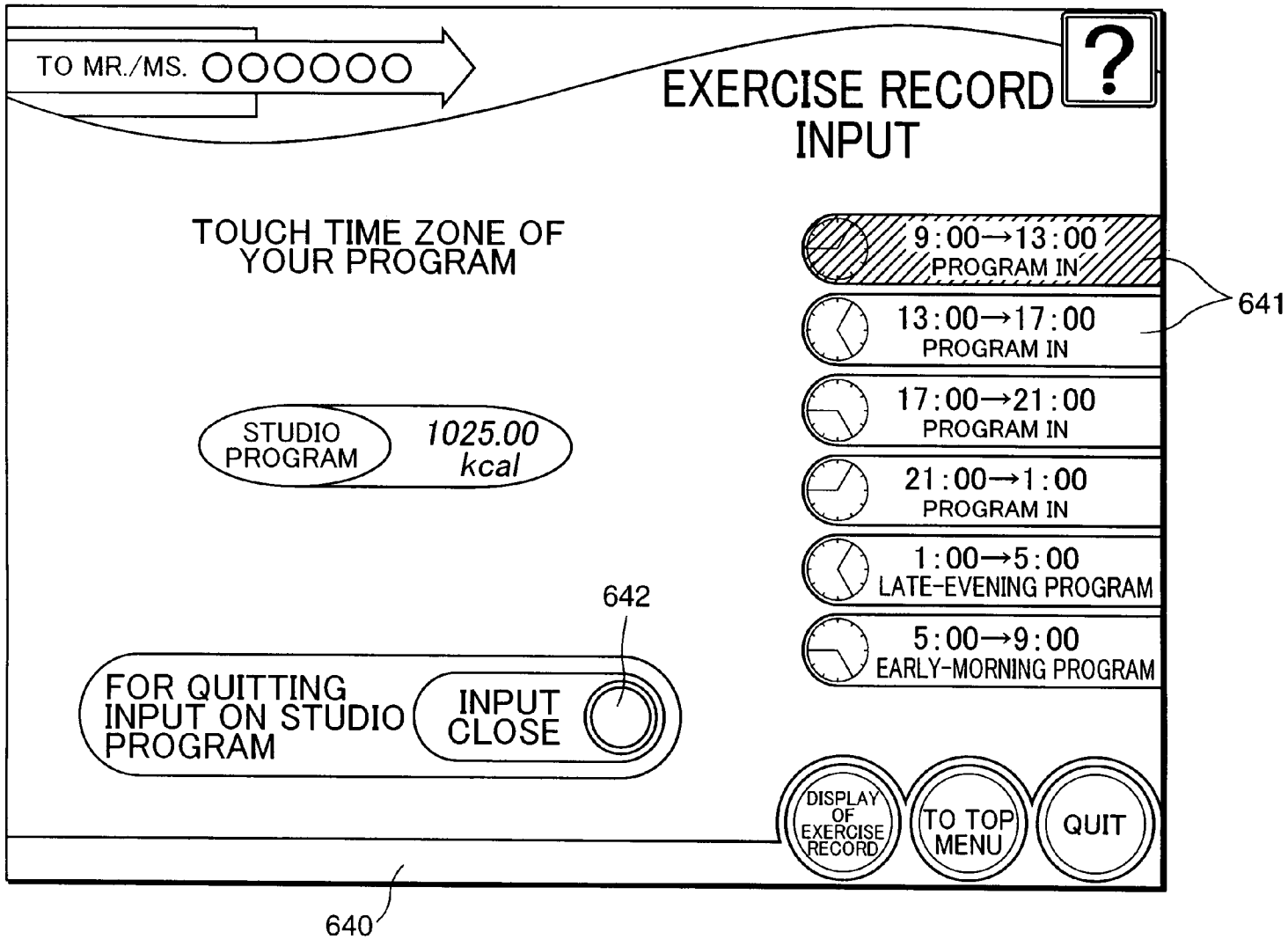
FIG. 34 is a diagram showing one example of a second exercise-data input screen image to be displayed in Step ST15 in the flowchart illustrated in FIG. 27.

FIG. 34 is a diagram showing one example of the second exercise-data input screen image to be displayed in Step ST15 in the flowchart illustrated in FIG. 27. The second exercise-data input screen image 640 is displayed when the studio button 631 in the first exercise-data input screen image 630 is pushed down. The second exercise-data input screen image 640 includes a plurality of time-zone selection buttons 641 disposed on the right side of the screen image and adapted to allow the user to select one of them corresponding to a time zone of user's exercise in a studio, and an input end button 641 disposed on a lower side of the screen image and adapted to be pressed down when the user stops inputting. In FIG. 34, the time-zone selection button indicating "program in time zone of 9:00→13:00" is shaded to show that it is pushed down.

Figure 35:
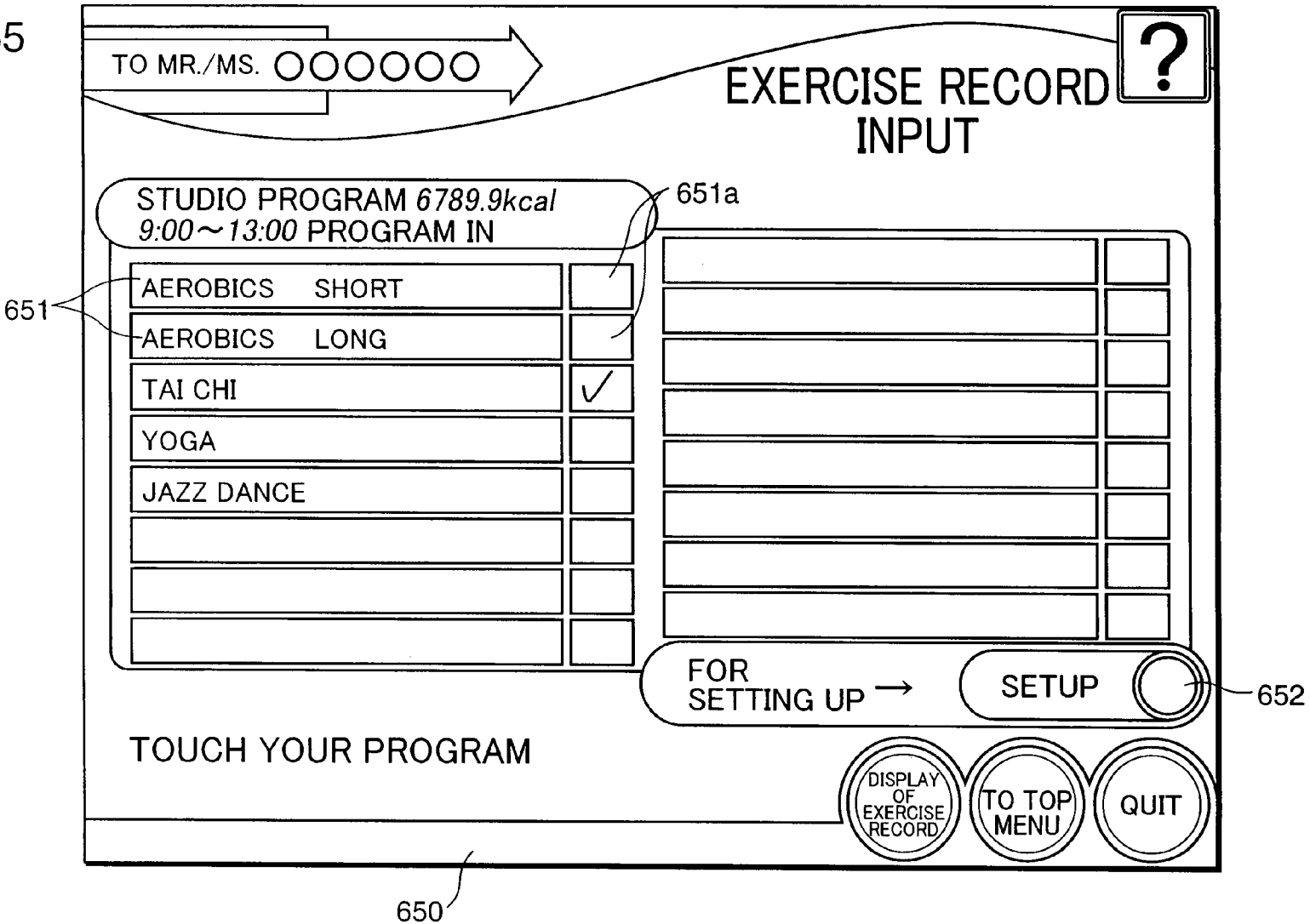
FIG. 35 is a diagram showing one example of a third exercise-data input screen image to be displayed in Step ST15 in the flowchart illustrated in FIG. 27.

FIG. 35 is a diagram showing one example of the third exercise-data input screen image to be displayed in Step ST15 in the flowchart illustrated in FIG. 27. The third exercise-data input screen image 650 is displayed when the uppermost one of the time-zone selection buttons which indicates the "program in time zone of 9:00→13:00" in the second exercise-data input screen image 640 is pushed down. In the third exercise-data input screen image 650, an exercise-type display field 651 corresponding to the "program in time zone of 9:00→13:00" is displayed on the left side thereof, and a check box 651*a* is displayed on the right side of the exercise-type display field 651 to allow the user to select an exercise type performed by the user. In this example, as indicated by a check mark in the check box 651*a* on the right side of "Tai Chi" in the exercise-type display field 651, "Tai Chi" is selected as the exercise type performed by the user. The user can input an exercise type related to exercise data to be input (and the exercise data).

Thus, even if there is an exerciser 2 from which the exerciser-data receiving section 4612 cannot receive user identification information or second exercise data, or even if the clock-time data receiving section 4616 cannot receive user identification information of a studio user or a studio-entrance clock time, an external input is accepted (in this embodiment, information input to the client terminal apparatus 5 is received) by the exercise-data input section 4619, and user identification information and user's exercise data are stored in the exercise-data storage section 4622. Thus, a consumed calorie value in the exercisers 2 (or in the studio) can be reflected to a total consumed calorie value so as to provide enhanced user-friendliness.

FIG. 36 is a diagram showing one example of an exercise-data display screen image to be displayed in Step ST16 in the flowchart illustrated in FIG. 27. The exercise-data display screen image 660 includes a total consumed calorie value display field 661 disposed on an upper side of the screen image and adapted to indicate a total consumed calorie value of the user, a consumed calorie segment display field 662 disposed on a lower side of the total consumed calorie value display field 661 and adapted to indicate a consumed calorie value consumed in each facility of the fitness club and a consumed calorie value measured by a pedometer 1, and a columnar graph 663 indicating a ratio of each consumed calorie value displayed in the consumed calorie segment display field 662 in a segmented manner to the total consumed calorie value. As seen in FIG. 36, the total consumed calorie value is "350.0 Kcal", and calories consumed in the studio are "70.0 Kcal", i.e., "20%" of the total consumed calorie value.

FIG. 37 is a diagram showing one example of an advice display screen image to be displayed in Step ST17 in the flowchart illustrated in FIG. 27. The advice display screen image 670 includes a target value display field 671 disposed on an upper side of the screen image and adapted to indicate a target total consumed calorie value of the user for one month, an advice display field 672 disposed in an approximately central region of the screen image and adapted to display an advice in a message form, and a graph display field 673 disposed on a lower side of the screen image and adapted to indicate a graph which has a horizontal axis representing day/month and a vertical axis representing an accumulated consumed calorie value. The graph display field 673 includes a target value curve 673*a* indicating the transition of a target accumulated consumed calorie value, and an actual value curve 673*b* indicating the transition of an actual accumulated consumed calorie value. In this example, the actual value curve 673*b* is lower than the target value curve 673*a*. Thus, an advice "How is your physical condition? It might be difficult to achieve your target if nothing is done. We recommend you to correct the current target" is displayed in the advice display screen image 670. In consideration of this advice, the user can take action about correction of the target or the like. The user can also know a remaining consumed calorie value which is a difference between the target total consumed calorie value and the total consumed calorie value. Thus, a target setting and motivation for exercises can be promoted by allowing each user to check the remaining consumed calorie value to be consumed in the fitness club.

In the present invention, the following configurations may be employed.

(A) While the above embodiment has been described based on one example where a fitness facility is a studio, the fitness facility may be any other fitness facility, such as a swim pool, where each type of exercise is performed according to date or time zone.

(B) The above embodiment has been described based on one example where the clock-time data receiving section 4616 receives IC-chip ID, a gate number and a studio-entrance clock-time. Alternatively, the clock-time data receiving section 4616 may be configured to receive IC-chip ID and a gate number, and a studio-entrance clock-time may be determined using a clock function of the exercise-data management server apparatus 4. In this case, the clock counter 32 of the studio gate 3 may be omitted, and an information transmission quantity from the studio gate 3 to the exercise-data management server apparatus 4 can be reduced.

(C) The above embodiment has been described based on one example where the personal authentication in the fitness club is performed based on IC-chip ID stored in the IC chip 7 embedded in the wristband 8. Alternatively, the personal authentication may be performed based on a user ID stored in the IC card 6.

(D) The above embodiment has been described based on one example where the schedule storage section 4623 stores an exercise type to be performed in each studio, in association with a gate number, date and a time zone, with respect to each studio arranged in the fitness club in association with the gate number. If the exercise type is determined based on a day of the week and a time zone, the schedule storage section 4623 may store an exercise type to be performed in each studio, in association with a gate number, a day of the week and a time zone, with respect to each studio arranged in the fitness club in association with the gate number.

(E) The above embodiment has been described based on one example where the studio gate 3 is provided in a plural number. In reality, some fitness clubs have only a single studio. The present invention can also be applied to such a case. Specifically, in addition to the configuration where the studio gate is set up in each of a plurality of studios, and information for identifying the respective studios is stored in the gate-number storage section 33, the present invention may include a configuration where a single studio gate is set up in a single studio of a fitness club. In this case, the switch 360 (see FIG. 4) for setting a gate number may be omitted. Further, the clock-time data receiving section 4616 is not required to receive a gate number.

(F) While the above embodiment has been described based on one example where the total-consumed-calorie calculation section 4613 calculates a consumed calorie value using body weight in body data, the consumed calorie value may be calculated using any other body data (e.g., body height or age). Further, the consumed calorie value may be calculated using an average consumed calorie value.

(G) In the above embodiment, an exercise time zone (i.e., a time zone in which an exercise is to be performed) stored in the schedule storage section 4623 (first storage means) is set based on an actual time period between the start of an exercise and the end of the exercise. In this case, a clock time of an authentication operation performed by a user who entered into a studio before the start of the exercise is likely to be out of a schedule (free time). Thus, the time zone is preferably set to include a time period for accepting an entrance to a studio (e.g., ten minutes before the start of the exercise). In this case, the consumed calorie value may also be calculated in consideration on an actual time width of the start of the exercise.

(H) While the exercise-data management server apparatus 4 in the above embodiment is configured to incorporate the schedule storage section 4623 storing the exercise time zone as a schedule, the present invention is not limited to such a configuration, a schedule management section having at least the function of the schedule storage section 4623 may be provided in a separated or sharable manner, and the schedule information may be stored in or managed by the schedule management section. In this case, it may also be generally construed that the exercise-data management server apparatus 4 includes such a schedule management section. Further, in this case, the schedule management section may have a time table designed to allow an administrator or operator to write a schedule thereinto, and an exercise schedule to be sequentially arranged may be written into the time table to achieve enhanced user-friendliness. Further, the time table of the schedule management section to be updated can be maintained and managed to eliminate a time-consuming operation required for maintenance and others.

In summary, the present invention provides an exercise-data management system for managing information about participant's exercise results, which comprises portable unique-information storage means recording therein unique information for authenticating a participant, a reader apparatus set up corresponding to a location where an exercise is performed and adapted to read the unique information recorded in the unique-information storage means, and an exercise-data management server apparatus set up at a given location. In the exercise-data management system, the reader apparatus includes a reader-side communication section operable, when the unique information is read, to transmit information indicating the read to the exercise-data management server apparatus. Further, the exercise-data management server apparatus includes first storage means storing, as a schedule, a time zone in which an exercise is to be performed, second storage means storing predetermined exercise result-related information in association with respective types of exercises, server-side communication means operable to receive, from the reader apparatus, the unique information and the read-indicating information of the unique information, and exercise data acquisition means operable, based on the unique information and the read-indicating information each received by the server-side communication means and the contents stored in the first and second storage means, to acquire predetermined information about an exercise result of a participant who has taken along the unique-information storage means.

In the exercise-data management system of the present invention, when a user performs an operation for allowing the reader apparatus to read the unique information for authenticating a participant (the user) from the unique-information storage means, i.e., a one-time operation, the unique information is read by the reader apparatus, and the unique information and the read-indicating information are transferred to the exercise-data management server apparatus through the reader-side communication section and the server-side communication means. When the reader apparatus is equipped with a clock-time counter, the read-indicating information includes clock-time information. If the reader apparatus has no built-in clock-time counter (in this case, a clock-time counter is built in the exercise-data management server apparatus), the read-indicating information will consist of information indicating a read processing at a time of the read. The exercise data acquisition means of the exercise-data management server apparatus acquires clock-time information from the received information, and collates the clock-time information with the stored content of the first storage means to identify the type of exercise (exercise category) corresponding to the time zone including the received clock-time data and acquire predetermined information about an exercise result corresponding to the identified exercise type, from the stored content of the second storage means.

As above, the exercise-data management system makes it possible to perform the operation for allowing the reader apparatus to read the unique information for authenticating a participant, from the portable unique-information storage means recording therein the unique information, through a one-time operation, and manage the predetermined exercise-related information based on the read operation. This can provide enhanced operationality or user-friendliness. In addition, the reader apparatus is designed to have a simplified configuration having only functions of read and communication with the exercise-data management server apparatus without other function, such as data analysis, so as to ensure high reliability and minimize occurrence of malfunction and failure even in studio environments having vibrations and temperature variations.

As a second aspect of the invention, the reader apparatus is formed to have transportability, and provided with setting means for setting locational information about a setup location thereof, and the reader-side communication section is operable to transmit the read unique information to the exercise-data management server apparatus together with the locational information.

In this exercise-data management system, the reader apparatus is an independently transportable type instead of a type, for example, of being embedded in a wall, and can transmit information for identifying the setup location thereof to the exercise-data management server apparatus. Thus, for example, in a fitness club having a plurality of studios and/or swim pools, when the layout of the studio is changed or when a reader apparatus used in one of the studios is used for training in the pool, the reader apparatus can be moved and used. When the setup location is changed in this manner, the setting means, such as a setup location selector switch provided in a housing of the reader apparatus, may be manually operated to update from locational information about a current setup location to locational information about a new setup location so as to identify the new setup location. A selector switch, such as a toggle switch or a DIP switch, may be used as the setting means. This makes it possible to eliminate the need for updating the content of a collation table for collimating between locational information and identification information of each reader apparatus.

In a system where a reader apparatus for checking entrance into a studio is embedded into a wall, it is impossible to change a layout of the reader apparatus in consideration of circulation during user's entrance into the studio or change a way to use an interior space of the studio. In the reader apparatus in the second aspect of the invention, the location of the reader apparatus can be freely changed after checking an actual situation of user's entrance.

Further, a large-scale studio is occasionally used in an event of a fitness club. For this event, additional reader apparatuses can be set up in the same studio to allow a read operation to be performed at a plurality of locations so as to prevent a large number of users after entering in the studio from concentrating in one location and waiting their turns. On this occasion, flexible measures can be taken, for example, by temporarily using reader apparatuses usually set up at other studios or swim pools. In this case, by use of the setting means, locational information in each of the additional reader apparatuses may be changed to a location of the large-scale studio, and, after completion of the event, returned to the respective original locations. The transportability may be in a manually transportable range, preferably, in a form (size and/or weight) allowing a person to hold and carry it.

In the exercise-data management system as the $2^{nd}$ aspect, when the layout of a studio is changed or when a reader apparatus used in a certain studio is used for training in a swim pool, flexible measures can be taken. In addition, the location of the reader apparatus can be freely changed after checking actual situation of user's entrance. Further, for example, when a large-scale studio is used, additional reader apparatuses can be set up in the studio to allow a read operation to be performed at a plurality of locations. On this occasion, flexible measures can be taken, for example, by temporarily using a reader apparatus usually set up at other studio or swim pool.

As a $3^{rd}$ aspect of the invention, the unique-information storage means includes a transmitter for transmitting the unique information within a relatively short distance in space, and the reader apparatus includes a receiver for receiving the unique information transmitted from the transmitter. In this exercise-data management system, the read of the unique information can be completed by performing a manual operation of bringing the unique-information storage means close to the reader apparatus, only once. As used in this specification, the term "relatively relatively short distance" means a detectable distance to the extent that the read is not performed when a user with the unique-information storage means stands adjacent to the reader apparatus or passes by the reader apparatus.

In the exercise-data management system as the $3^{rd}$ aspect, the read operation can be performed only by bringing the portable unique-information storage means close to the reader apparatus, to provide further enhanced operationality. Different from an insertion-type card reader, the proximity type reader apparatus has no exposed portion to achieve high environment resistance, such as low susceptibility to excess humidity in a studio.

As a $4^{th}$ aspect of the invention, the reader apparatus has a guide mark indicated on a front surface of a housing thereof to guide the participant to bring the unique-information storage means close thereto. In this exercise-data management system, the guide mark is indicated on the front surface of the reader apparatus to guide how to allow the unique information to be read. This makes it possible to prompt a user to perform a correct read operation.

As a $5^{th}$ aspect of the invention, the reader apparatus includes an annunciation section operable, in response to reading the unique information, to perform an annunciating action. In this exercise-data management system, when the reader apparatus recognizes the unique information, information indicating the read is annunciated to a user using, for example, a light-emitting element or a sound-generating element, to effectively annunciate the completion of read. The reader apparatus may be designed such that it does not recognize the content of unique information but only a type of unique information, and the annunciating action is performed in response to receiving a signal representing the type of unique information. In this case, the content of unique information is recognized by the exercise-data management server apparatus.

As a $6^{th}$ aspect of the invention, the server-side communication means is operable, in response to receiving the unique information, to return an acknowledge signal to the reader apparatus, and the reader apparatus includes an annunciation section operable, in response to receiving the acknowledge signal, to perform an annunciating action. In this exercise-data management system, when the exercise-data management server apparatus receives the unique information from the reader apparatus, the acknowledge signal is returned from the exercise-data management server apparatus. In response to receiving the acknowledge signal, annunciation section performs the annunciating action. This makes it possible to effectively annunciate that the read operation has been correctly performed.

As a $7^{th}$ aspect of the invention, the second storage means stores, as the predetermined exercise result-related information associated with respective types of exercises, assumed consumed calorie values to be consumed through the respective types of exercises performed by a participant, and the exercise data acquisition means is operable to calculate a consumed calorie value of a participant. In this exercise-data management system, a consumed calorie value as an exercise result is calculated only by performing the operation of allowing the reader apparatus to read the unique information. This makes it possible to reflect a consumed calorie value to an exercise (training) using no exerciser (exercise machine), which has been difficulty to be achieved by the conventional system.

As an $8^{th}$ aspect of the invention, the exercise-data management system includes third storage means storing authentication information of a participant and personal information of the participant in a mutually associated manner. Further, the exercise data acquisition means is operable to calculate a consumed calorie value of the participant using the personal information. In the exercise-data management system, a consumed calorie value is calculated using the personal information, such as body weight. This makes it possible to acquire a further accurate consumed calorie value.

As a $9^{th}$ aspect of the invention, the present invention relates to an exercise-data management server apparatus for use in a system for managing information about participant's exercise results which comprises portable unique-information storage means recording therein unique information for authenticating a participant; a reader apparatus arranged in a location corresponding to where an exercise is performed and adapted to read the unique information recorded in said unique-information storage means; wherein said reader apparatus including a reader-side communication section operable, when the unique information is read, to transmit information indicating having read said unique information to said exercise-data management server apparatus. The exercise-data management server apparatus being provided in a given location, comprises: first storage means storing, as a schedule, a time zone in which an exercise is to be performed; second storage means storing predetermined exercise result-related information in association with a type of exercise; server-side communication means operable to receive, from said reader apparatus, said unique information and the read-indicating information of said unique information; and exercise data acquisition means operable, based on the unique information and the read-indicating information each received by said server-side communication means, and the contents stored in said first and second storage means, to acquire predetermined information about an exercise result of a participant who has taken along said unique-information storage means.

The exercise-data management server apparatus can be suitably used in the exercise-data management system.

This application is based on Japanese Patent Application Serial No. 2005-362306, filed with Japan Patent Office on Dec. 15, 2005, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An exercise-data management system for managing information about participant's exercise results, comprising:

portable unique-information storage means recording therein unique information for authenticating a participant;

a reader apparatus arranged in a location corresponding to where an exercise is performed, and adapted to read the unique information recorded in said unique-information storage means; and an exercise-data management server apparatus arranged in a given location;

wherein:

said reader apparatus including:

a reader-side communication section operable, when the unique information is read, to transmit information indicating having read said unique information to said exercise-data management server apparatus; and said exercise-data management server apparatus including:

first storage means storing, as a schedule, a time zone in which an exercise is to be performed;

second storage means storing predetermined exercise result-related information in association with a type of exercise;

server-side communication means operable to receive, from said reader apparatus, said unique information and the read-indicating information of said unique information; and exercise data acquisition means operable, based on the unique information and the read-indicating information each received by said server-side communication means, and the contents stored in said first and second storage means, to acquire predetermined information about an exercise result of a participant who has taken along said unique-information storage means.

2. The exercise-data management system as defined in claim 1, wherein:

said reader apparatus is formed to have transportability, and provided with setting means for setting locational information about a setup location thereof; and said reader-side communication section is operable to transmit the read unique information to said exercise-data management server apparatus together with said locational information.

3. The exercise-data management system as defined in claim 1, wherein:

said unique-information storage means includes a transmitter for transmitting the unique information within a relatively short distance in space; and said reader apparatus includes a receiver for receiving the unique information transmitted from said transmitter.

4. The exercise-data management system as defined in claim 3, wherein said reader apparatus has a guide mark indicated on a front surface of a housing thereof to guide the participant to bring said unique-information storage means close thereto.

5. The exercise-data management system as defined in claim 1, wherein said reader apparatus includes an annunciation section operable, in response to reading the unique information, to perform an annunciating action.

6. The exercise-data management system as defined in claim 1, wherein:

said server-side communication means is operable, in response to receiving the unique information, to return an acknowledge signal to said reader apparatus; and said reader apparatus includes an annunciation section operable, in response to receiving said acknowledge signal, to perform an annunciating action.

7. The exercise-data management system as defined in claim 1, wherein:

said second storage means stores, as said predetermined exercise result-related information associated with respective types of exercises, assumed consumed calorie values to be consumed through said respective types of exercises performed by a participant; and said exercise data acquisition means is operable to calculate a consumed calorie value of a participant.

8. The exercise-data management system as defined in claim 7, which includes third storage means storing authentication information of a participant and personal information of said participant in a mutually associated manner, wherein said exercise data acquisition means is operable to calculate a consumed calorie value of the participant using said personal information.

9. An exercise-data management server apparatus for use in a system for managing information about participant's exercise results which comprises portable unique-information storage means recording therein unique information for authenticating a participant; a reader apparatus arranged in a location corresponding to where an exercise is performed and adapted to read the unique information recorded in said unique-information storage means; wherein said reader apparatus including a reader-side communication section operable, when the unique information is read, to transmit information indicating having read said unique information to said exercise-data management server apparatus; said exercise-data management server apparatus being provided in a given location, comprising:

first storage means storing, as a schedule, a time zone in which an exercise is to be performed;

second storage means storing predetermined exercise result-related information in association with a type of exercise;

server-side communication means operable to receive, from said reader apparatus, said unique information and the read-indicating information of said unique information; and exercise data acquisition means operable, based on the unique information and the read-indicating information each received by said server-side communication means, and the contents stored in said first and second storage means, to acquire predetermined information about an exercise result of a participant who has taken along said unique-information storage means.

* * * * *